US012403355B2

(12) United States Patent
Porter

(10) Patent No.: US 12,403,355 B2
(45) Date of Patent: Sep. 2, 2025

(54) CORE TRAINING DEVICE AND METHOD

(71) Applicant: Rebound Box Limited, Birmingham (GB)

(72) Inventor: Luke Leonard Martin Porter, Birmingham (GB)

(73) Assignee: REBOUND BOX LIMITED, Birmingham (GB)

( * ) Notice: Subject to any disclaimer, the term of this patent is extended or adjusted under 35 U.S.C. 154(b) by 333 days.

(21) Appl. No.: 17/914,625

(22) PCT Filed: Mar. 23, 2021

(86) PCT No.: PCT/GB2021/050705
§ 371 (c)(1),
(2) Date: Sep. 26, 2022

(87) PCT Pub. No.: WO2021/191595
PCT Pub. Date: Sep. 30, 2021

(65) Prior Publication Data

US 2023/0123007 A1 Apr. 20, 2023

(30) Foreign Application Priority Data

Mar. 25, 2020 (GB) ..... 2004311
Jun. 18, 2020 (GB) ..... 2009354
(Continued)

(51) Int. Cl.
*A63B 23/02* (2006.01)
*A63B 21/00* (2006.01)

(52) U.S. Cl.
CPC ..... *A63B 23/0211* (2013.01); *A63B 21/154* (2013.01); *A63B 21/4007* (2015.10);
(Continued)

(58) Field of Classification Search
CPC ..... A63B 23/0211; A63B 21/154; A63B 21/4007; A63B 21/4035; A63B 21/4047;
(Continued)

(56) References Cited

U.S. PATENT DOCUMENTS 3,708,164 A * 1/1973 Griffin ..... A63B 23/14 482/46
5,096,199 A * 3/1992 Wyatt, Jr ..... A63B 21/0442 473/215
(Continued)

FOREIGN PATENT DOCUMENTS

WO 02083054 A1 10/2002
WO 2006129979 A1 12/2006

OTHER PUBLICATIONS

GB2004311.3 UKIPO Search Report dated Aug. 14, 2020(2 pages).
(Continued)

*Primary Examiner* — Garrett K Atkinson
(74) *Attorney, Agent, or Firm* — Amundsen Davis, LLC

(57) ABSTRACT

The present invention provides an exercise device (100) for exercising core muscles of a user's torso. The exercise device comprises a frame (110), configured to be supported by the user and a radially outwardly facing channel (130; FIG. 6), the channel (130) configured to receive a resistance member. The frame defines an aperture (112) configured to receive a torso of the user and the device (100) is configured to provide a resistance force against which the user can exercise when the device (100) is in use. Also claimed is a kit of parts comprising the device (100) and a resistance member, and a method of exercising core muscles of one's torso.

20 Claims, 70 Drawing Sheets

(30) Foreign Application Priority Data

| | | |
|---|---|---|
| Jul. 6, 2020 | (GB) | 2010343 |
| Aug. 3, 2020 | (GB) | 2012040 |
| Nov. 2, 2020 | (GB) | 2017336 |
| Nov. 12, 2020 | (GB) | 2017862 |
| Dec. 3, 2020 | (GB) | 2019070 |

(52) U.S. Cl.
CPC ..... *A63B 21/4035* (2015.10); *A63B 21/4047* (2015.10); *A63B 2225/685* (2013.01)

(58) Field of Classification Search
CPC ..... A63B 2225/685; A63B 2071/0063; A63B 21/00061; A63B 21/00065; A63B 21/0552; A63B 21/0557; A63B 21/169; A63B 21/222; A63B 21/4005; A63B 21/4017; A63B 21/4039; A63B 21/4049; A63B 23/03525; A63B 23/0355; A63B 21/0004
See application file for complete search history.

(56) References Cited

U.S. PATENT DOCUMENTS 5,209,482 A * 5/1993 Hopfer ..... A63B 69/0059 482/904
5,498,221 A * 3/1996 Blair, Jr. ..... A63B 23/03575 482/99
5,517,948 A * 5/1996 Udelle ..... A01K 15/025 119/706
5,690,494 A * 11/1997 Luker ..... A63B 21/0552 473/277
D405,563 S * 2/1999 Baiera ..... D30/160
6,099,444 A * 8/2000 Domenge ..... A63B 21/0608 482/110
6,440,047 B1 * 8/2002 Huang ..... A63B 19/00 446/236
6,488,613 B1 * 12/2002 Domenge ..... A63B 21/22 482/148
6,500,102 B1 * 12/2002 Domenge ..... A63B 15/005 482/148
7,662,072 B1 * 2/2010 Chen ..... A63B 43/007 482/81
8,814,765 B2 * 8/2014 Bernstein ..... A63B 21/4035 482/110
9,616,267 B2 * 4/2017 Sassano ..... A63B 21/00043
2002/0155781 A1 * 10/2002 Lee ..... A63B 19/00 446/236
2003/0134727 A1 * 7/2003 Yu ..... A63B 23/03508 482/44
2005/0096200 A1 * 5/2005 Amann ..... A63B 21/0602 482/110
2010/0190620 A1 * 7/2010 Chen ..... A63B 21/4009 482/110
2016/0193517 A1 * 7/2016 Angulo ..... A63B 69/0057 482/92

OTHER PUBLICATIONS

PCT/GB2021/050705 International Search Report and Written Opinion of the International Searching Authority dated Jun. 22, 2021(8 pages).

* cited by examiner

CORE TRAINING DEVICE AND METHOD

TECHNICAL FIELD

The disclosure relates generally to exercise devices. More particularly, the disclosure relates to portable exercise devices, and more specifically, the disclosure relates to portable exercise devices for training the core muscles of the body, and to methods for doing so.

BACKGROUND

The core muscles of the torso are essential for most activities involving movement. Core muscle strength is required for a variety of sports and particularly for sports in which a club, bat or racquet is swung around the body.

Many exercise devices exist which are suitable for training the core muscles. One example is a rowing machine, with which a user simulates the motion of rowing whilst pulling a handle which provides resistance. Whilst devices such as rowing machines provide suitable pieces of equipment with which to exercise, they are expensive and take up a large amount of space, making them unsuitable for many people. Additionally, some people may travel frequently and therefore they may require equipment which is portable.

If a user adopts a particular (bad) posture during exercise, he or she may become injured and may damage his or her muscles, which can in turn cause the user to experience pain. After sustaining an injury it is more difficult for a user to exercise, even if different muscles are being trained to those which are injured. As such, it is important for a user to maintain a predetermined, correct, posture which reduces his or her risk of becoming injured during exercise. People who have not exercised regularly in the past may be unaware of how to position themselves if he or she wishes to avoid injury, or indeed how to position themselves to get the most effective muscle development. Some of the exercise devices which are currently available require the user to operate the device in a very specific way, which the user may be unaware of.

Low intensity exercise can be beneficial for a wide variety of people with different needs. For example, for a person who is recovering from a previous injury and is undergoing rehabilitation, high intensity exercise can cause the injury to reoccur. As such, he or she may choose to start off with low intensity exercise initially in order to prevent this. Similarly, a person who is currently injured may want to maintain his or her general fitness levels by continuing to perform low intensity exercise which will not affect the injured part of his or her body. It is therefore beneficial to be able to exercise specific muscles or muscle groups, in a controlled predictable way.

Some exercise devices which are currently available only operate within certain limits of resistance to movement and do not provide a big enough variation in difficulty to accommodate for the people of different needs. For example, some devices which operate using weights may not provide a level of exercise which accessible to people who are new to exercising certain muscles or muscle groups. In contrast, certain devices only operate at a level which is not demanding enough for an experienced user to be able to exercise properly.

An exercise device for training the core muscles that addresses at least some of the issues described above is desired.

SUMMARY OF INVENTION

According to an aspect of the invention there is provided an exercise device for exercising core muscles of a user's torso. The exercise device comprises a frame, configured to be supported by the user and a radially outwardly facing channel, the channel configured to receive a resistance member. The frame defines an aperture configured to receive a torso of the user and the device is configured to provide a resistance force against which the user can exercise when the device is in use.

The aperture may be partly defined by the frame and partly defined by another component such as a strap or support. The aperture may be defined as a void into which a user can place his or her torso. The aperture may be an open aperture, in that the frame does not completely encompass a user when the device is in use.

The frame may have a curved bow shape. The frame may have a convex outer surface that defines the channel. The frame may have a concave and/or padded inner portion adapted to abut or be closely spaced from the user's torso. The aperture may be about 180 degrees and the bow may extend about 180 degrees about the torso/aperture when the device is in use.

The channel may be discontinuous. The device may comprise a first frame section and a plurality of second frame sections extending radially outwardly from the first frame section. Each of the second frame sections may comprise part of the channel. The device may comprise an upper rail and a lower rail. Each of the upper rail and lower rail may be coupled to a frame member of the device by a joint at a plurality of points along the length of the frame member. The rails and joints may form a discontinuous channel. The upper and rails may militate against a resistance member from becoming dislodged from the channel in use.

The frame may be formed from an outer curve and an inner curve that meet at junctions. The junctions may be at opposite ends of the frame. The frame may comprise one or more struts that join the inner and outer curves. The frame may line in a common plane. In other words, the strut or struts and inner and outer curves may lie on a single, common plane.

The frame may comprise a maximum radius in the range of 200-1000 mm, 200-500 mm, or 300-400 mm. The frame may comprise a maximum thickness, measured substantially perpendicularly to a radius of the frame, in the range of 20-100 mm, 20-50 mm, or 30-50 mm. A maximum radius of the frame may be in the range of 2-50, 2-20, 2-10 or 5-10 times a maximum thickness of the frame, measured substantially perpendicularly to the maximum radius of the frame. The thickness of the frame excludes any handles which may project away from a generally planar nature of the frame.

At least part of the frame, such as the inner and/or outer curve, may be constructed from a curved box section, for example a metal curved box section. A cross-section of the curved box section may be square, or any other suitable polygonal shape such as rectangular, triangular or circular. Where the cross-section of the curved box section is square, the height and width of the square cross-section may be in the range of 20-100 mm, 20-50 mm, or 30-50 mm.

The inner curve may be flexible. A flexible inner curve may allow the device to flex to various body shapes of prospective users.

The device may be substantially symmetrical across a sagittal plane and/or a transverse plane of the user's body when the device is held in a use position by the user.

The curved bow shape may be formed along an arc of 120° or more. The aperture may be formed between a corresponding arc of 240° or less.

The device may comprise a thoracic support adapted in use to engage the front of the user's torso. The device may comprise a lumbar support adapted in use to contact the back of a user. One or both of the thoracic support and the lumbar support may be padded.

The device may comprise a closure strap that in use extends from the ends of the bow shaped frame behind a user, and may be attached to one or both ends of the bow. One or both of the attachments between the strap and the bow may be releasable attachments. One attachment may be a fixed attachment and the other may be a releasable attachment. The closure strap may be adjustable in length. The closure strap may have the lumbar support on it. The lumbar support may be attached to the closure strap or formed within it.

The resistance member may be attachable or attached to one end of the bow.

The resistance member may be attachable or attached to a centre point of the bow.

A pair of resistance members may be provided, or more than two.

The resistance force may be provided as a tangential force. Using a tangential force can provide the user with a uniform and/or controllable force. This can help a user with form and technique and prevent a user from 'cheating' by varying arm position or resistance during an exercise movement.

The resistance force may be configurable by the user. This can allow the user to increase or decrease intensity of exercises accordingly. It can also allow the device to be used by both physically stronger and weaker users.

The exercise device may be light weight and may have a mass of less than 10 kg. The exercise device may be readily picked up by a user and be transportable.

The aperture may have a diameter of between 30 cm and 130 cm. The aperture may be sized to fit a range of human torsos. Various iterations of the device may have varying aperture sizes in order to be used by different target users.

The channel may be situated at, proximal to, or radially inwardly displaced from a perimeter of the frame.

The channel may have a depth that is about 50% as deep as the diameter of the resistance member, or deeper; or about as deep as the diameter of the resistance member or deeper; or of at least twice the diameter of the resistance member, and preferably at least four times or six times.

Having a channel depth greater than a diameter of the resistance member reduces the chances of the resistance member being displaced from the channel. A deeper channel can further reduce the chances of displacement.

The frame may lie on a plane and the channel may extend at one or more points in a direction transverse to the plane. Extending the channel may broaden or deepen or both and broaden and deepen the channel. Broadening and/or deepening the channel can mitigate the resistance member coming unseated from the channel. The broadening may also militate against any rebound of the resistance member should it become detached. This may prevent against the resistance member 'twanging' and potentially striking the user. The extension or extensions to the channel may comprise 'anti-twang' clips or shields. The clips or shields may be releasable components that are releasably attachable to the frame.

The 'anti-twang' clips or shields may extend 5 cm, 10 cm or more transverse to the plane of the frame and may optionally extend substantially equidistantly above and below the plane of the frame.

The aperture may have a central axis that is collinear with a central axis of the frame.

Aligning the axes may provide an ergonomically preferable stance to the user and may also provide improved posture and alignment of the users limbs when exercising with the device.

The exercise device may further comprise handles for providing a device supporting means to the user.

The exercise device may comprise multiple sets of handles, and/or handles that are adjustable relative to the frame, to provide differing hand/arm position for the user when the device is in use.

The frame may define one or more slots that face in a downwards direction when the device is in use. The slots may be configured to receive the handles. The slots may be curved slots. The curved slots may follow the curve of the frame. The handles may be angularly movable within the slots. The handles may be securable at a plurality of positions within the slots. Securing the handles at a position within the slots may comprise locking the handles in place in a position that is appropriate for the user to hold and support the device.

The handles may be positioned on the inner or the outer curve.

Providing multiple handles, or adjustable handles, may allow different users to use the device (for example users having differing arms spans). It may also provide a user with the option to vary his hand position in order to enact different exercise movements.

The frame may lie on a plane and the handles may extend transversely to the plane. Having the handles perpendicular, or otherwise angled to, a plane of the frame may provide a more ergonomic position for the users hands and/or arms.

The handles may be radially outwardly displaced from the aperture.

The frame may comprise a plurality of releasably attachable sections.

Having releasably attachable sections may provide the device with a means for it to be dismantled for storage and/or transport. It may also provide a means for sections of the device to be swapped or modified. For example a size of the aperture may be modified by providing various inner sections that define different sized apertures in order to fit different user body types and sizes.

The exercise device may comprise an attachment point for attaching the resistance member to. The exercise device may comprise a plurality of attachment points for attaching the resistance member to.

The exercise may comprise an attachment point for attaching the resistance member at a first end of the bow.

The exercise may comprise an attachment point for attaching the resistance member at a second end of the bow.

The exercise may comprise an attachment point for attaching the resistance member to at a centre point of the bow.

A plurality of resistance members may be used with a plurality of attachment points. A plurality of resistance members may be used with a single attachment point. Using multiple attachment points and resistance members may provide a user a means to alter a twisting direction without reconfiguring the device, providing a means to vary exercises and ensure balanced work-out routines.

The attachment point may be a hole (through which the resistance member could be passed and tied or restricted by), a strut (around which the resistance member could be tied or a clip/carabiner or the like of the resistance member could be clipped) or a clip or carabiner or the like (which could attach to a corresponding loop, clip or the like of the resistance member).

When in-use, a portion of the resistance member may be seated in the channel.

The resistance member may be seated in the channel along an arc of 90° or more.

Seating the resistance member may provide a tangential relationship between the exercise device and a resistance point, and therefore a tangential resistance force. The exercise device may comprise the resistance member.

The resistance member may be attached to the frame or another structural part of the device.

The resistance member may comprise a cable (band, strap, rope, or other elongate apparatus) configured to be connected to the frame and further configured to be connected to a resistance point.

The cable may be in the form of a steel rope cable commonly found in commercial gym exercise equipment, or may be of lower gauge. A band may be elasticated.

The resistance member may have a length that is greater than half of a length of a perimeter of the frame. The resistance member may have a length that is greater than 1×, 1.5×, or 2×, or 2.5×, or 3× the length of a perimeter of the frame. This may allow the resistance member to be seated in the channel for a full exercise movement of the user when the user is using the device.

The resistance member may be inextensible. The resistance member may be attached to an external resistance providing apparatus when in use to provide the resistance force.

The resistance member may be extensible. Extension of the resistance member may provide the resistance force.

The device may comprise an indicator to provide a user of the device with information relating to their use of the device. The indicator may comprise a spirit level which enables a user to maintain a given angle of the device relative to the horizontal. The indicator may comprise a rep counter which informs a user of the device of a number of completed repetitions of a particular exercise. The indicator may provide a user of the device with information relating to a force or tension applied to the resistance member. The indicator may comprise an electronic display, such as an LCD screen, or one or more lights, such as an LED, configured to provide a user of the device with information. The indicator may comprise a speaker to provide information to the user in the form of sound. The indicator may comprise an accelerometer, gyroscope or any other suitable sensor or means to determine the motion of the device. The device may comprise mounting and/or attachment means for mounting or attaching an electronic device, such as a mobile phone, tablet or the like, the device. The device may utilise sensors within the electronic device to determine motion of the device in use. This information may be provided to a user of the device by means of a screen and/or a speaker of the electronic device.

The mounting means may comprise a pocket, slot, housing, or holster for the device—such as a phone. The pocket/holster/receiving slot or housing may in use receive the device/phone and hold it securely and rigidly to the device so that it moves with the device and so that movement of the so-mounted phone/electronic device equates to movement of the exercising device.

In an example use case, the indicator may comprise an LED and a speaker. A user of the device may provide an input to a controller of the device which is indicative of a particular exercise the user wishes to perform. The LED may flash red if the user is performing the exercise incorrectly. The LED may flash green and the speaker may emit a reassuring sound, such as a 'swoosh', if the user performs the exercise correctly.

The device may comprise digital control units located in the frame and in the handles. The digital control units may provide a feedback mechanism for the motion of the device which would specifically give the user a report on the use of the device in operation. This reporting for example may include the amount of resistance being applied in operation of the device and the orientation of the device in respect to the angle of use and the path motion of use. The device may be configured to dynamically control the amount of resistance when used with a cable system which supports the appropriate digital technology to provide this capability. The device handles may be configured to control resistance by way of buttons e.g., a "Smart Handle" with Bluetooth functionality giving the user the ability to turn the resistance on/off or increase/decrease resistance.

Another aspect of the invention provides a kit of parts. The kit of parts comprises the exercise device of the preceding aspect, a resistance member and a set of instructions for providing a user with methods of using the device.

Another aspect of the invention provides a method of exercising core muscles of one's torso. The method comprises situating a frame about one's torso and supporting the frame with one's hands, applying a tangential force to the frame, and turning through an angular distance to enact a resistance force against the tangential force.

Another aspect of the invention provides a method of exercising core muscles of one's torso. The method comprises taking the exercise device of the first aspect, attaching one end of a resistance member to the exercise device, attaching another end of the resistance member to a resistance point, putting the device overhead and positioning it around one's torso, positioning oneself so that there is tension in the resistance member, twisting one's torso against the tension so as to exercise the core muscles of one's torso.

Attaching another end of the resistance member to a resistance point may comprise attaching the resistance member to an exercise machine comprising a weight and pulley system.

According to another aspect of the invention, there is provided an exercise device for exercising a user's core muscles, the exercise device comprising: a frame, wherein the frame defines a central aperture configured to receive a torso or trunk of a user; and an attachment point wherein the attachment point is configured to attach the frame to a resistance member in order to provide a resistance force against which the user can exercise when the device is in use.

The exercise device may be configured such that, in use, the resistance force is provided as a torque about a rotational axis of the frame in response to the twisting or turning his or her torso.

The torque may be a configurable torque. On other words a magnitude of the torque may be adjusted. The direction of the torque can also be reversed so as to exercise difference muscle groups and sides of the user's body.

The torque may be configurable by adjusting a moment of inertia about a central axis of the device, or by changing the resistance of the resistance member, or by changing a resistance provided by a resistance point to which the resistance member is attached (such as a conventional pulley weight type exercise machine).

The device may further comprise fasteners which are configured to attach a first frame section to a second frame section.

The fasteners may be adjustable fasteners which are configured to vary a diameter of an inner frame section, wherein the inner frame section defines the aperture. The fasteners are adjustable through having a length that is variable, such as through a turnbuckle, strap or ratchet system.

The moment of inertia of the exercise device about the central axis of the device may be adjustable.

The frame may comprise receiving means configured to support a resistance member. That is the receiving means can both receive and support the resistance member. The receiving means may be in the form of a channel. The receiving means reduces the likelihood of the resistance member from coming unseated from the exercise device when in use as the resistance member is kept support by the receiving means.

The resistance member may be attached to, or configured to be attached to, the attachment point at a first end of the resistance member and the resistance member may be configured to be attached to an external resistance point at a second end of the resistance member.

The exercise device may comprise multiple attachments points, wherein the multiple attachment points are configured to be attached to the first end of the resistance member. The multiple attachment points may also form the receiving means in that the attachment points also attach a top section of the frame to a bottom section of the frame and the resistance member can be supported against the attachment points when the resistance member is under tension when in use.

According to another aspect of the invention there may be a kit of parts, the kit of parts comprising an exercise device according to the first aspect, and a resistance member.

The device may be configured such that when a resistance member is attached to the frame, the resistance member provides a resistance force. The resistance force may increase and decrease in response to the user twisting the exercise device. The resistance force may be applied in a direction which is substantially tangential to the perimeter of the frame. The resistance force may be applied in a direction such that a component of the force acts in a direction which is tangential to the perimeter of the frame. The resistance force may provide a torque. The torque may be generated in a direction opposite to that in which the user rotates. The user resists (i.e. provides an opposing torque to) this torque as a means of exercise. The user twists against this torque as a means of exercise.

The frame may comprise multiple attachment points. The different attachment points may be used by a user to provide exercise at different intensity levels. The resistance member may be configured to be attached to the different attachment points in order to produce different torques for the user to exercise against. The resistance member may be configured to be attached to the different attachment points in order to allow the user to exercise different muscle groups.

The frame may be configured such that an axis of rotation of the frame aligns with a central axis of the user during exercise. The frame may be configured to ensure that the user maintains a correct posture whilst exercising. The term correct posture is used throughout this application to refer to a stance during exercise wherein a user minimises his or her chance of sustaining an injury.

The frame of the exercise device may have the shape of a circle. The frame of the exercise device may have the shape of any regular polygon, any ovoid or conical section, or any irregular polygon any other irregular shapes, such as a pear shape.

The frame may comprise an inner diameter and an outer diameter. The inner diameter may be defined by the size of the central aperture of the frame. The outer diameter may define the overall radial extent of the frame.

The inner diameter of the frame may range between 40 cm to 100 cm, or 50 cm to 90 cm, or between 60 cm to 80 cm. The inner diameter of the frame may be adjustable. The inner diameter of the frame may adjustable to enable a variety of different users to fit within the central aperture of the device.

The outer diameter of the frame may range between 70 cm to 120 cm, or between 80 cm to 110 cm, or between 85 cm to 105 cm. The outer diameter of the frame may be no greater than 10 cm wider than an average user's arm span.

The frame of the exercise device may comprise a single frame section. The frame of the exercise device may comprise a plurality of frame sections. The frame sections may be held together via adjustable fasteners. The frame sections may be held together via rigid fasteners. The frame section with the smallest diameter may be referred to as the innermost frame section. The frame section with the largest diameter may be referred to as the outermost frame section.

The frame may comprise a first frame section and a second frame section. A diameter of the first frame section may be smaller than a diameter of the second frame section. The first frame section may define the inner diameter of the frame. The second frame section may define the outer diameter of the frame. The first frame section may be the innermost frame section. The second frame section may be the outermost frame section.

The innermost frame section may be configured to fit proximally around the waist of a user. The term "proximally" in this context means there is a gap between the user's waist and the innermost frame section. The gap between the user and the innermost frame section may range between 0 cm and 30 cm, or between 0 cm and 20 cm, or may range between 0 cm and 10 cm.

The attachment point may be attached to or formed as part of the outermost frame section. The attachment point may be attached to or formed as part of the innermost frame section. Multiple frame sections may have an attachment point attached to or formed as part of them. There may be multiple attachment points on each frame section.

The attachment point may be configured to have the resistance member tied around it. The attachment point may be configured by comprising a projecting rod around which the resistance member can be tied without the subsequent knot slipping off, such as by terminating ends of the rod into the frame. The attachment point may be configured to support a hook which is attached to the resistance member. The attachment point may be configured such that the resistance member can clip on to the frame of the exercise device. The attachment point may be configured to limit the motion of the resistance member from sliding around the frame of the exercise device. The attachment point may be configured to reduce the chance of the resistance member becoming detached from the frame when compared with a device which does not have an attachment point. The attachment point may be configured to have the resistance member attached to it through the provision of corresponding features on the resistance member and the attachment point, such as the attachment point comprise a clip (such as a carabiner) and the resistance member comprise a closed loop, or vice-versa.

A user may selectively connect the resistance member to a particular frame section in order to select a desired resistance torque to exercise against.

The component of the resistance force which acts in a tangential direction to the perimeter of the frame creates a moment about the centre of rotation of the device. This moment is proportional to the distance between the centre of rotation and the position at which the force is being applied. As such, the attachment points to which the resistance member may be attached provide a greater moment, and hence a greater torque for a user to exercise against, when he or she is positioned further from the centre of rotation of the device. The device enables the resistance member to be attached at differing radii in order to provide differing torques to the user.

The resistance member may apply a rotational force to the frame consistently around the entire perimeter of the frame. The resistance member may apply a rotational force along a continuous section of the frame. The resistance member may apply a rotational force to the innermost frame section. The resistance member may apply a rotation force to the outermost frame section. The resistance member may apply a rotational force to a frame section which does not comprise the attachment point. The resistance member may be attach to the frame via an attachment point on the first frame section and apply a rotational force to the frame via the second frame section or vice versa.

The exercise device may comprise handles. The handles may be positioned on the frame. The exercise device may alternatively comprise detachable handles. The detachable handles may be configured to be attached to or detached from the frame. The term "handles" used throughout the application may now refer to either permanent, or detachable handles. The exercise device may comprise a plurality of handles at varying distances from the centre of the device. Having detachable handles may provide a more compact storage and transport solution as well as allowing a user to position handles according to his or her preference/according to an exercise requirement.

The handles may be positioned on the innermost frame section. The handles may be positioned on the outermost frame section. There may be handles on any of the frame sections. There may be handles positioned on multiple frame sections at the same time. There may be handles positioned at different distances from the centre of rotation of the device. The handles positioned on different frame sections may be configured to enable the user to exercise different muscles or muscle groups. The handles positioned on different frame sections may be configured to enable the user to vary the intensity of exercise he or she experiences. The handles may be positioned at various distances from the centre of the device so that users with different arm spans can reach the handles.

The handles positioned on the outermost frame reduce the force a user needs to apply to rotate the device. The handles positioned on the innermost frame sections increase the force a user needs to apply to rotate the device.

The force which the user may apply via the handles creates a moment about the centre of rotation. The moment is proportional to the distance between the centre of rotation of the device and the position at which the force which creates the moment is applied. As such, the user can apply a greater moment to the device whilst applying the same force by applying the force using handles which are positioned at a greater distance from the centre of rotation of the device.

The exercise device may comprise attachment points at various positions relative to the handles of the device. The attachment points at various positions relative to the handles may be configured to allow a user to exercise different muscles or muscle groups.

The or each handle of any of the above described embodiments may comprise two upright sections and a transverse section extending between the upright sections. The or each handle may be attached to the frame at a first end of each upright section. The or each handle may be substantially U-shaped. The angle between the transverse section and each of the upright sections may be substantially a right angle. Each upright section may extend substantially perpendicularly to the plane of the frame, or each upright section may extend at an angle of less than or greater than 90 degrees to the plane of the frame.

Providing a handle with multiple connection points with the frame, i.e. via the upright sections, may increase the stability of the handle. In addition, the fastening load at each of the connection points would not be required to be as great compared to a handle comprising a single connection point. Such a handle also provides multiple grip positions with a single handle, such as an overhand or underhand horizontal grip on the transverse section, or a vertical grip on the upright sections.

The exercise device may comprise straps attached to the frame. The straps may be configured to attach the device to the user. The straps may be configured to suspend the device from the body of the user. The straps may be configured to be worn over the shoulders of the user. The straps may be configured to support the exercise device. The straps may suspend the exercise device from the user's shoulders. The straps may enable the user to release the device without the device dropping to the floor. The straps may be adjustable straps. The straps may be non-adjustable straps. Adjustable straps may enable the user to adjust the position of the exercise device relative to the user's body. The straps may be configured to support the device relative to the user's body. The straps may be connected to, or configured to be connected to, the frame. The straps may be adjustable straps configured to vary the position of the device relative to the user's body.

The exercise device may be configured to provide a variable moment of inertia of the device. The exercise device may be configured to provide a variable moment of inertia about a central axis of the frame. The exercise device may be configured to provide a variable moment of inertia about a non-central axis of the frame. The user may vary the moment of inertia about a rotational axis of the device in order to vary difficulty of exercise experienced when using the device. The moment of inertia may be increased and decreased by respectively adding and subtracting weight from the device.

The frame of the exercise device may be constructed using hollow tubes. The innermost frame section may be constructed from hollow tubes. The outer most frame section may be constructed from hollow tubes. All of the frame sections may be constructed from hollow tubes. A combination of frame sections may be constructed from hollow tubes. The frame may be constructed using hollow tubes which can be filled with a liquid such as water in order to increase the moment of inertia about an axis of rotation of the device.

The frame of the exercise device may be configured to have weights attached to it in order to increase the moment of inertia about an axis of rotation of the device. The frame may be configured such that weights can be suspended from the innermost frame section. The frame may be configured such that weights can be suspended from the outermost frame section. The frame may be configured such that weights can be suspended from any, or a combination of, frame sections.

The exercise device may comprise a resistance member attached to the frame. The resistance member may be attached to the frame via the attachment point. A first end of the resistance member may be attached to the frame. A second end of the resistance member may be configured to be attached to an external resistance point (such as a wall, a floor, a door, or a pulley system of weights). The exercise device may comprise a plurality of resistance members attached to the frame. The resistance members may be attached to the frame via a single attachment point or by respective, separate attachment points. The resistance members may be configured to be attached to a single resistance point.

The resistance member may be a resistance cable, such as a rope, string, an elastic cable or in some other elongate form. The resistance member may also be a closed loop, such as in an elastic band. There may be a plurality of resistance cables for a user to choose from. The different resistance members may provide different levels of resistance. Different resistance members may have different spring constants. Some resistance members may be non-extendable, meaning he or she is resistant to extension under the tension provided by ordinary human force.

The user may choose from one of the plurality of resistance members in order for the device to provide a desired torque against which the user can exercise. The resistance member may be configured to wrap around the outer perimeter of the frame multiple times to increase the tension throughout the resistance member, which would increase the torque against which the user exercises. A plurality of resistance members may be attached the frame at the same time. A plurality of resistance members may be attached to a plurality of different attachments points at the same time. A plurality of resistance members may be attached to the same attachment point at the same time.

The frame may comprise a receiving means in the form of a channel configured to receive the resistance member attached to the frame. The receiving means may prevent the resistance member from losing contact with an outer perimeter of the frame. The receiving means may be configured to support the resistance member. The receiving means may be a receiving groove. The receiving means may be present along all or most of an outer perimeter of the frame. The receiving means may prevent the resistance member from slipping off the frame and hitting the user.

The resistance point, which may be attached to the second end of the resistance member, may be a stationary resistance point. The stationary resistance point may be a wall, a floor, or an object which is sufficiently heavy such that it will not be moved by a force from the resistance member. The resistance member may comprise a loop of clip in order to be retained by the resistance point or may be simply tied and/or knotted around the resistance point (such as when the resistance member comprises a rope or band).

The resistance point which may be attached to the second end of a resistance member may be a moveable resistance point. The moveable resistance point may be a pulley weight system. The resistance point may be attached to a system such that the resistance member is configured to apply a variable force to the device. The user may increase the weight on the pulley weight system in in order to experience a greater torque to exercise against. The resistance point may be an exercise device already known in the art.

The user may attach the second end of the resistance member to a pulley weight system, and in this situation, the user may use a non-stretchable resistance member. The device may be configured to be used in combination with pre-existing devices. The user may vary the weight system in order to increase or decrease the tension throughout the resistance member. The user may increase or decrease the tension throughout the resistance member in order to experience a different amount of torque to exercise against.

The user may stand closer or further away from the resistance point in order to increase or decrease the tension throughout the resistance member. The user may choose to wrap the resistance member around the outer perimeter of the device a multiple number of times in order to increase the tension throughout the resistance member.

The user may rotate in a first direction to exercise a first group of muscles, and may rotate in a second direction to exercise a second group of muscles. The user may use the device whilst in a standing position in order to exercise. The user may keep the device substantially perpendicular to his or her upper body whilst exercising. The user may rotate the device by rotating his or her upper body only. The user may rotate the device by rotating his or her arms relative to his or her body. The user may rotate his or her body forward at the hips or knees whilst using the device in order to strengthen the specific muscle groups associated with swinging a racket, club or bat. The user may use the device in various positions in order to exercise different muscle groups.

A pendulum, or swinging member, may be provided for use with or as part of the exercise device. The pendulum may be provided instead of or in addition to a resistance member. The pendulum may be configured to swing when the user rotates the device using their core. The forces exerted by the pendulum on the user may further condition or strengthen core muscles, and train the user. The pendulum may oscillate in use and a user's attempt to control the oscillation, when the device is in use, may provide guidance to the user for improving his or her form (wherein form may refer to exercising in a particular way and/or in a way that is in imitation of performing a particular sporting action—such as a golf swing).

The device may be configured to predominantly exercise the user's core muscles during exercise. The device may be configured to also exercise other muscles groups during exercise.

The device may be configured such that if the user accidently releases the device during exercise, it will not be repelled towards the resistance point to avoid someone being injured or something being damaged.

The use of the term "diameter" throughout the description and claims should be taken to mean the widest point when referring to a non-circular feature.

According to another aspect of the invention there may be a kit of parts, the kit of parts comprising an exercise device according to the first aspect and a stability training device. The stability training device may be of the type that a user stands on in use. The stability training device may be designed to be deliberately unstable when a user is standing on the stability training device, so as to train the core muscles of the user as the user attempts to maintain stability. The stability training device may comprise a board or a cylinder or curved surface for standing on, and the stability training device may be compressible, for example a compressible cellular or foam structure . . .

BRIEF DESCRIPTION OF THE DRAWINGS

Examples of the invention will now be described, with reference to the accompanying drawings, in which.

DETAILED DESCRIPTION

Figure 1:
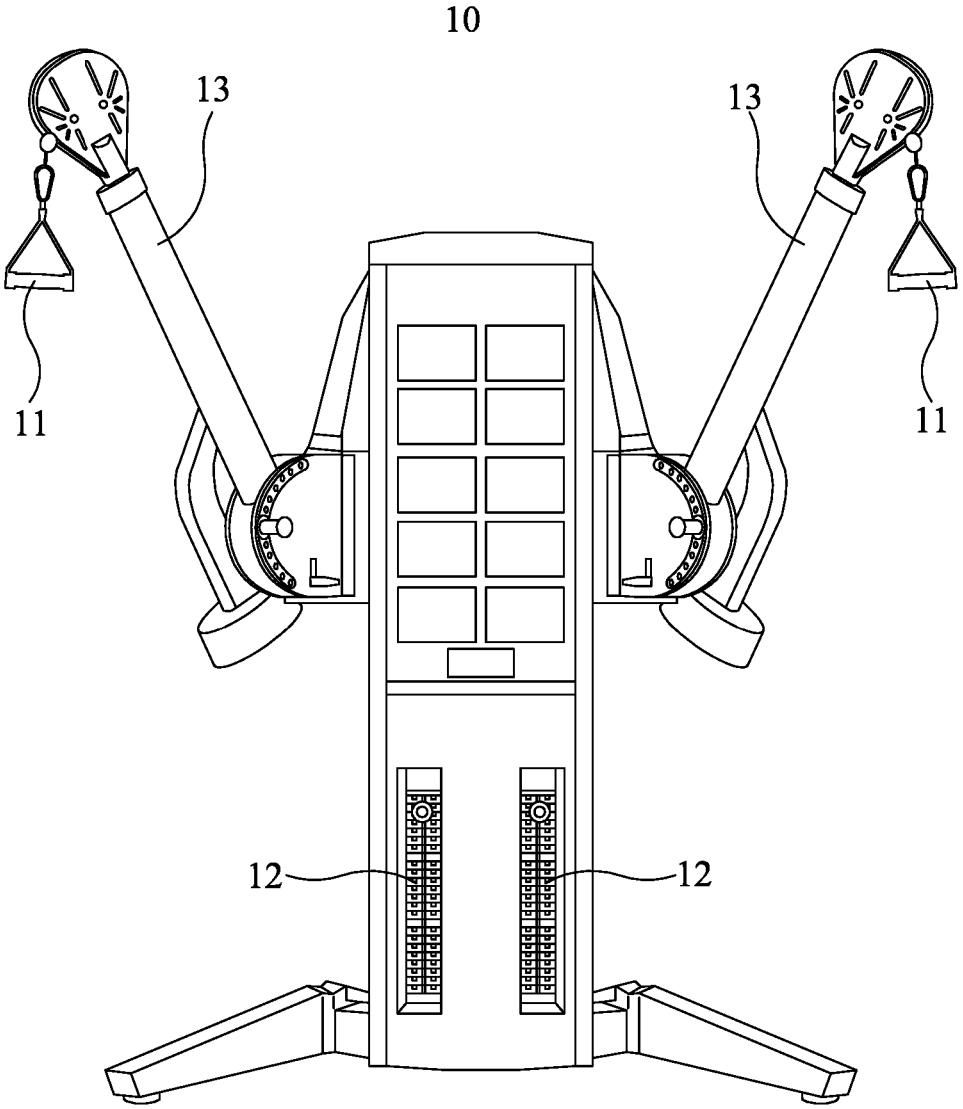
FIG. 1 (PRIOR ART)
FIG. 1 shows a photograph piece of exercise equipment known in the art.

FIG. 1 shows a first exercise machine 10 that is currently available and known in the prior art. The exercise machine is a weight and pulley based machine and comprises handles 11, cables (not visible in FIG. 1 as encased within the machine), and weights 12. The cables are attached to the handles 11 at a first end and he or she is attached to the weights 12 at a second end. Various exercises can be performed using the apparatus but fundamentally each exercise consists of pulling the handles 1 to exercise against the weight of the weights 12. In one exercise a user holds the handles 1 and pulls them across his or her body. As the handles 11 are pulled, the weights 12 are lifted via the cables. The weights 12 provide a resistance force through the cable 13 to the handles 11 which the user resists against as a means of exercise. The user can vary the amount of weight attached to the second of the cables 13 in order to vary the difficulty of the exercise. The user can also vary the position of the handles 11 relative to the user's body by adjusting pivotable arms 13 to which the handles 11 are attached.

Figure 2:
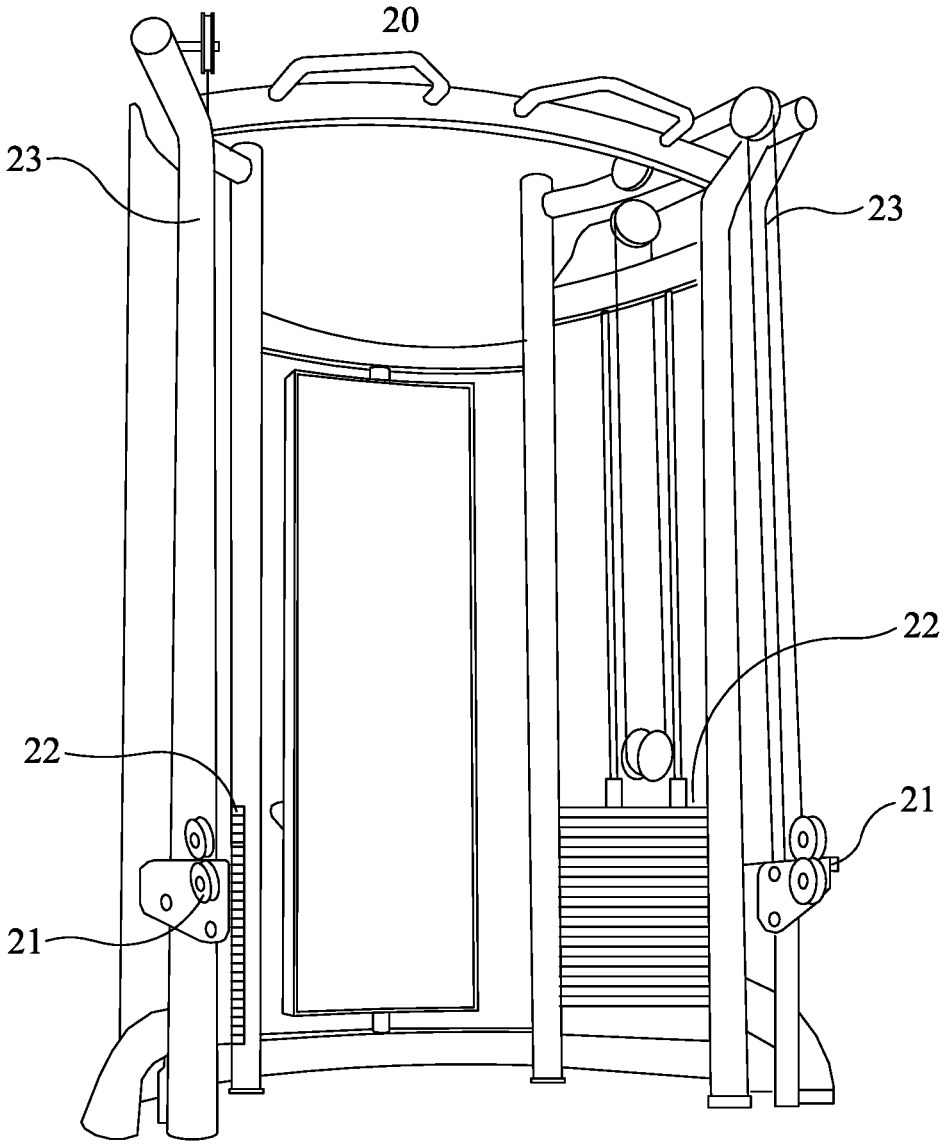
FIG. 2 (PRIOR ART)
FIG. 2 shows a photograph of another piece of exercise equipment known in the art.

FIG. 2 shows a second exercise machine 20 that is currently available and known in the prior art, which is also a weight and pulley based machine. The second exercise machine 20 operates in operable in a similar manner to the first exercise machine 10, and also weights 22 and cables 23. The cables 23 are attached to the weights 22 (which are configurable for different resistances) at one end and to an attachment point 21 at the other end. The attachment point 21 may receive a handle of various types in dependence on a selected exercise type. In this machine 20 the user can also vary the position of the attachment points 21 (and therefore the handles) relative to the user's body through vertically raising or lowering the attachment points in order to accommodate for a range of different exercises, and to accommodate for a range of users with different heights.

In each of the prior art exercise machines 10, 20 the user is provided with control over the positioning of his or her hands and arms relative to his or her body. Whilst this freedom can provide for a variety of exercises to be performed it can also lead to injury or ineffective exercises due to poor technique and body positioning.

Figure 3:
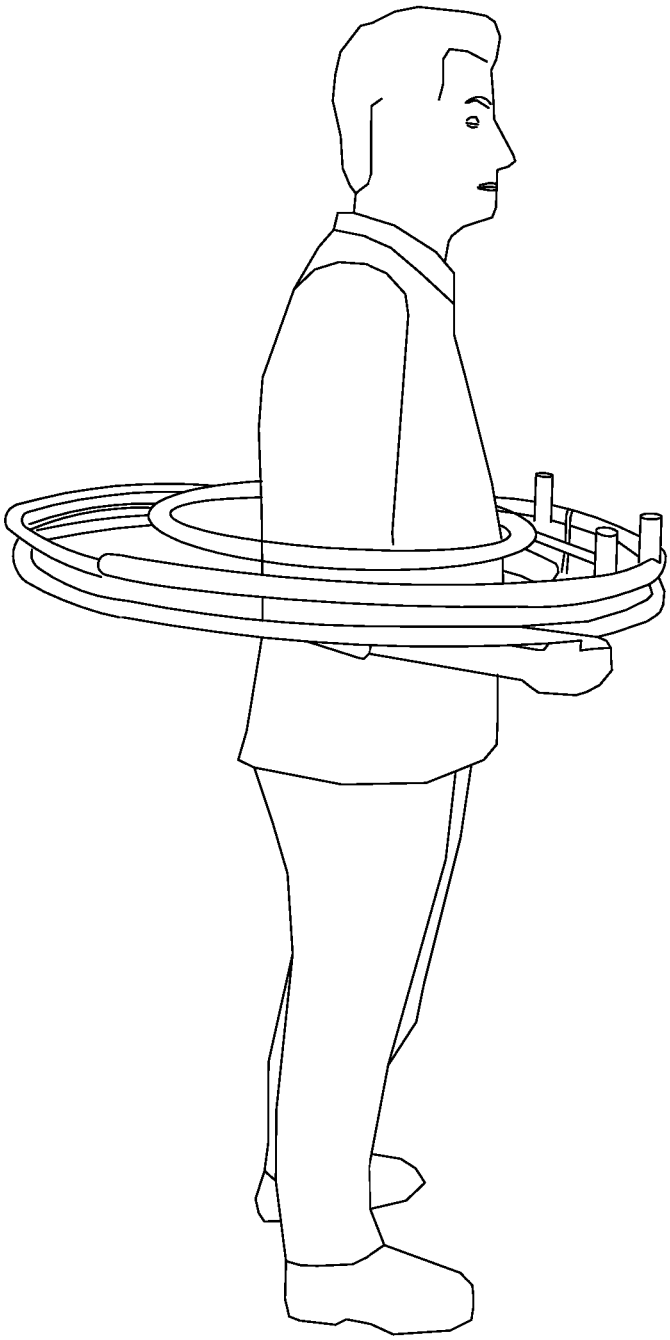
FIG. 3 shows a photograph of an exercise device in use.

An example of an exercise device 100 for improving core strength is shown being used in the photograph of FIG. 3. The device 100 can be used in combination with the exercise machines 10, 20 of the prior art or can be used as a standalone piece of exercise equipment.

Figure 4:
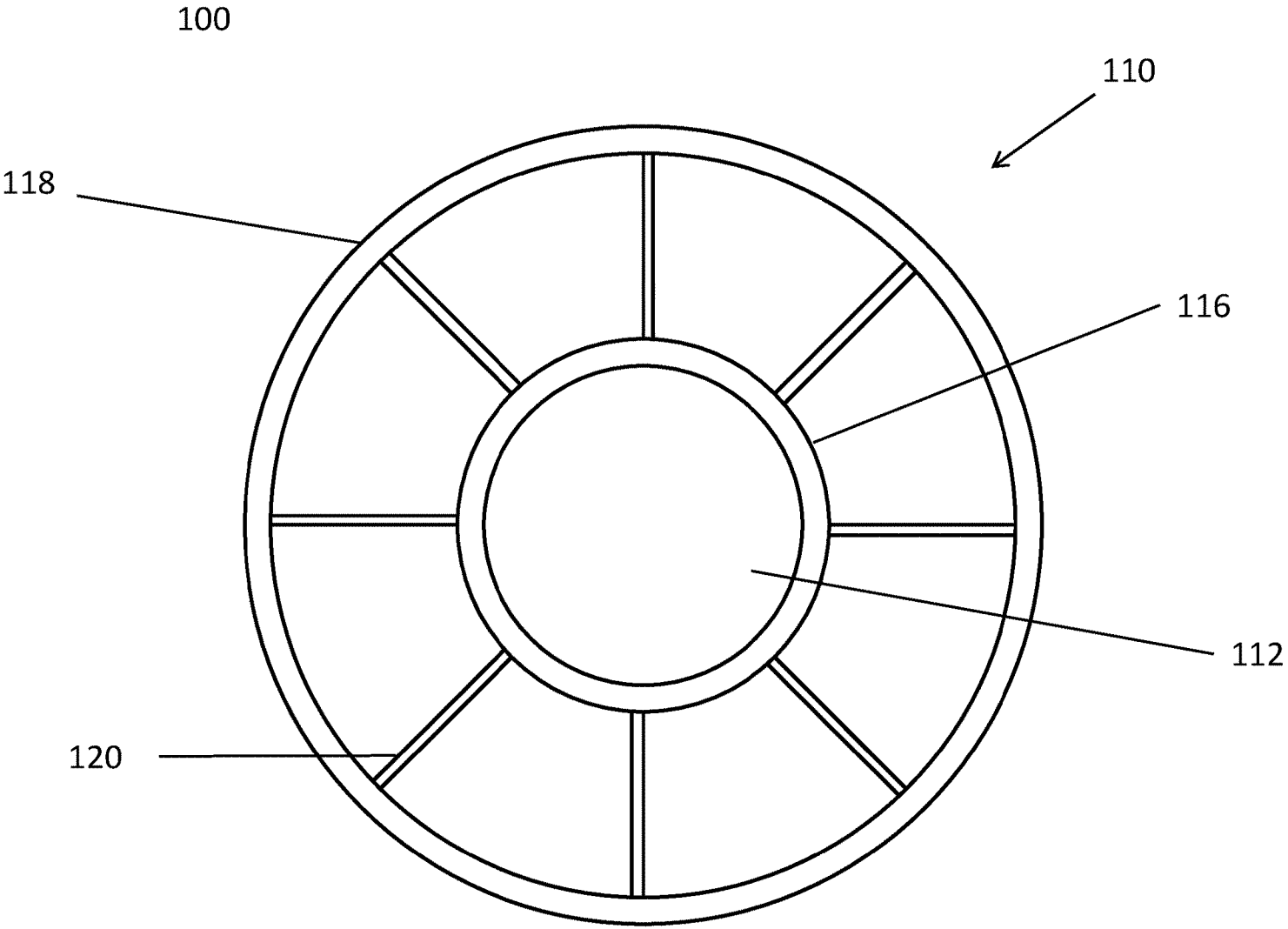
FIG. 4 shows a simplified plan view of the exercise device of FIG. 3.

A simplified, plan view of the exercise device is shown in FIG. 4. The exercise device 100 comprises a frame 110 which defines a central aperture 112. A user may stand within the central aperture 112 in order to use the exercise device 100 as shown in FIG. 3.

The frame 110 comprises a first frame section 116 and a second frame section 118. The second frame section 118 has a greater outer diameter than the first frame section 116. An inner diameter of the first frame section 116 defines an inner diameter of the frame 110. The outer diameter of the second frame section 118 defines an outer diameter of the frame 110. The first frame section 116 and the second frame section 118 share a common central axis. In this example, in which the first and second frame sections are circular, the first frame section 116 and the second frame section 118 are therefore concentric. In other examples, the frame may comprise only a single frame section or any multiple number of frame sections. In other examples, the frame sections 116, 118 may not share a common centre.

The frame 110 is substantially circular. The first frame section 116 and the second frame section 118 are also substantially circular. In other examples the frame 110 may have another shape, such as any regular polygon or any irregular polygon, a conic section or a pear shape. Different shaped frames 110 may be used in order for the user to exercise different muscles or muscle groups with the device.

The inner diameter of the first frame section 116 is configured to be greater than the girth of a user, such that the user can fit his or her torso within the central aperture 112 of the frame 110. The outer diameter of the second frame section 118 is not too large so that the user can reach the second frame section 118 when he or she is positioned within the central aperture 112.

The first frame section 116 and the second frame section 118 are attached together via a plurality of fasteners 120. FIG. 1 shows an example comprising eight fasteners 120, but any number of fasteners may be used instead. Preferably at least three fasteners are used. Using at least three fasteners substantially equally spaced, may provide stability of the first section relative to the second section. In the present example, the fasteners 120 are adjustable fasteners. The fasteners are adjustable through the use of a ratchet mechanism. Other adjustment systems may also be used, such as adjustable straps, turnbuckles, or any other suitable means.

In other examples, the frame sections 116, 118 may be connected via non-adjustable fasteners, or a combination of adjustable and non-adjustable fasteners. The first frame section 116 is adjustable in this example, and its diameter can be varied by adjusting the adjustable fasteners 120. The diameter of the first frame section 116 may be adjusted in order to fit proximally around the differently sized waists of different users.

The first frame 116 section may comprise an elastic ring. The elastic ring may be constructed such that it has a diameter which is large enough to fit proximally around the torso of the user when there are no forces being exerted on it. The elastic ring 116 may be configured such that its diameter increases when there are forces being exerted on it via the fasteners 120. The fasteners 120 may be adjustable fasteners, and may be adjusted in order to adjust the force exerted on, and the inner diameter of, the elastic ring 116. The elastic ring 116 may be configured such that its diameter can be increased and/or decreased to a size at which it can fit proximally around the torso of users with various girths.

The frame 110 and its components (116, 118, 120) can be made from any suitable material such as plastic, wood, or metal. The materials used are sufficiently strong so that he or she does not significantly bend or deform under his or her own weight or when in use. The materials are lightweight so that a user is able to lift the device 100 without great effort. The frame 110 may be constructed using hollow tubes in order to reduce its weight. In this example the frame 100 and its components are formed from a polymer. Each part is formed from polyethylene. More specifically the outer frame section 118 is formed from high-density polyethylene and the other components are formed from low-density polyethylene. Different materials may be used in dependence on design criteria and the envisaged end user. For example, a device designed for an adult to use may be stronger (and potentially heavier) than a device designed for use by a child. Lightweight materials are preferred, having sufficient structural rigidity for the frame sections (plastics and metal, e.g. aluminium, for example).

Figure 5:
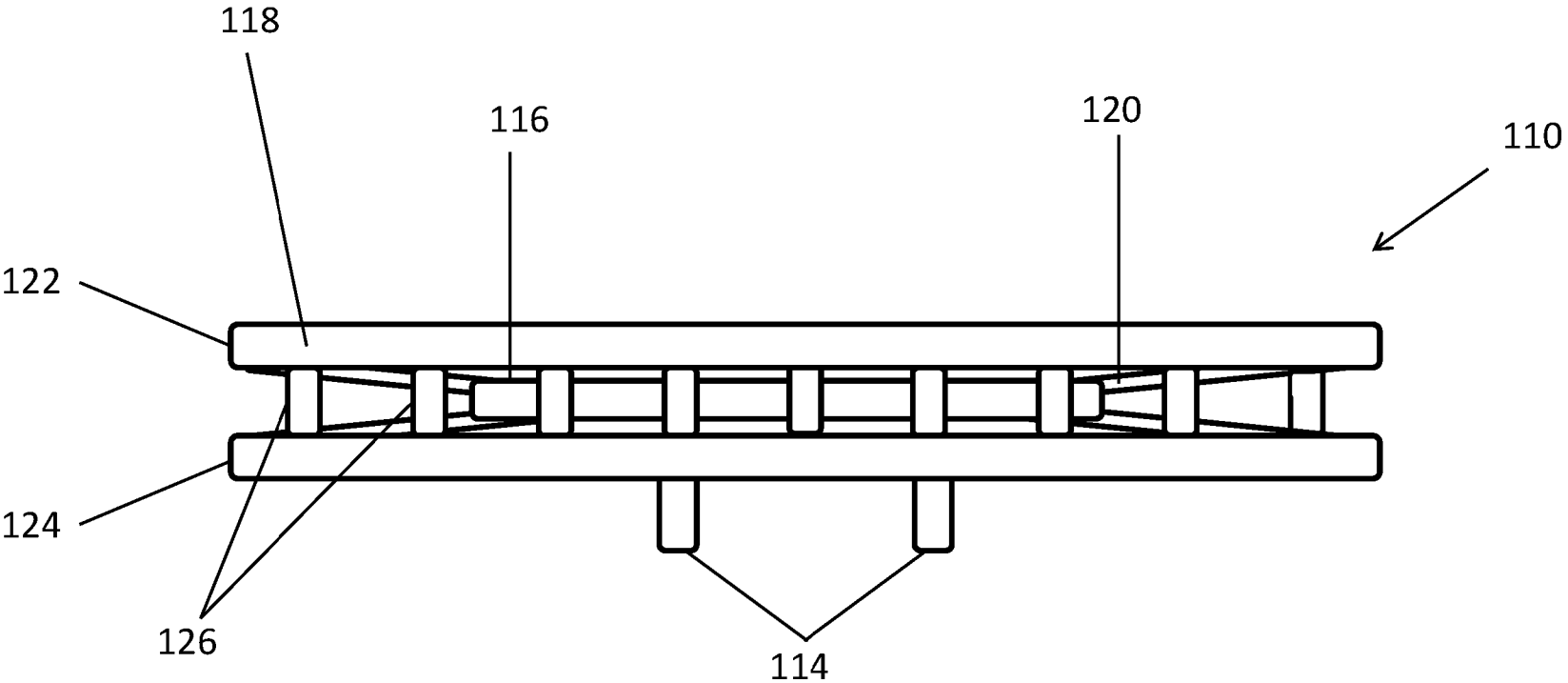
FIG. 5 shows a simplified front view of the exercise device of FIG. 3.

FIG. 5 shows a simplified front view of the exercise device of FIG. 4. The second frame section 118 of the exercise device comprises a top section 122 and a bottom section 124. The top section is connected to the bottom section via connecting rods 126. The connecting rods in this example form a channel 130. The exercise device comprises handles 114 attached to the frame 110. In this example a pair of handles is provided. The pair of handles provides one handle for each hand of the user. In other examples a single handle may be provided or more than two handles may be provided. A single handle may allow a single point of contact for the user, or for the user to place both hands in a central location. Multiple handles (e.g. 3, 4, 5, 6 or multiple pairs of handles) may provide a means for a user to vary his or her arm positioning, which may allow them to vary the exercise types and which muscle groups are exercised when using the device. The handles provide a means by which the user can support the exercise device 100 in position about the torso of said user. The handles 114 are connected to the second frame section 118, but in other examples, they may be connected to the first frame section 116 or any other frame section. Handles may be provided on both its first and second frame sections.

The handles 114 provide a grip for the user. The handles 114 may be profiled or coated with an appropriate material, such as rubber, in order to provide comfort for the user when grasping the handles 114. In the present example, the handles 114 are shown as protrusions extending from the second frame section 118. However, in other examples, the handles may be integrally formed as part of the frame 110. The handles 114 may be formed from indents in the frame sections (116, 118) which are configured to receive the user's fingers. The handles 114 may be constructed from, or coated with, a material which increases the grip a user can get on the handles 114.

Figure 6:
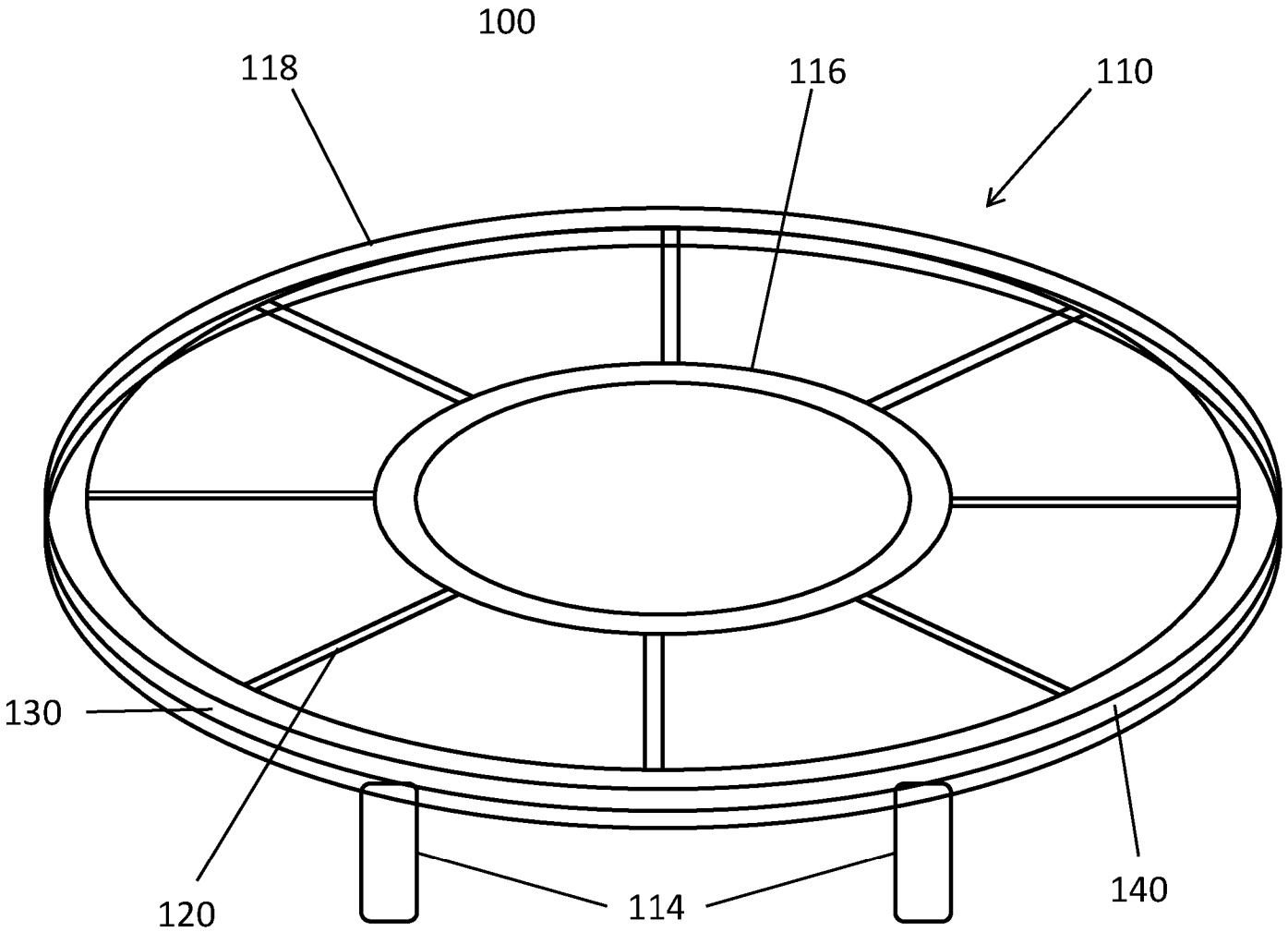
FIG. 6 shows a simplified perspective view of the exercise device of FIG. 3.

FIG. 6 shows a simplified, perspective view of the exercise device 100 of FIGS. 4 and 5 in which some features have been omitted for clarity.

Figure 7:
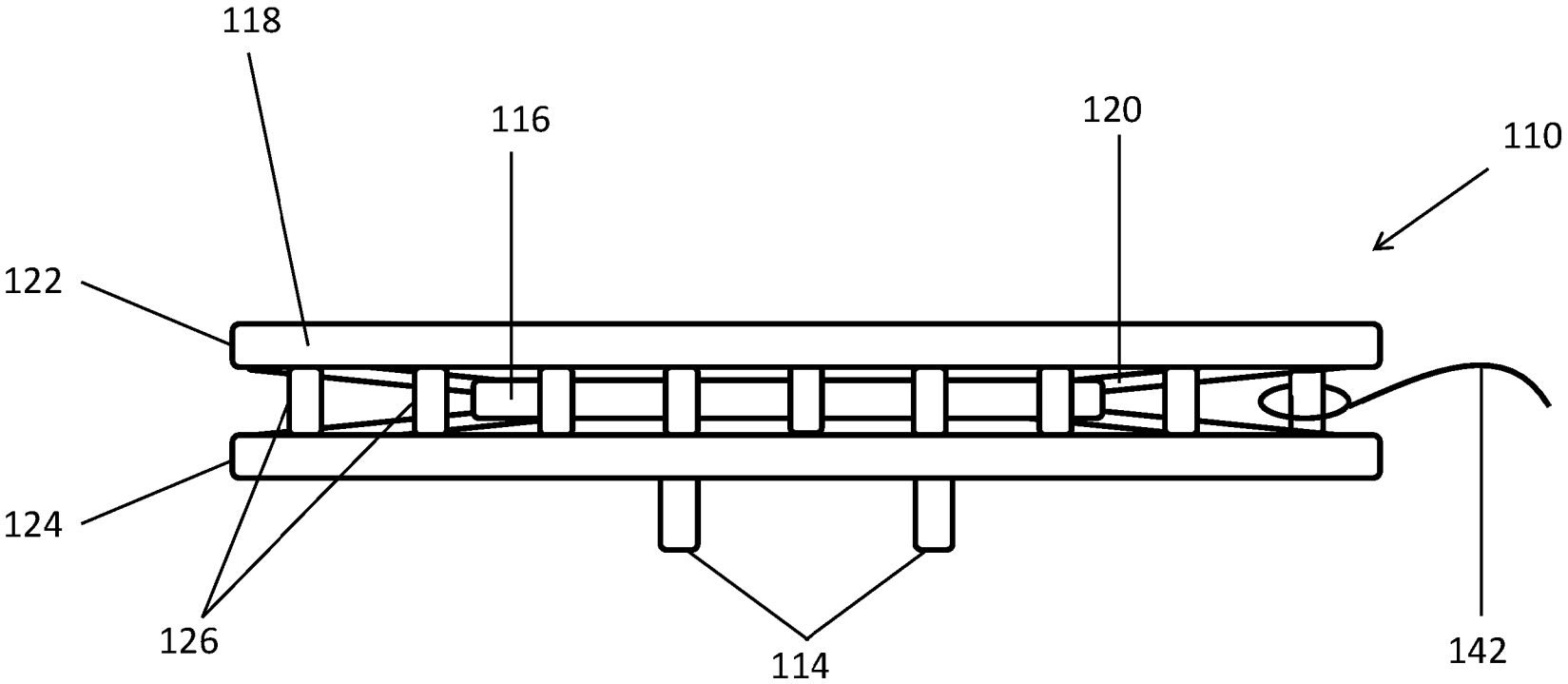
FIG. 7 shows a simplified front view of the exercise device of FIG. 3 being prepared for use.

FIG. 7 shows a simplified front view of the exercise device of FIGS. 4-6 being prepared for use. There is a resistance member 142 attached at a first end of the resistance member 142 to one of the connecting rods 126 of the device. In this example, the end of the resistance member 142 is tied around the connecting rod 126, the connecting rod forming a connection point of the device.

Figure 8:
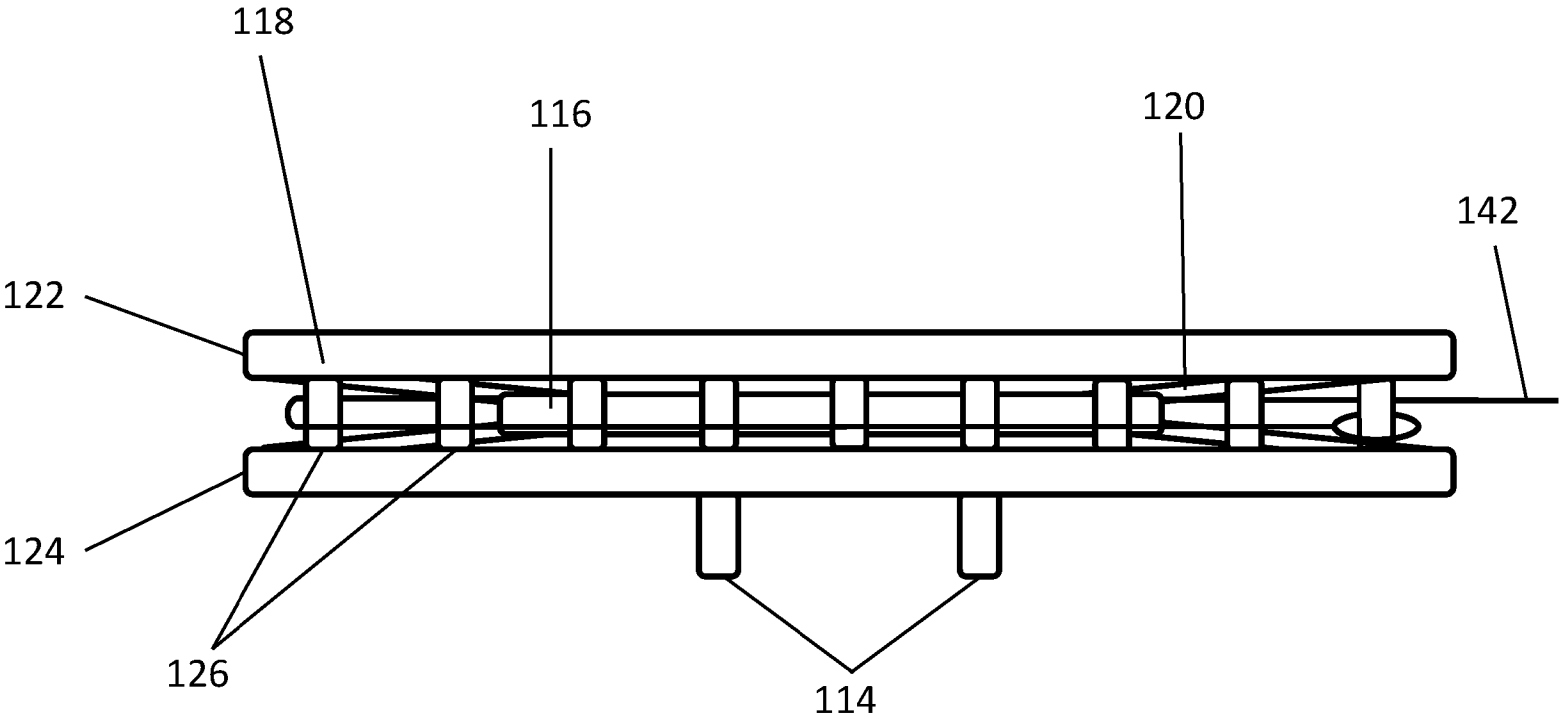
FIG. 8 shows a simplified front view of the exercise device of FIG. 3 in use.

FIG. 8 shows a simplified front view of the exercise device of FIGS. 4-6 in use. The resistance member 142 is wrapped around majority portion of the channel 130. The resistance member 142 abuts the connecting rods 126 in this example. The connecting rods 126 forming the channel which is configured such that the resistance member will not slip out of contact with the outer perimeter of the exercise device 100 when the resistance member is under tension. The channel is not always formed from connecting rods 126, as shown in the example in FIG. 9.

The resistance member may be supplied separately or with the frame 110 of the exercise device 100 and be attachable to the frame. The resistance member 142 may be formed integrally with the frame 110 in other examples. A first end of the resistance member 142 is attached to the frame 110 via an attachment point 140. In other examples, there may be multiple attachment points. In this example the attachment point 140 is positioned on the second frame section 118. In other examples, the attachment point(s) 140 may be positioned on the first frame section. Having multiple attachment points allows for the position of the resistance member relative to the user to be modified. This can allow for further configuration in order to account for different exercise regimes. The attachment point (or attachment points) may also be re-positionable on the frame as an alternate or supplementary means to provide further configuration options. The attachment point may be re-positionable using a clamping means, by which the attachment point clamps to the frame, or by any other suitable, releasable attachment means. Various attachment points are envisaged. The attachment point used is configured to be co-operable with the resistance member and/or vice-versa. For example, a hook-and-eye system may be used, in which the resistance member comprises a loop (i.e. the eye) at a first end and the attachment comprises a hook, peg, or similar, over which the loop may be secured. The attachment point may comprise a clamp, configured to be releasably clamped onto the first end of the resistance member, In this example, the resistance member 142 is a stretchable member, such as an elastic resistance band. The resistance force to the user twisting his or her torso is provided through stretching the resistance member. The strength required of the user to exercise with the member being proportional to the spring constant of the resistance member 142. In other examples, the resistance member 142 may be a relatively inelastic resistance cable (i.e. one that is not meant to be stretched during use), for example a steel or nylon cable such as steel wire rope often used in fixed gym equipment. In these examples resistance is generally not provided by the resistance member, but through a system (e.g. a weight or separate spring) to which the resistance member may be attached at its second end.

The second end of the resistance member 142 is configured to be attached to an external resistance point. The external resistance point may be stationary, fixed point such as a wall, a floor, a post, or a door handle (on a closed door) or may be a dynamic resistance point such as a pulley weight system. For an exercise device using a stretchable member a fixed resistance point is used. For an exercise using an in-elastic resistance member a dynamic resistance point is used.

The resistance member 142 may be wrapped or partly wrapped around the perimeter of the frame 110 when the device is in use or when in storage. The resistance member may be wrapped around the second frame section 118 once or any number of times. Wrapping the resistance member around the device can be used to increase the tension throughout the resistance member. Wrapping the resistance member around the device also provides a storage means, by which the resistance member can be kept with the frame 110 for improved storage and transportation (compared with keeping the resistance member 142 separate from the frame 110). Wrapping the resistance member around the perimeter of the frame may apply an inwardly directed force (i.e. towards the central axis of the device) which may also assist the resistance member with locating on the device and reducing the likelihood of the resistance member becoming unseated from the device during use.

The exercise device 100 comprises a receiver which is configured to receive the resistance member 142 when the resistance member is wrapped around the frame 110. The receiver is comprised within the frame 110 in this example. The second frame section 118 comprises connecting rods (not shown in FIG. 2) that form the receiver in which the resistance member 142 is held. The connecting rods connect an upper section of the frame to a lower section of the frame. When the resistance member 142 is wrapped around the frame 110, the resistance member 142 may apply a rotational force equally along the entire perimeter of the frame 110. In other examples the resistance member 142 may be partially wrapped around the perimeter of the frame 110, the resistance member 142 may apply a rotational force continuously along the section of the frame 110 which is in contact with the resistance member 142.

Figure 9:
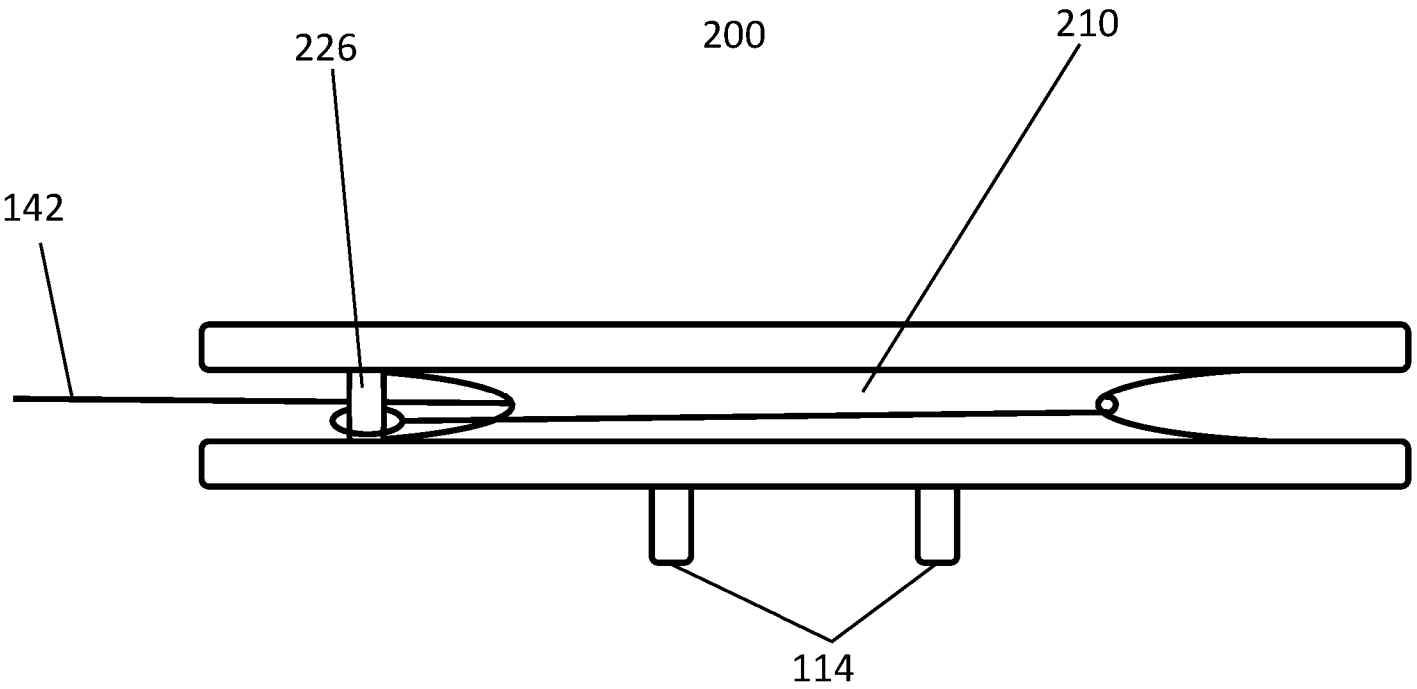
FIG. 9 shows a simplified front view of another exercise device in use.

FIG. 9 shows a simplified front view of another exercise device 200 in use. In this example, the frame 210 comprises a top section 222, a bottom section 224, and a joining section 210. The joining section 210 defines a central aperture (not shown). The joining section 210 has a curved outer perimeter which defines receiver. The device 200 comprises a connection point 226 which provides a means by which a user can attach a resistance member 142 to the device 200. The top section 222, bottom section 224 and joining section 210 can be formed from a single piece. That is the frame can be produced as a mould, such as via injection moulding or similar.

Figure 10:
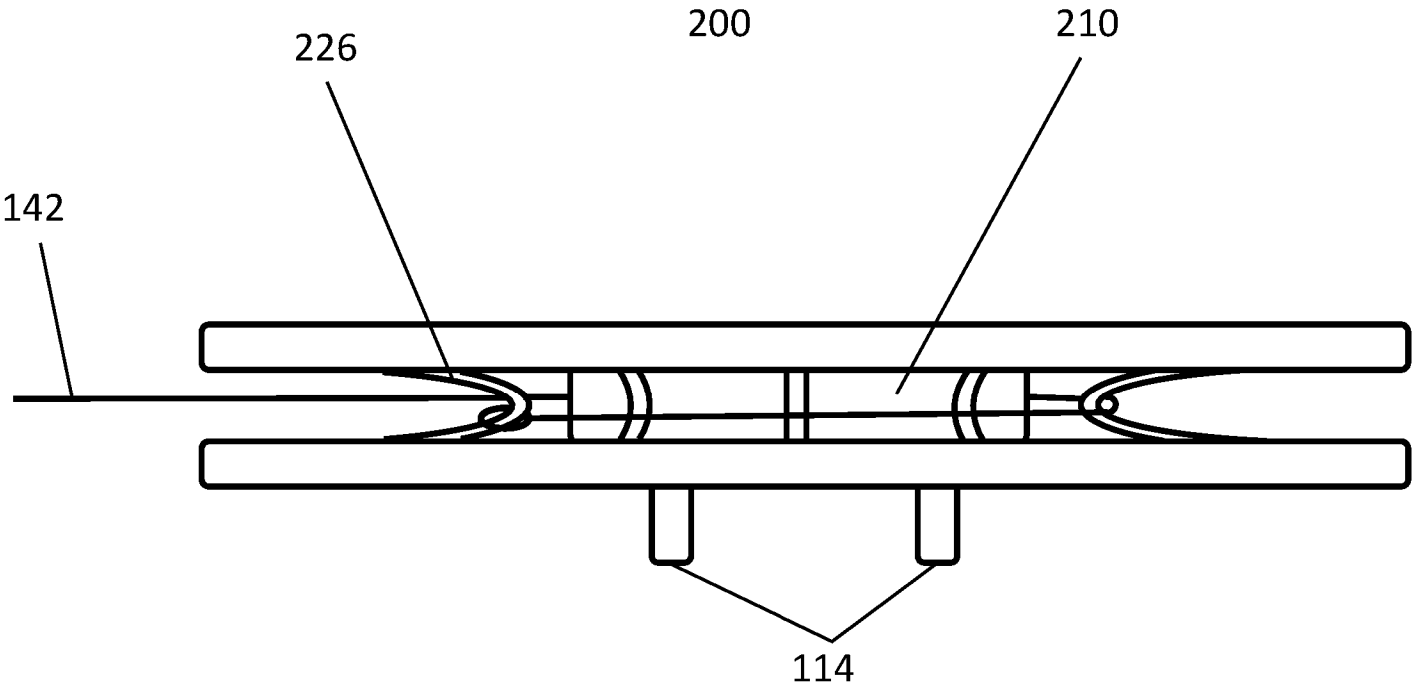
FIG. 10 shows a simplified front view of another exercise device in use.

FIG. 10 shows a simplified front view of another exercise device 200 in use. In this example, the frame 210 comprises a top section 222, a bottom section 224, and a joining section 210. The joining section defines a central aperture 212. The device also contains connecting rods 216 which extend between the top section 222 and bottom section 224 of the frame 210. The connecting rods 216 are curved in his or her centre towards the central aperture in order to define a deeper channel than the channel provided by the rods in the first example exercise device.

Figure 11:
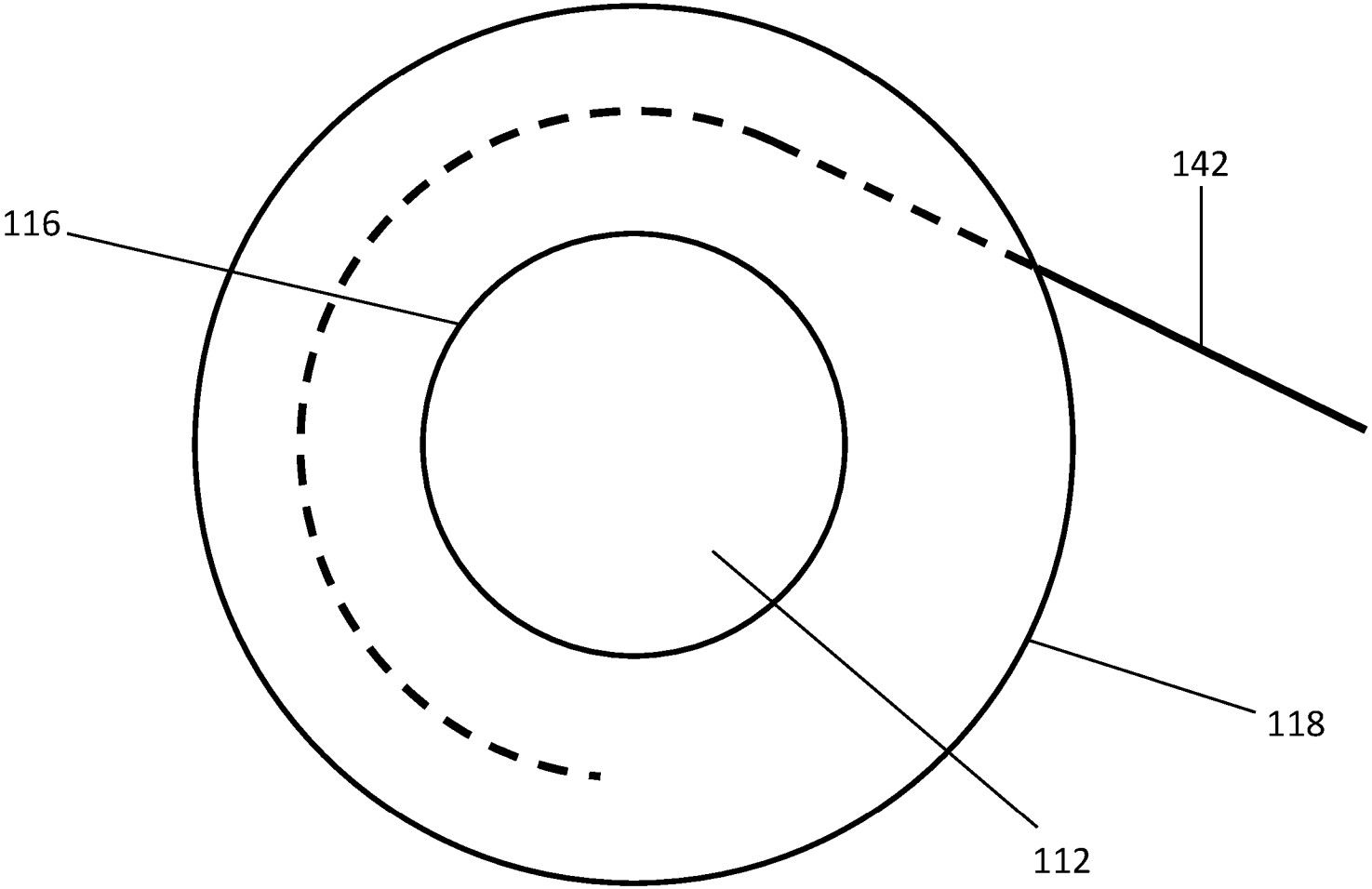
FIG. 11 shows a simplified plan view of the exercise device of FIG. 9 in use.

FIG. 11 shows a simplified plan view of the exercise device of FIG. 9. The resistance member is shown in dashed line form where it is hidden by the top section 222. The resistance member is contained within the channel and extends tangentially away from the device to a resistance point.

Figure 12:
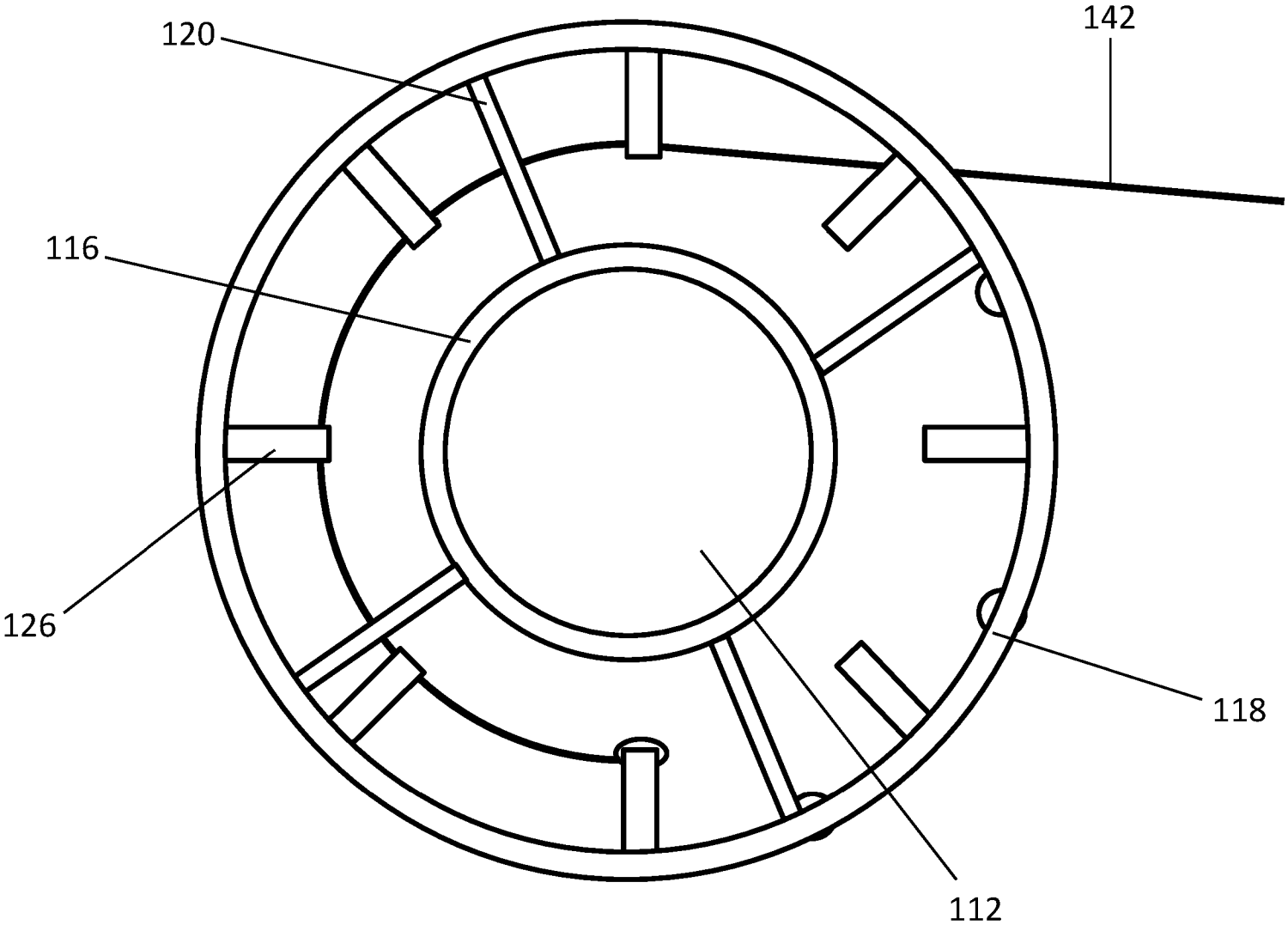
FIG. 12 shows a simplified plan view of the exercise device of FIG. 10 in use.

FIG. 12 shows a simplified plan view equivalent of FIG. 10. In this example, the resistance member 142 is connected to a connecting rod 126 at a first end and is connected to an external resistance point (not shown) at a second end. The resistance member 142 is held taught so that the resistance member 142 rests against the channel which is defined by the connecting rods 126.

Figure 13:
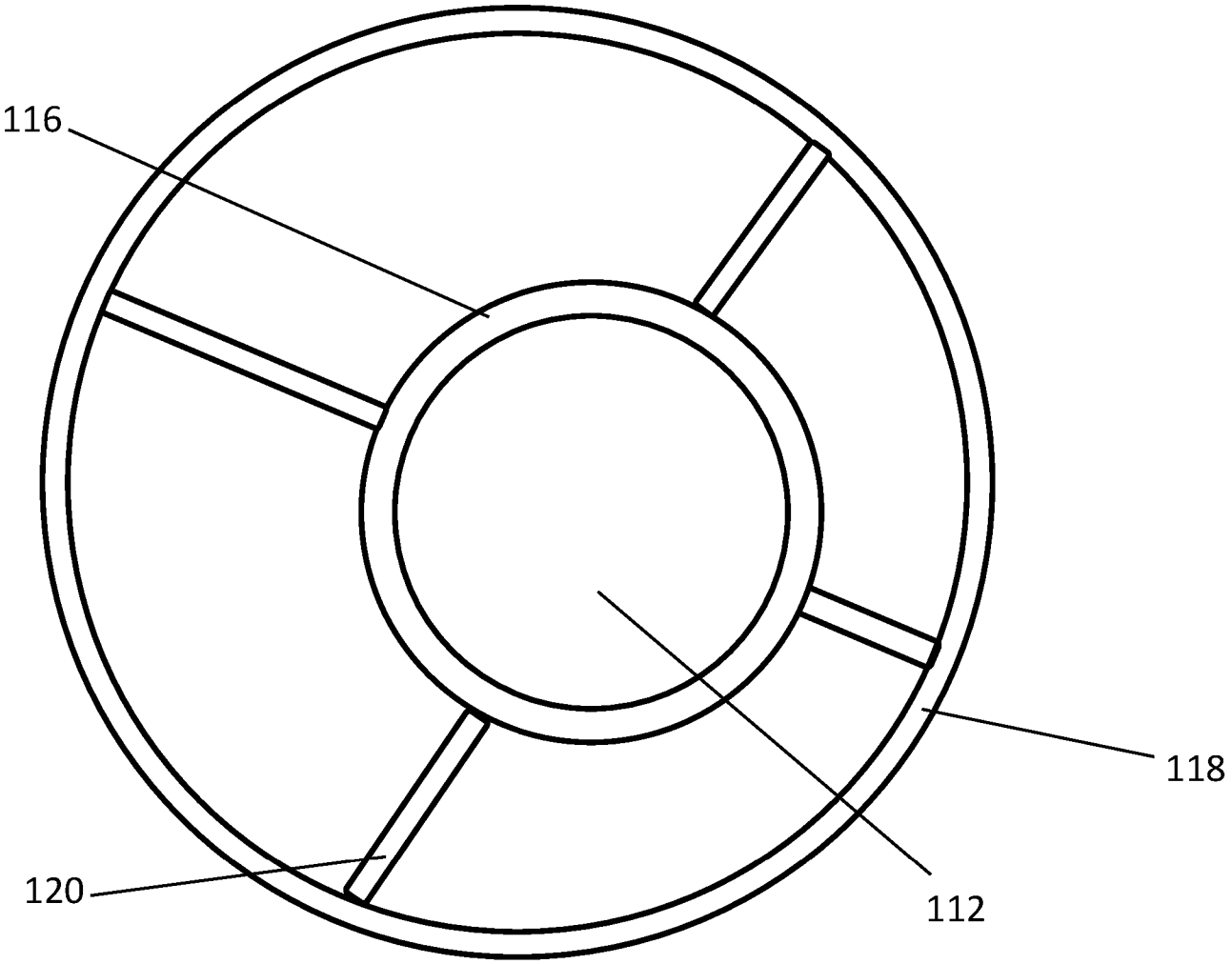
FIG. 13 shows a simplified plan view of another exercise device.
Figure 14:
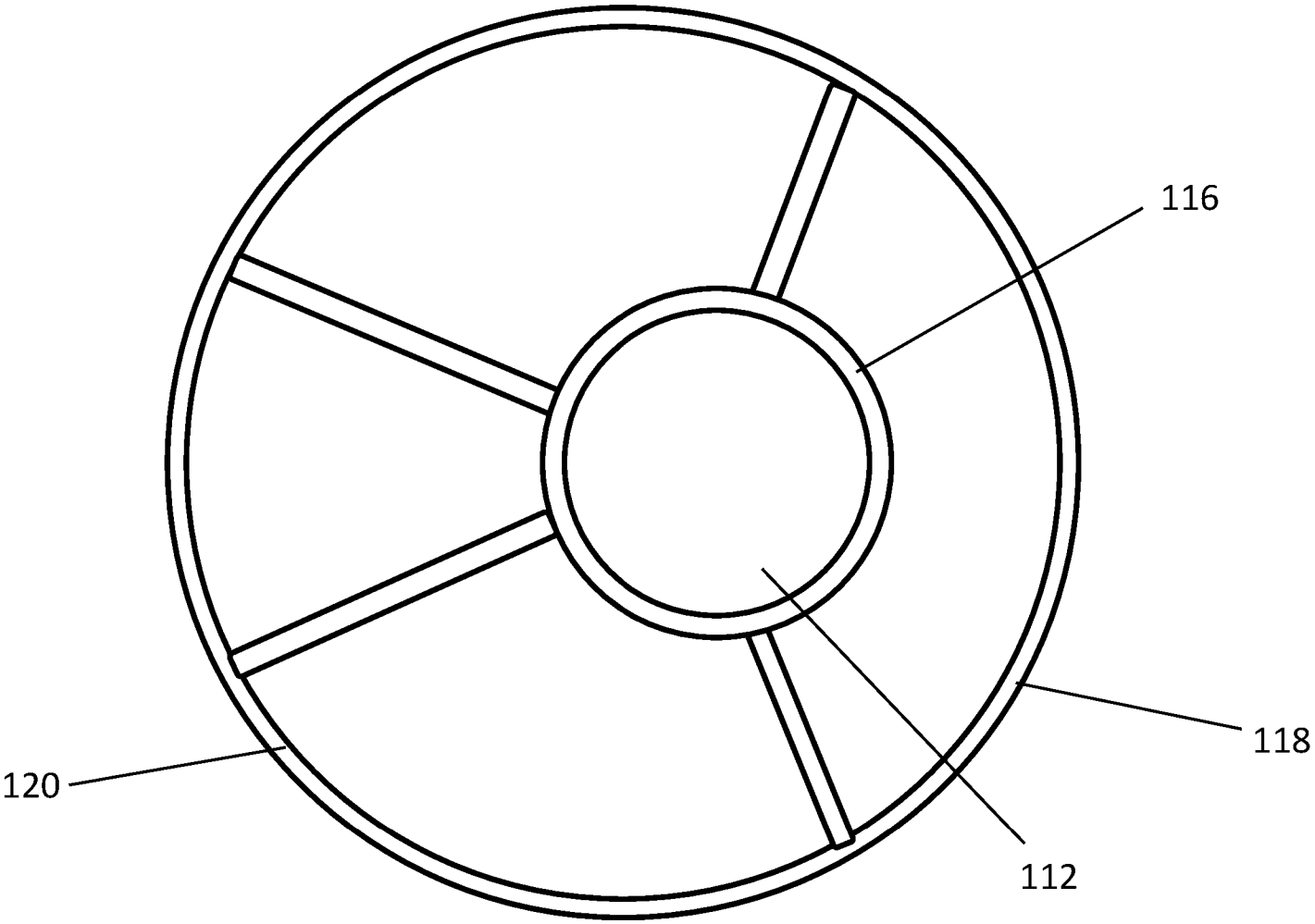
FIG. 14 shows a simplified plan view of another exercise device.

FIGS. 13 and 14 show simplified plan views of other exercise devices 100. In these examples, the central aperture 112 is not concentric with the centre of the exercise device 100. In these examples, the lengths of the adjustable straps 120 have been increased or decreased in order to move the first frame section 116 relative to the second frame section 118.

Figure 15:
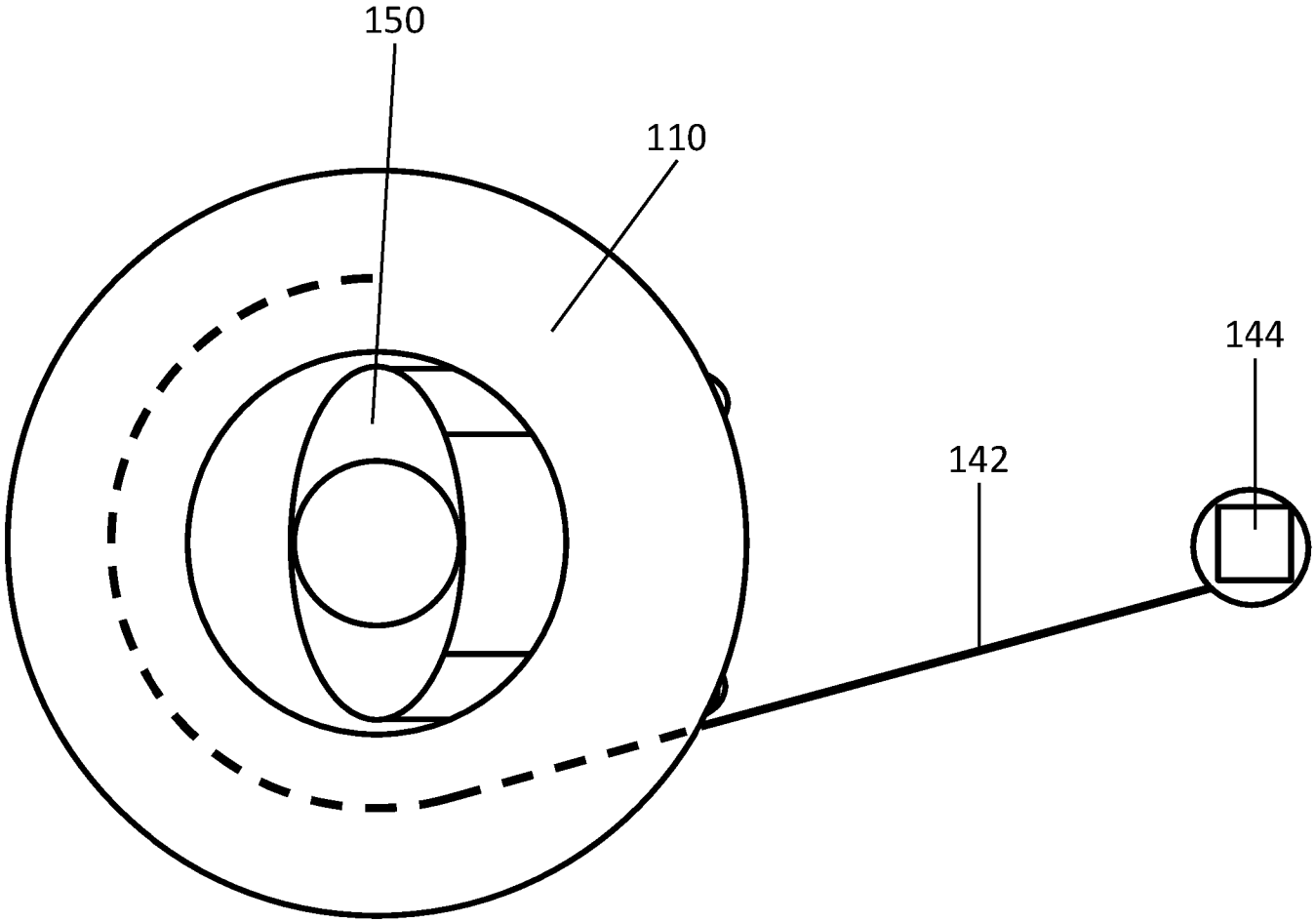
FIG. 15 shows a simplified plan view of an exercise device in use by a user.
Figure 17:
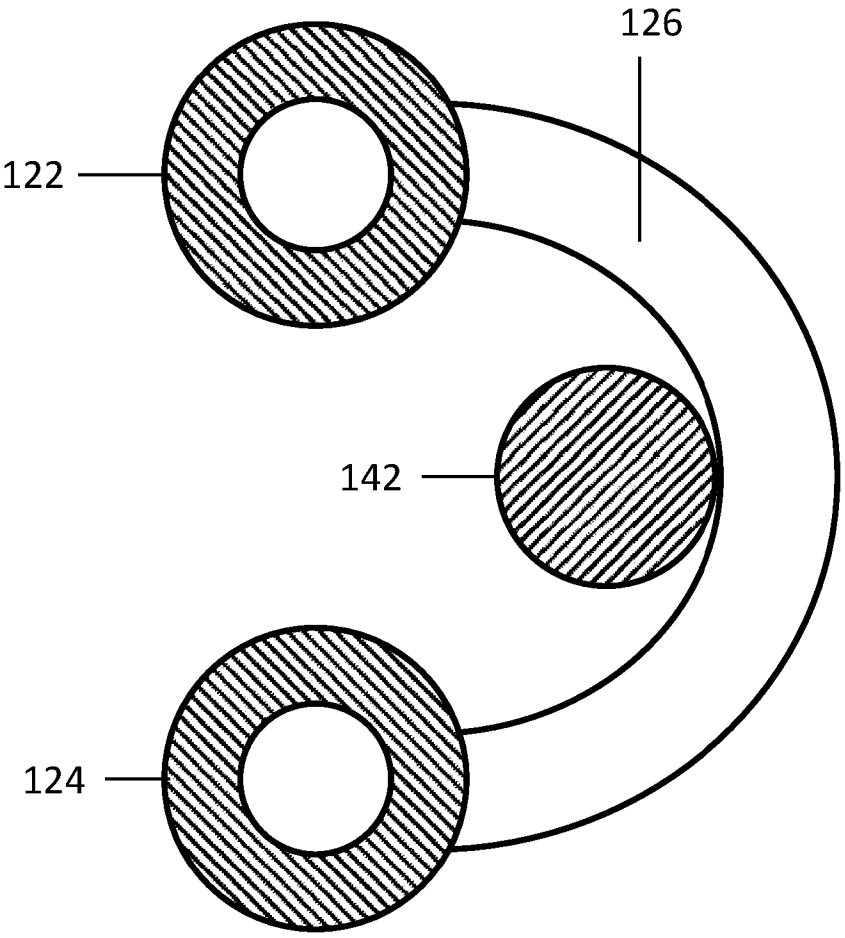
FIG. 17 shows a cross section of a part of another exercise device.
Figure 16:
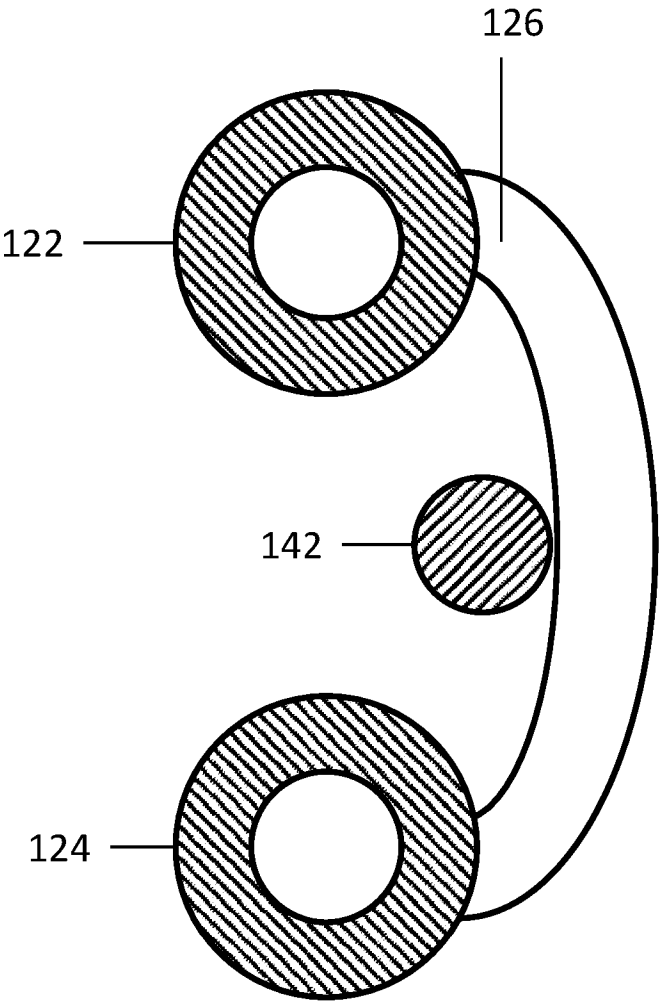
FIG. 16 shows a cross section of a part of an exercise device.
Figure 19:
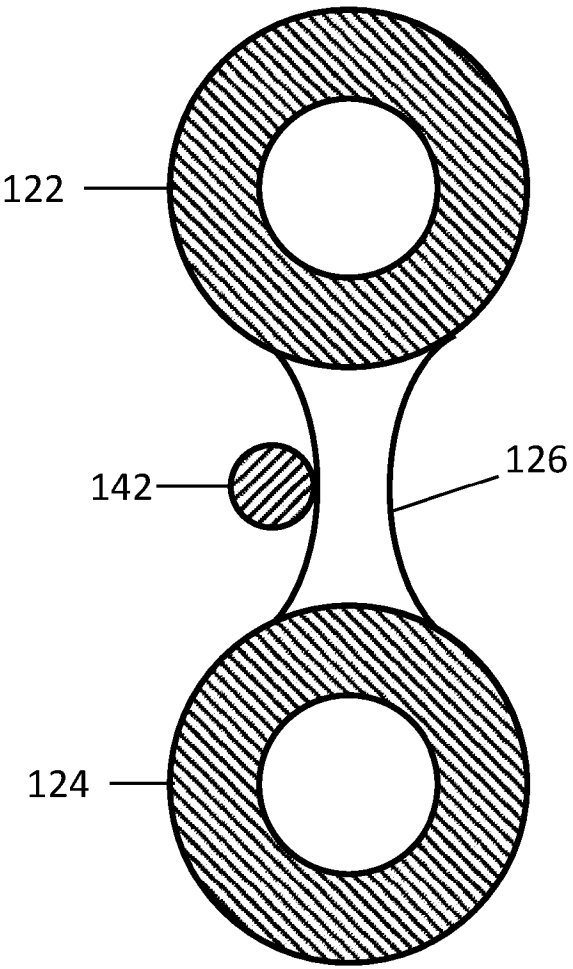
FIG. 19 shows a cross section of a part of another exercise device.
Figure 18:
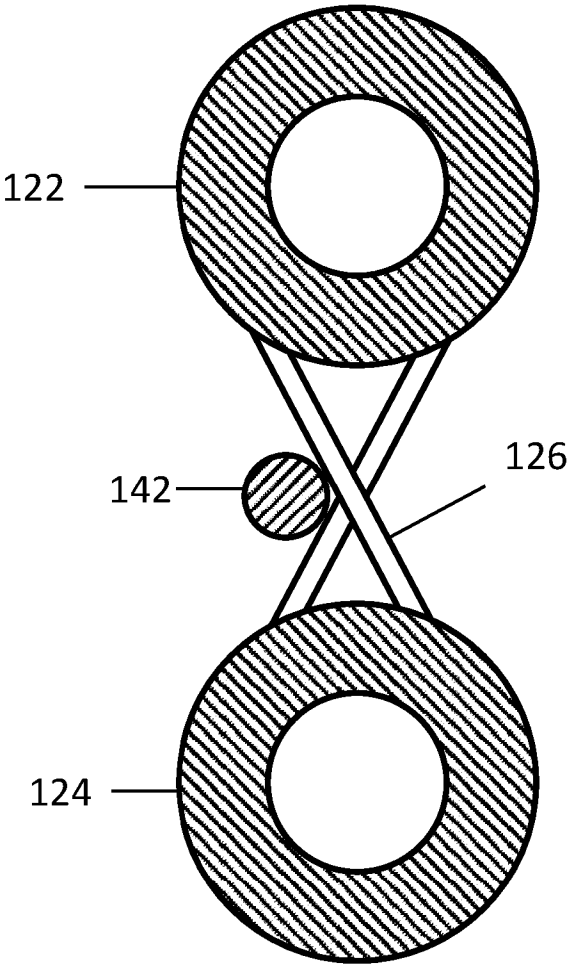
FIG. 18 shows a cross section of a part of another exercise device.
Figure 21:
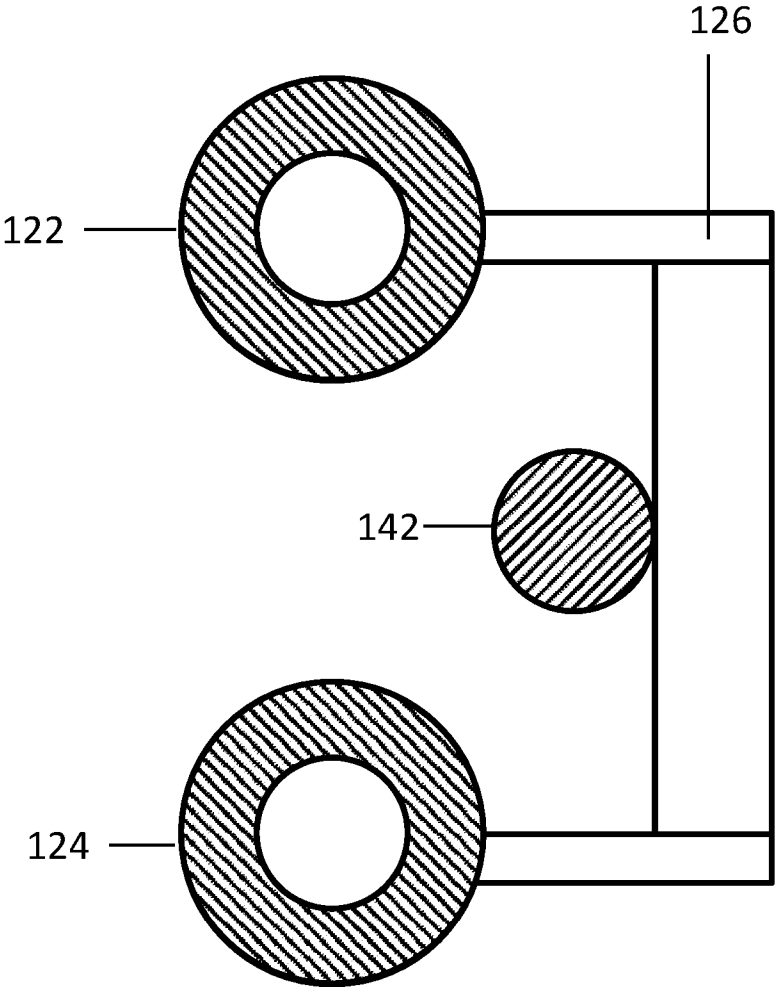
FIG. 21 shows a cross section of a part of another exercise device.
Figure 20:
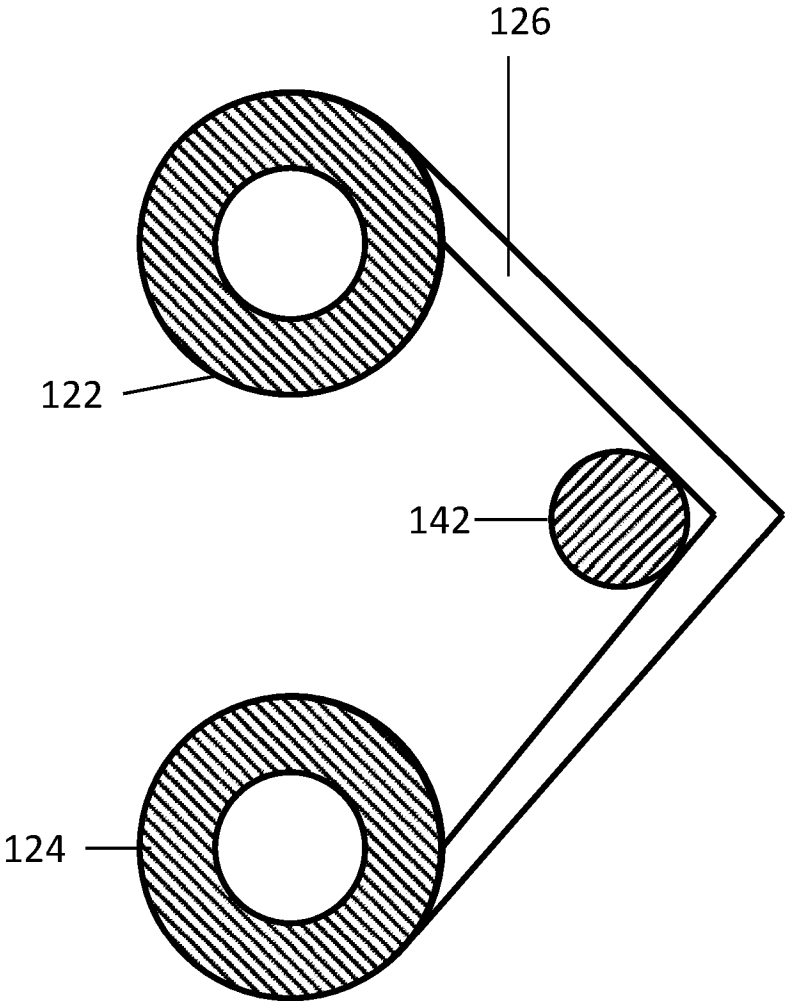
FIG. 20 shows a cross section of a part of another exercise device.

FIG. 15 shows a simplified plan view of an exercise device 100 being used by a user 150. The user 150 is supporting the device 100 by resting the frame 110 against his or her forearms. The user 150 is holding the handles in order to exert an opposing torque on the device 100. In this example, the second end of the resistance member 142 is connected to an external resistance point 144 which is a stationary post.

FIGS. 16-21 shows the examples of forms of connecting rods 126 in greater detail than in earlier figures. The figures provide a cross-sectional view of the connecting rods 126. The connecting rods 126 are connected between the top section 122 and the bottom section 124 of the second frame section 118. The connecting rods 126 are configured to allow a resistance 142 member to rest against them.

The top section 122 and the bottom section 124 of the second frame section 118 are connected via the connecting rods 126. The connecting rods 126 can be curved, such that the centre of the connecting rods 126 (the centre being the point midway between the top section 122 and the bottom section 124) is closer to the centre of the exercise device 100.

The connecting rods may be constructed from any suitable material which will not break under the inwardly (i.e. towards the central axis of the frame) directed force exerted by the resistance member 142. In the example shown, the top section 122 and bottom section 124 of the second frame section are hollow In other examples the top section 122 may be hollow and the bottom section 124 may not be hollow, or vice versa. In other examples, the top and bottom sections 122, 124 may both be solid throughout.

The curvature of the connecting rods 126 creates a channel which provides a receiving means in which the resistance member 142 is received. In this example, the channel 130 is formed by the groove. In other examples, the receiving means 130 may be a receiving tube or other receiver. The channel 130 prevents the weight of the resistance member 142 from causing the resistance member 142 to fall away from the second frame section 118.

The connecting rods 126 may also be used as an attachment point to attach the resistance member 142 to the device 100. In such examples, the first end of the resistance member 142 can be tied around one of the connecting rods 126 in order to connect the resistance member 142 to the exercise device 100.

In other examples the channel 130 may be constructed from a single section. The single section may be of semicircular cross section wherein the centre of the cross section curves towards the centre of the frame 110. The semicircular cross section may be configured to support the resistance member 142. In other examples, the single section may be of circular cross section (i.e. a tube) configured to contain a portion of the resistance member 142.

The first frame section 116 (shown in FIGS. 1 and 2) may be constructed similarly to the second frame section 118 shown in FIG. 3.

Figure 22:
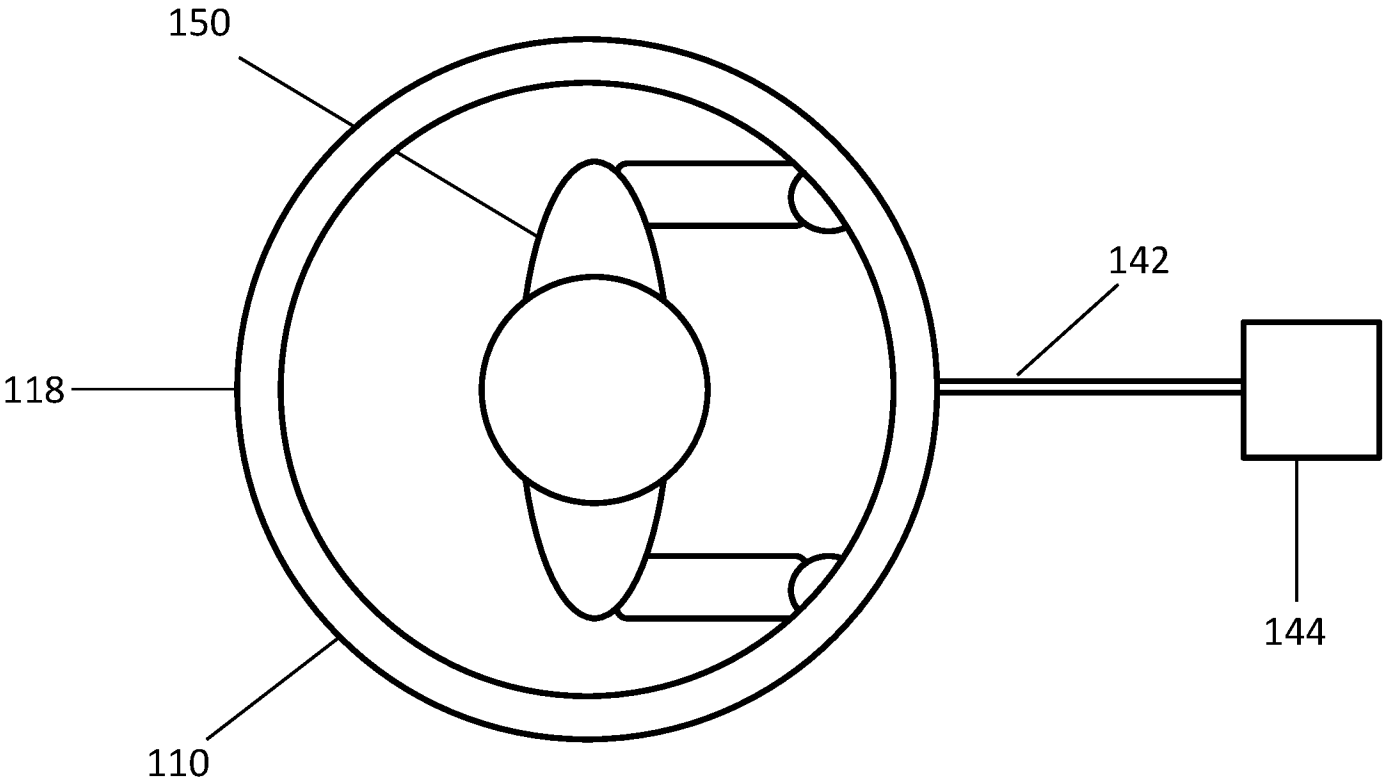
FIG. 22 shows a simplified plan view of an exercise device being prepared for use by a user.

FIG. 22 shows an example of a user 150 in a position ready to use the exercise device 100. The user 150 is positioned within the central aperture 112 of the frame 110. The frame 110 of the exercise device 100 is being held by the user 150 via the handles 114 which are attached to the first frame section. The first frame section is not shown in FIG. 22 for clarity. The resistance member 142 is provided between the exercise device 100 and a resistance point 144. The frame 110 is being held by the user 150 at a level height with the torso of the user 150.

FIGS. 22-26 shows a user 150 using the device 100 to exercise. The resistance member 142 used in this example is an elastic cable. A first end of the resistance member 142 is attached to the second frame section 118 via an attachment point 140. A second end of the resistance member 142 is attached to a resistance point 144 which is external from the exercise device 100. In the example shown, the resistance point 144 is a stationary post, which is an example of a fixed resistance point.

The user 150 in FIG. 22 is facing directly towards the resistance point 144. The user 150 is stood at a distance from the resistance point 144 such that the resistance member 142 is extended beyond its natural length and so there is tension throughout the resistance member 142 which provides an elastic resistance force, but not enough tension to exert a force that can forcibly move the user 150. The user 150 may stand closer or further away from resistance point 144 in order to increase or decrease the tension throughout the resistance member 142.

The user may use different resistance members 142 to increase or decrease the tension throughout the resistance member 142. The user may use a resistance member 142 with a shorter natural length in order to increase the tension throughout the resistance member 142 without having the stand in a different position. In contrast, the user 150 may use a resistance member 142 with a greater natural length in order to decrease the tension throughout the resistance member 142 without having to stand in a different position.

Further, the user 150 may use a resistance member 142 with a greater spring constant in order to increase the tension throughout the resistance member 142. In contrast the user 150 may use a resistance member 142 with a smaller spring constant in order to decrease the tension throughout the resistance member 142. The user may choose to increase or decrease the tension throughout the resistance member 142 in this way in order to vary the intensity of exercise he or she experiences.

Figure 23:
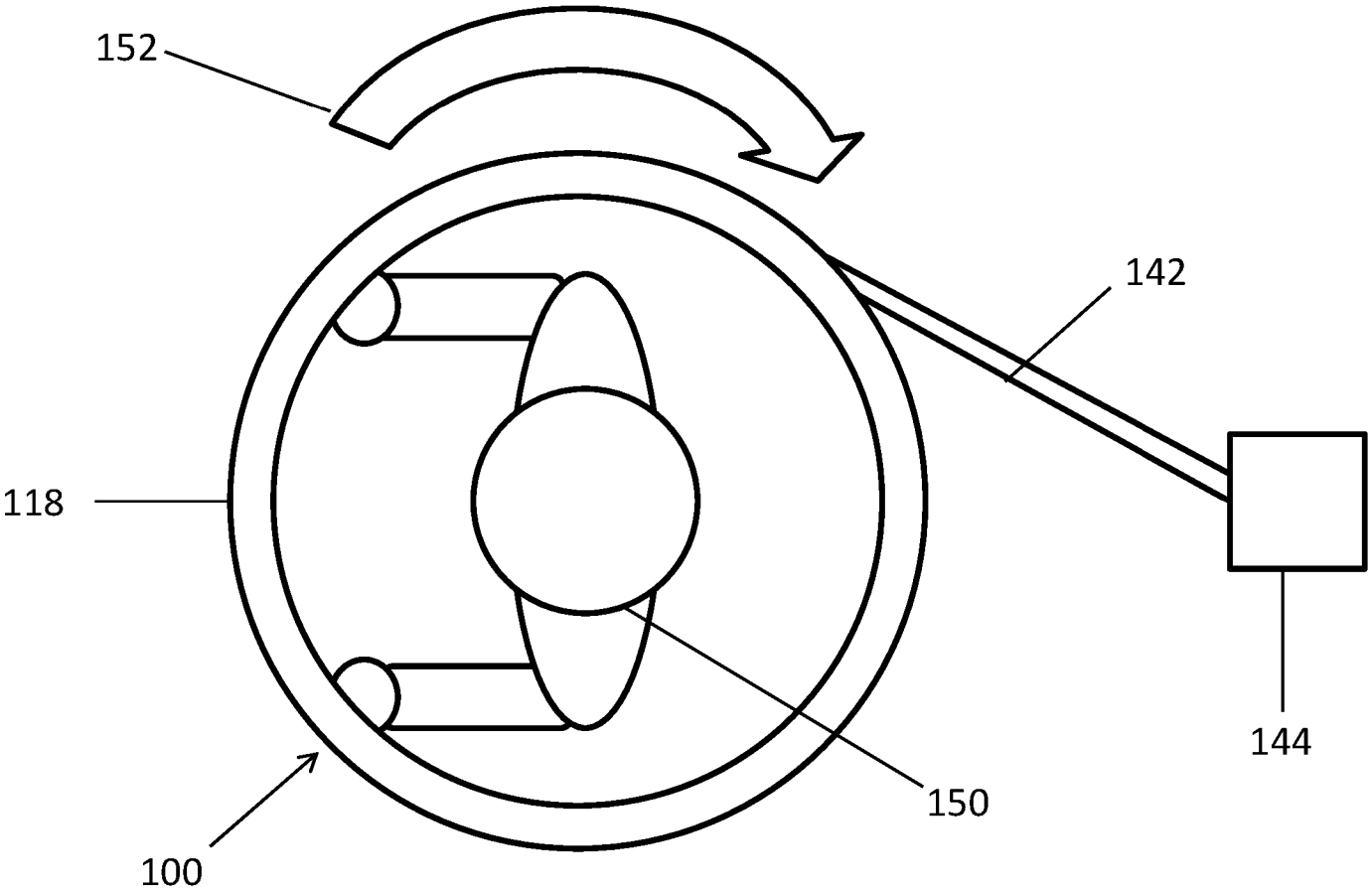
FIG. 23 shows a simplified plan view of a user using the exercise in a first position.
Figure 24:
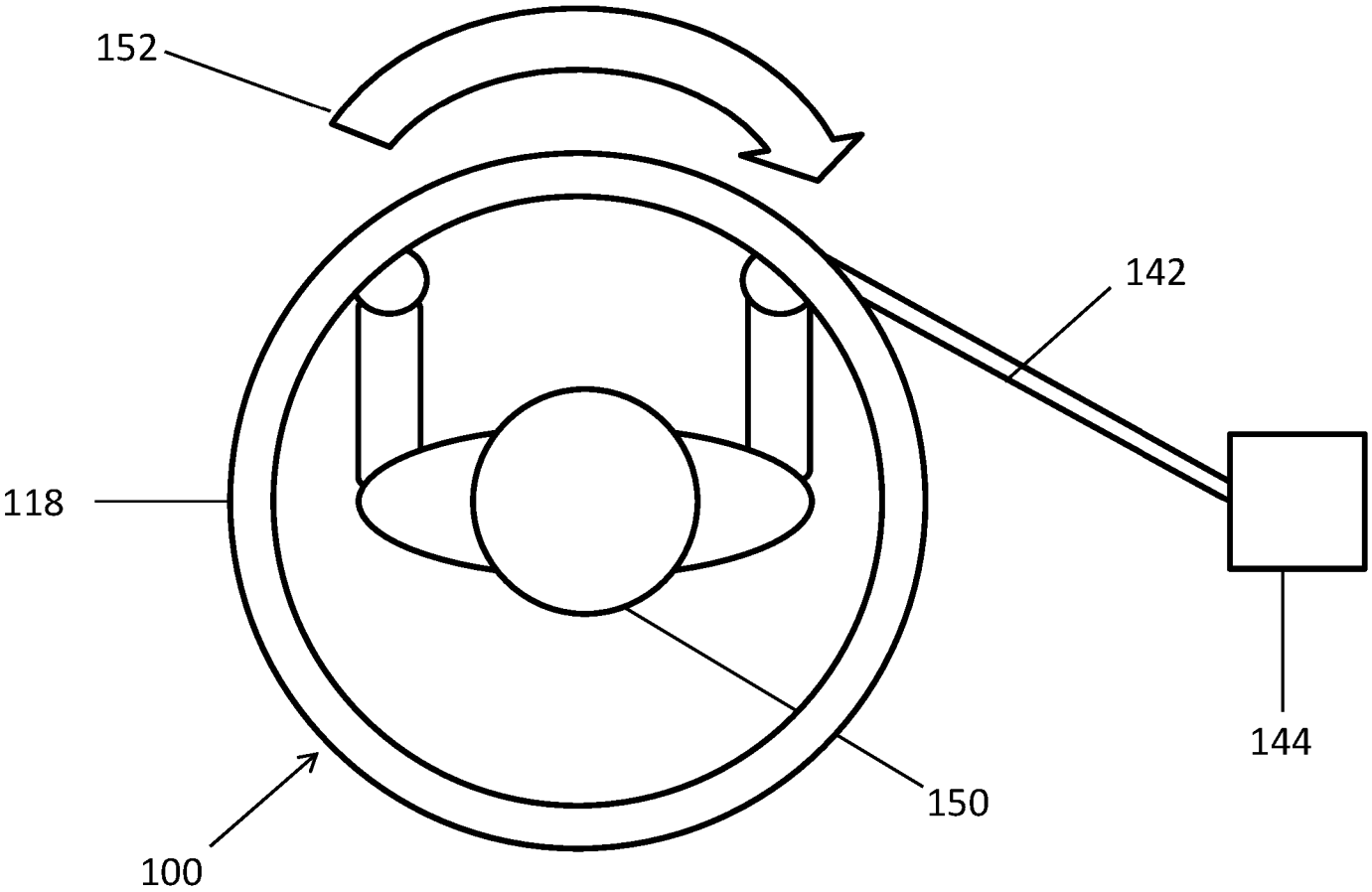
FIG. 24 shows a simplified plan view of a user using the exercise in a second position.

In FIG. 23 the user 150 has turned around through an angle of 180° anti-clockwise from the starting position in FIG. 22 and has rotated the device 100 simultaneously. The user 150 grips the handles (not shown) whilst turning so that the device turns through the same angle as the user. The tension in the resistance cable 142 increases upon rotation because it extends further beyond its natural length. The tension in the resistance cable 142 produces a resistance force which acts on the second frame section 118 via the connection point (not shown), and it acts in a direction towards the fixed resistance point 144.

The component of the resistance force which acts tangentially to the perimeter of the second frame section 118 creates a clockwise torque, indicated by the arrow 152. The user 150 resists against this torque and uses it as a means of exercise. The user 150 may twist in an anti-clockwise direction to increase the amount of torque being applied or reduce the torque through twisting clockwise. As the user twists through a greater angle, the torque applied to the device 100 increases. In this example the user twists between the positions shown in FIGS. 23 and 24 in order to exercise.

Figure 25:
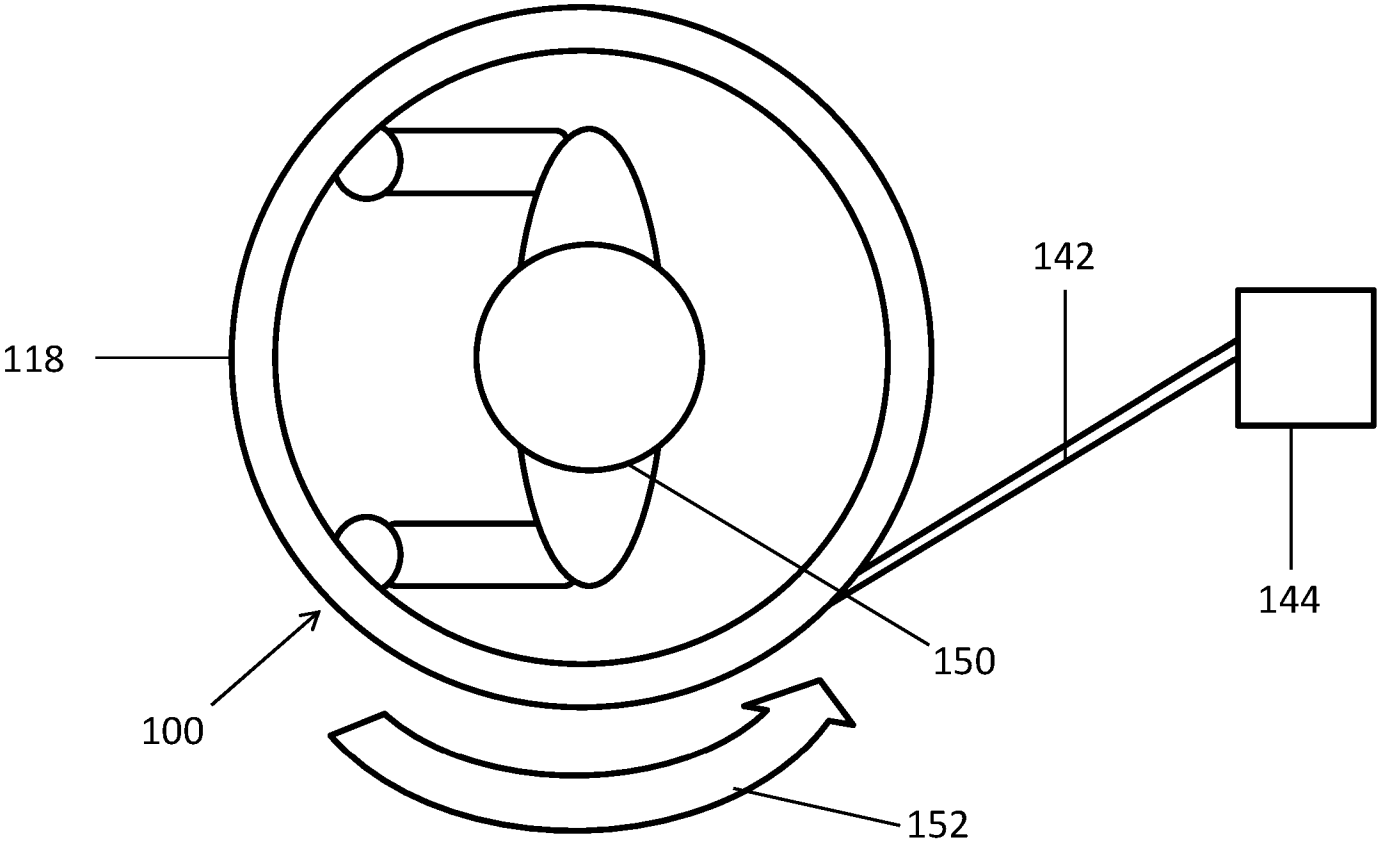
FIG. 25 shows a simplified plan view of a user using the exercise in a third position.
Figure 26:
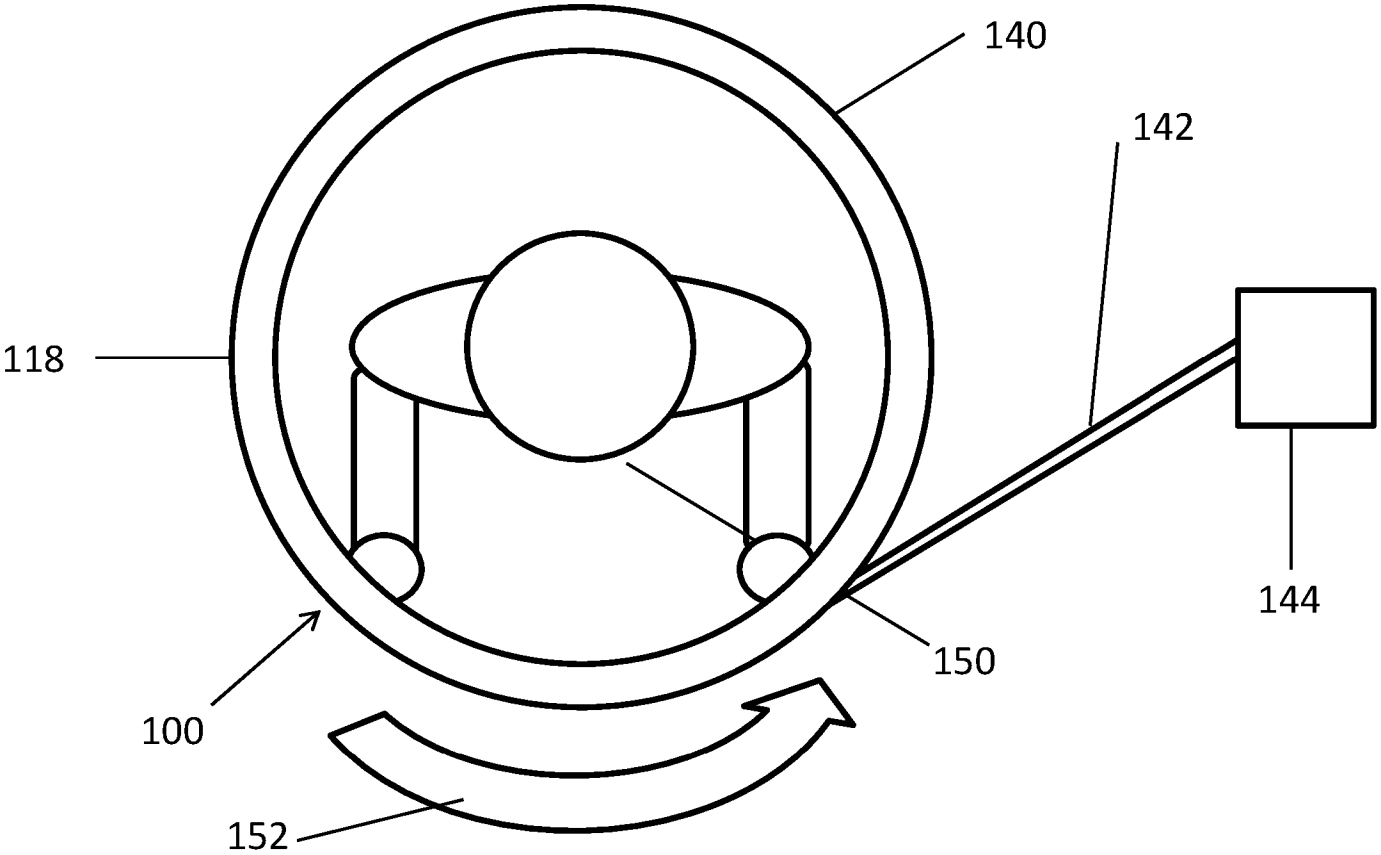
FIG. 26 shows a simplified plan view of a user using the exercise in a fourth position.

In order to exercise the other side of his or her body the user can turn the other way from the starting position shown in FIG. 22. As shown in FIGS. 25 and 25 an anti-clockwise torque 152 is provided against which the user can exercise through twisting in a clockwise direction.

By twisting it is meant that the user keeps his or her feet in position or at least does not move his or her position much, and the movement comes from turning of the torso. Such actions are common in many sports, particularly sports which involve striking—such as golf, hockey and racquet sports.

The user 150 may twist in clockwise and anti-clockwise directions periodically as a means of exercise. The user 150 may rotate through small angles to repeatedly exercise a specific muscle group. The user may rotate through larger angles to exercise a wider variety of muscle groups.

In other examples, the user 150 may rotate clockwise from the starting position. In such examples, the torque which the user 150 exercises against would then be in an anti-clockwise direction.

In some situations the user may turn the device through an angle greater than 360° in order to get into a starting position. In such a situation, the resistance member 142 will wrap around the perimeter of the second frame section 118. As the user 150 rotates, the resistance member 142 may be supported within the channel 130. The channel may decrease the chance of the resistance member 142 losing contact with the second frame section 118 than if the resistance member simply wrapper around a perimeter of the device.

In the examples shown in FIGS. 23-26, the user is using the centre of the device 100 as the axis of rotation. In other examples, the centre of rotation may be displaced from the centre of the device.

Figure 28:
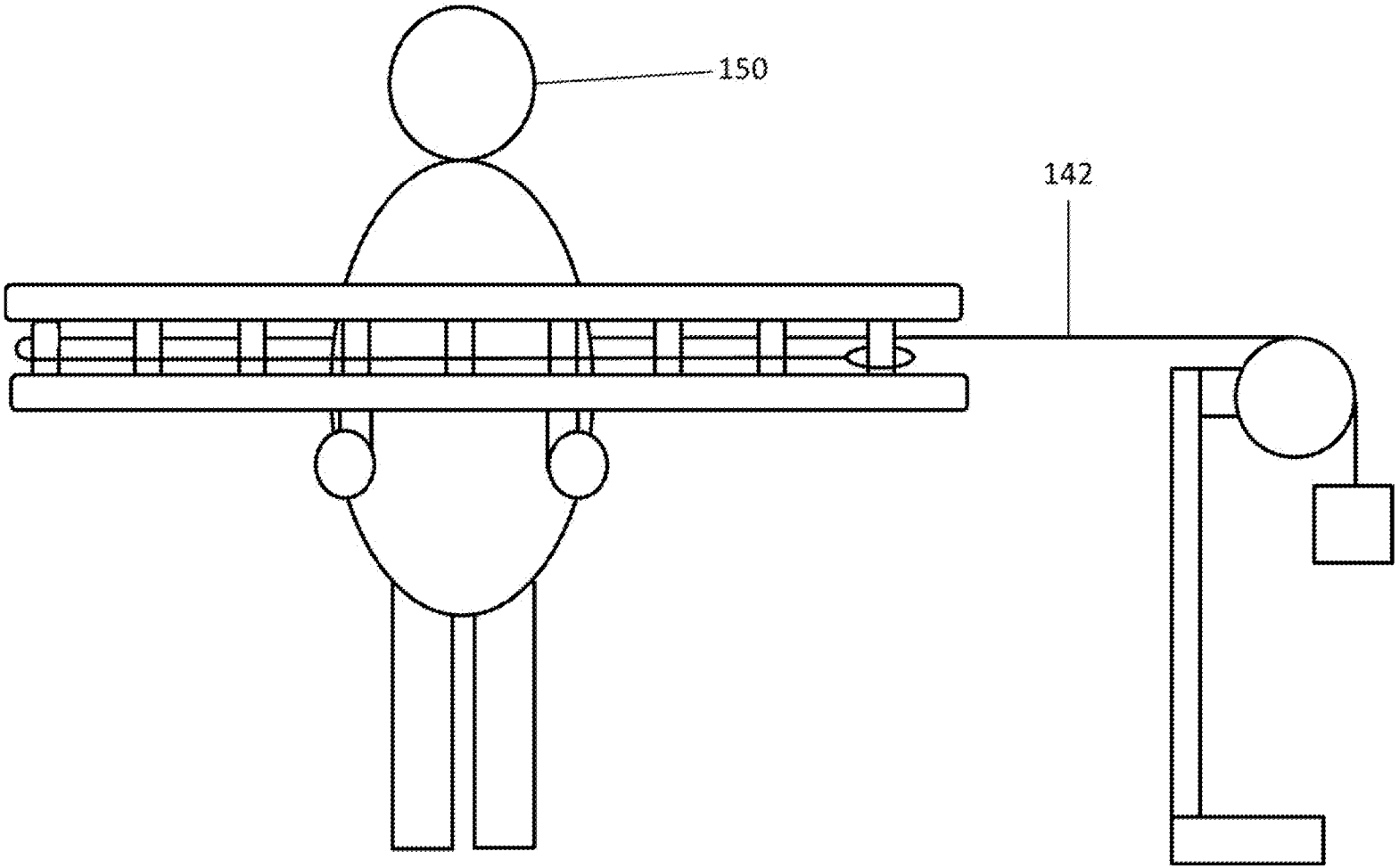
FIG. 28 shows a simplified schematic of an exercise device in use in a first arrangement.
Figure 29:
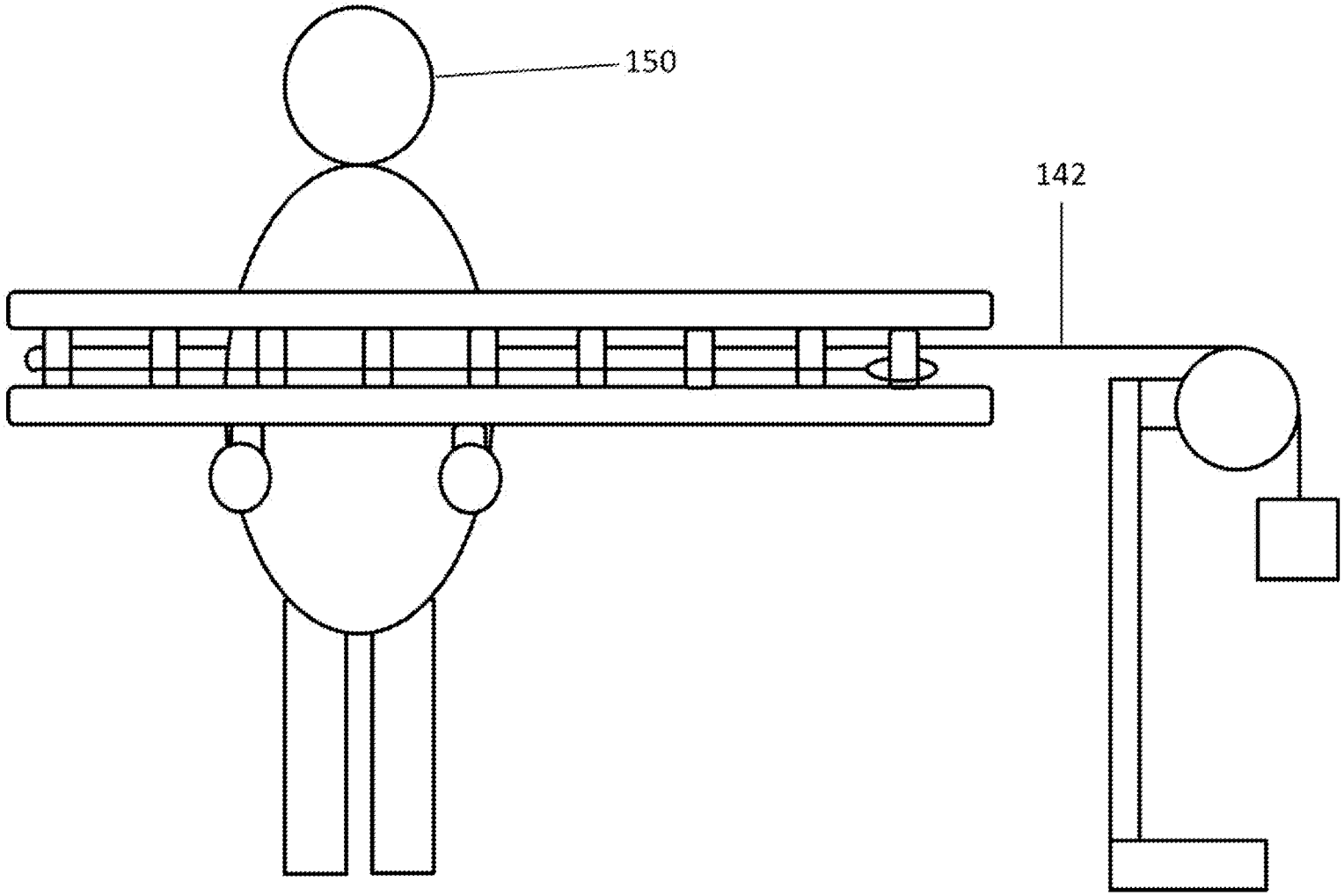
FIG. 29 shows a simplified schematic of an exercise device in use in a second arrangement.

In other examples, the resistance member 142 may be non-extendable and the resistance point 144 may be a pulley weight system. Examples are shown in FIGS. 28-29. In these examples, the resistance force does not vary with the angle through which the user 150 rotates. Instead, in this example, the resistance force which is applied to the second frame section 118, and hence also the torque, is dependent on the amount of weight being lifted by the pulley weight system 144.

As the user 150 rotates the device 100, the attachment point 140 moves the resistance member 142 via the first end of the resistance member 142. The second end of the resistance member 142 is attached to the pulley weight system 144. As the user rotates, the resistance member 142 exerts a force on the pulley weight system 144 in order to lift a set of weights. The user may periodically rotate clockwise and anti-clockwise in order to repeatedly lift the weights as a means of exercise.

The non-extendable resistance member 142 is made from a material which is sufficiently strong to avoid it snapping when a large force is imposed on it from the pulley weight system.

Figure 27:
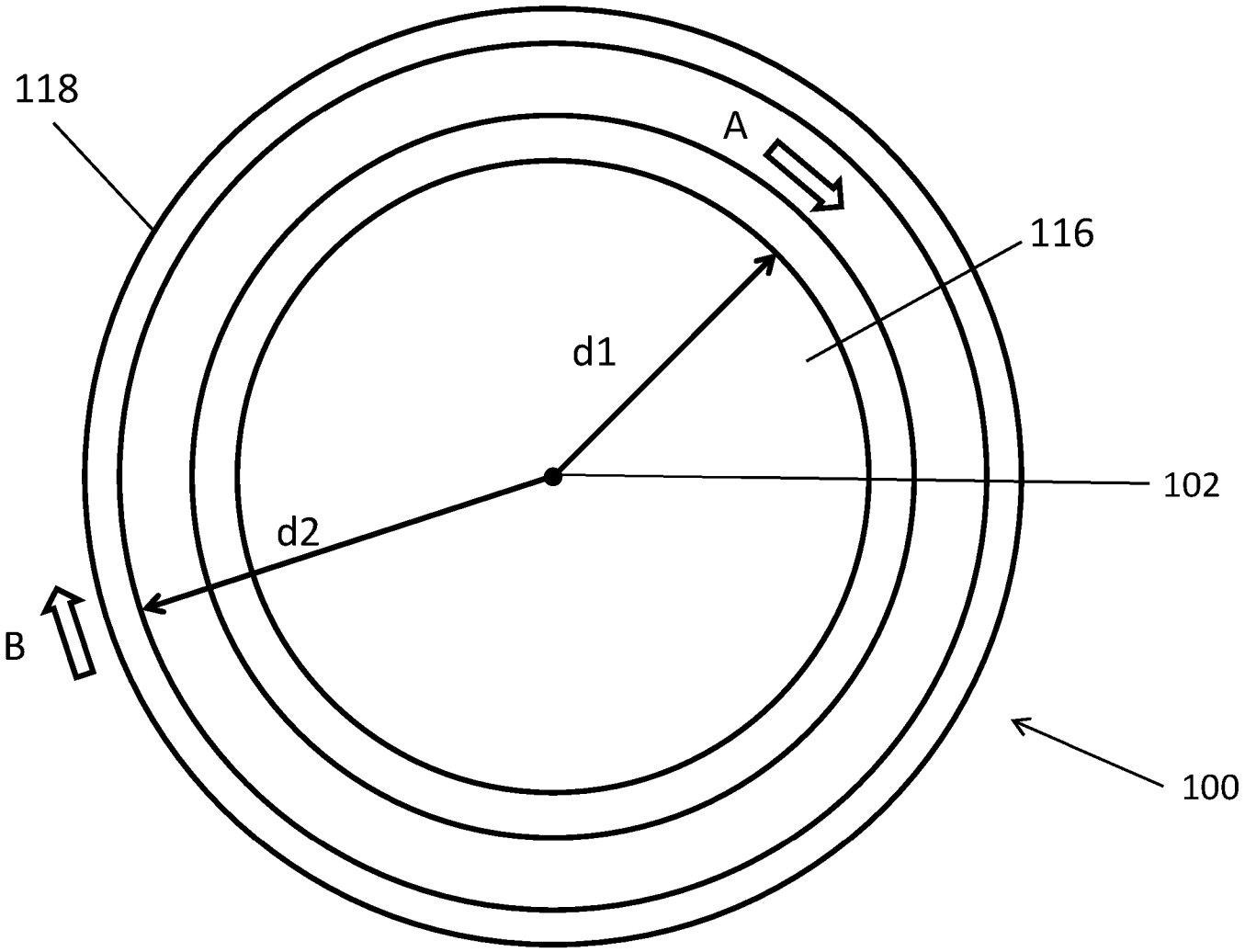
FIG. 27 shows a force diagram representing the forces applied when an exercise device is in use.

FIG. 27 shows how the moment about the centre of rotation 102 of the device 100 can vary according to which frame section 116, 118 the force is applied to. The first frame section 116 is a distance d1 away from the centre of the device 100. The second frame section is a distance d2 away from the centre of the device 100.

When a force is applied to the first frame section 116 as indicated by arrow A, the moment produced about the centre of the rotation 102 of the device 100 is given by the equation: Moment=d1×Size of force A. Similarly, When a force is applied to the second frame section 118 as indicated by arrow B, the moment produced about the centre of the rotation 102 of the device 100 is given by the equation: Moment=d2×Size of force B. As such, the same moment can be applied by applying less force when the force is applied to the second frame section 118 rather than the first frame section 116. Similarly, the same moment can be applied by applying a greater force when the force is applied to the first frame section 116 rather than the second frame section 118. A user may use handles and/or attachment points positioned on the various frame sections according to this principle.

FIGS. 28 and 29 show a user using the device with a weighted pulley exercise machine (which may be an exercise machine 10, 20 such as those shown in FIGS. 1 and 2. In FIG. 28 the device has a concentric aperture to the device. In FIG. 29 the aperture is off-centre. Differing the axes of the aperture and the frame can allow for different exercise types to be performed and also to provide different weight profiles. For example a circular device with a concentric aperture may provide a more uniform resistance, whereas a non-concentric aperture may provide a non-uniform resistance profile. A non-uniform resistance profile can be useful for simulating sporting movements (e.g. at different points of a swing of a racquet, club or bat)

Figure 30:
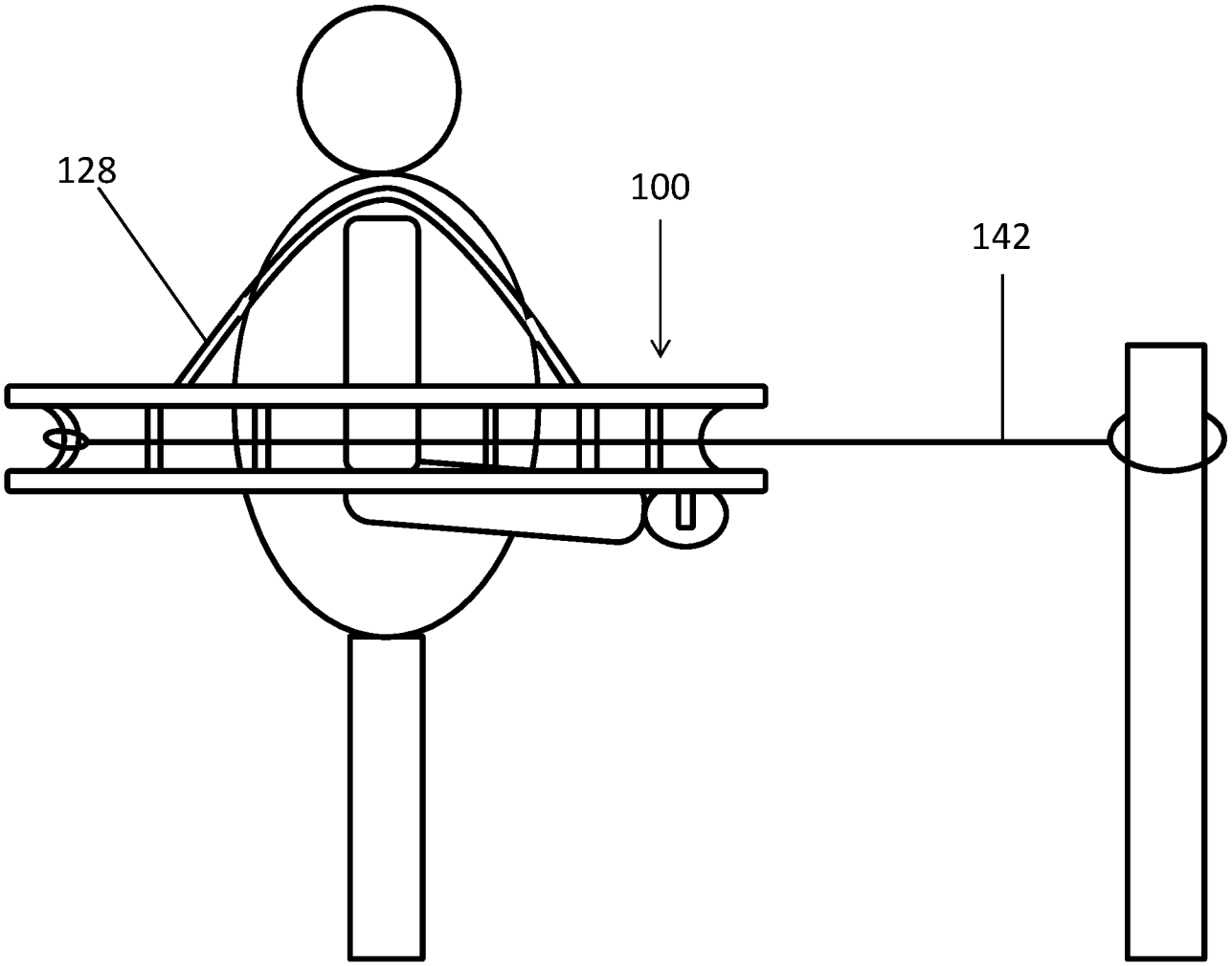
FIG. 30 shows a simplified schematic of an exercise device in use in a third arrangement.

FIG. 30 shows a simplified schematic of an exercise device in use with a fixed resistance point. In this example, there are straps 128 connected to the second frame section 118. The straps are being worn over the shoulders of the user 150 in order to support the device 100. In other examples, the straps 128 may be connected to any other frame section, such as the first frame section (not shown). The straps 128 are constructed from a durable fabric. Suitable materials include polyester, leather or cotton or any other suitable material. Padding may be provided on the straps in a region that is configured to sit on the user's shoulders in use in order to provide improved comfort over an unpadded strap. The straps 128 are constructed of a material that is lightweight and that is comfortable for a user to wear. The straps 128 are constructed to have enough tensile strength such that the straps do not distort or snap when a force is exerted on them through the weight of the device 100. The shoulder straps may be adjustable. Adjusting the shoulder straps may allow the device to be configured to fit different torso lengths. The adjustability may also provide the option to position the device to exercise different muscle groups.

Figure 31:
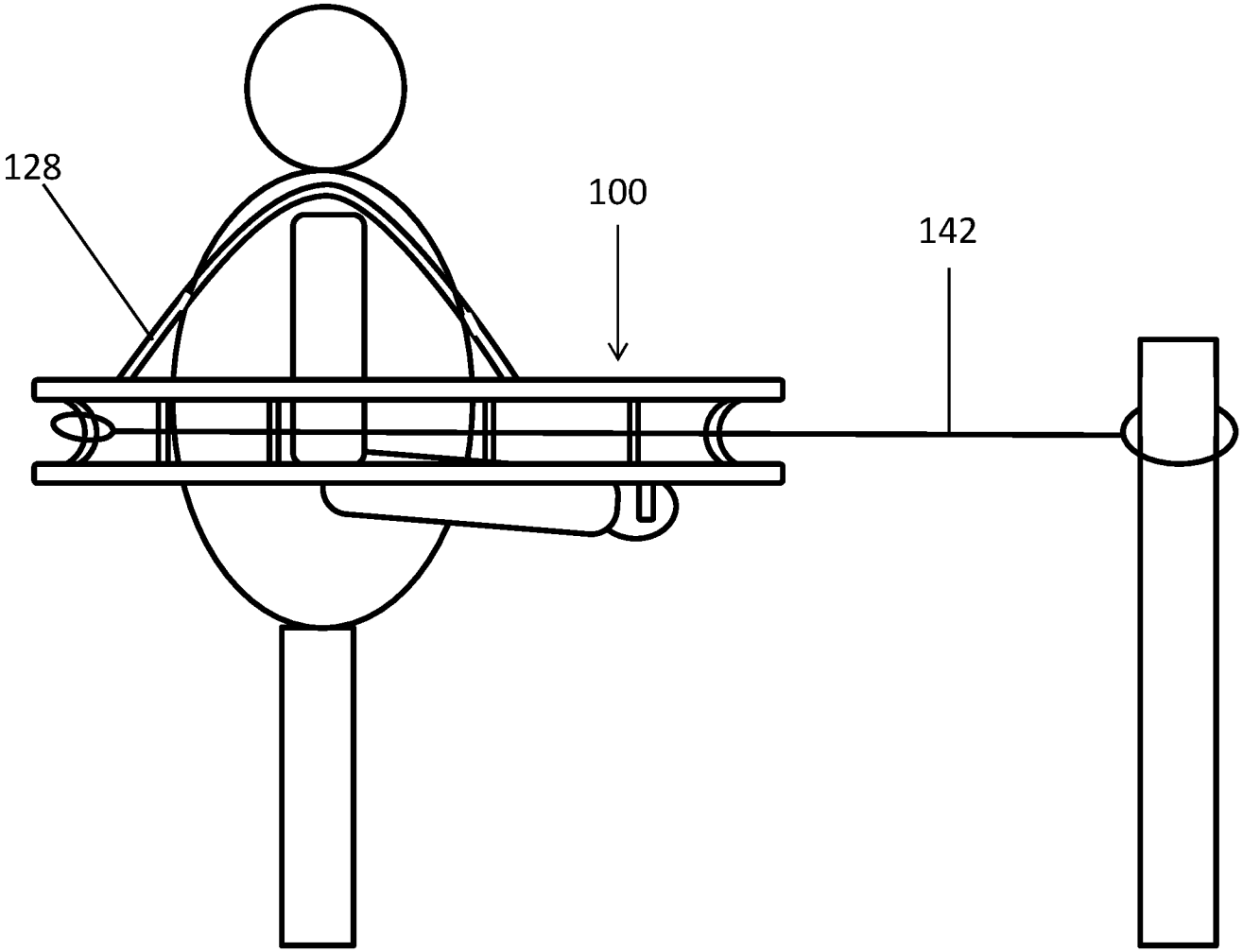
FIG. 31 shows a simplified schematic of an exercise device in use in a fourth arrangement.

FIG. 31 shows a simplified schematic of an exercise device 100 in use with a fixed resistance point. In this example, the central aperture 112 which receives the user is not concentric with the centre of the device 100.

Figure 32:
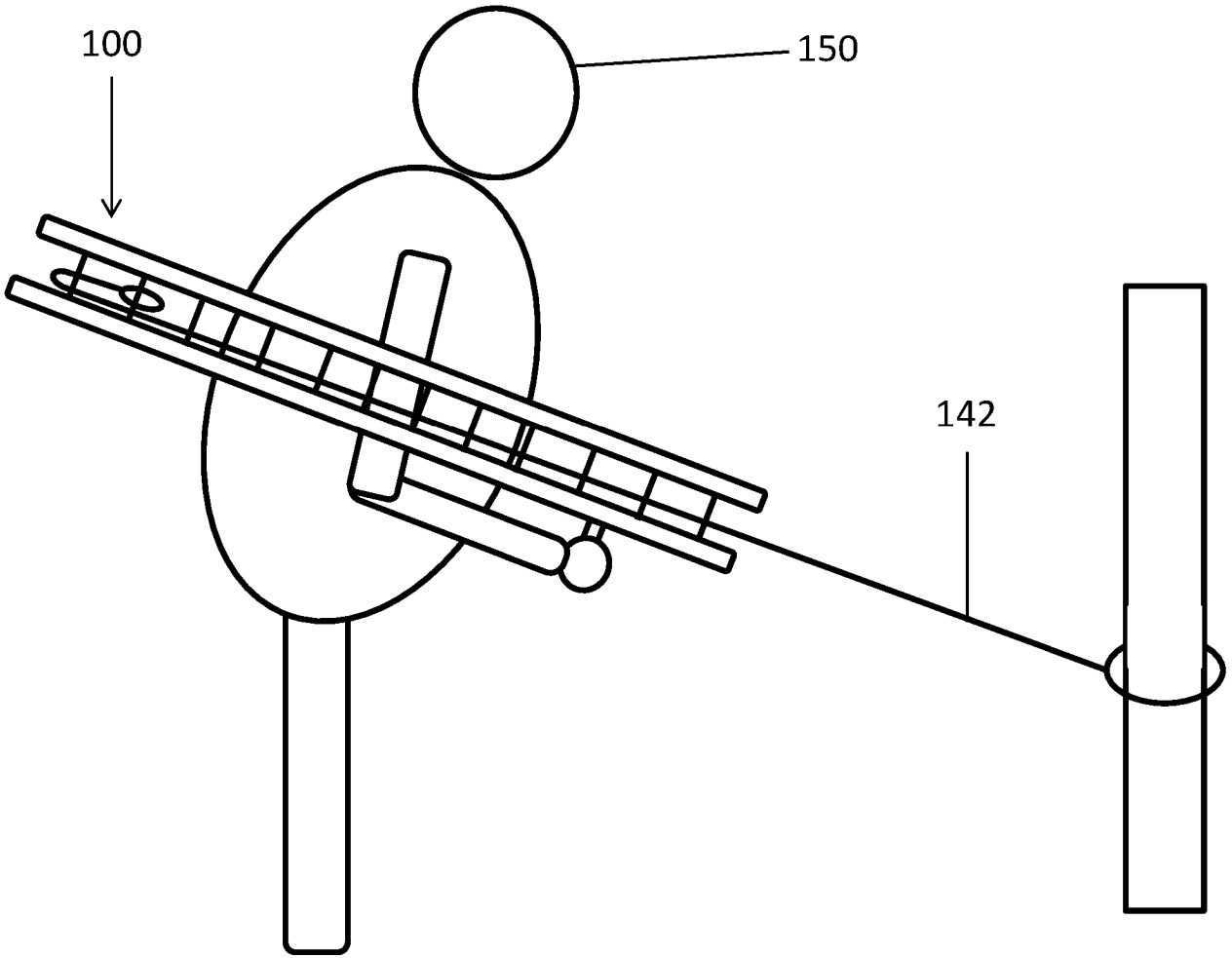
FIG. 32 shows a simplified schematic of an exercise device in use in a fifth arrangement.
Figure 33:
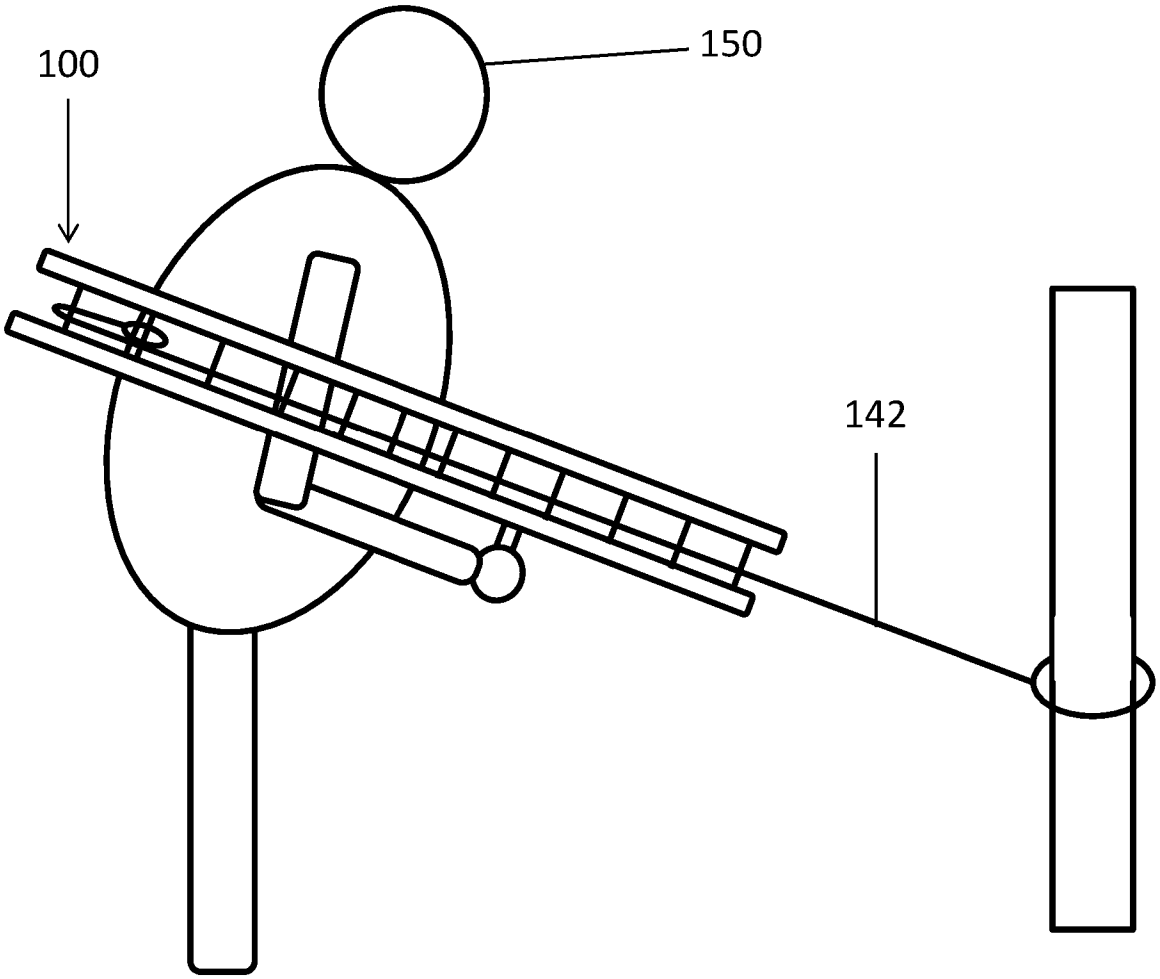
FIG. 33 shows a simplified schematic of an exercise device in use in a sixth arrangement.

FIGS. 32 and 33 show simplified schematics of an alternative way of a user using the exercise devices in FIGS. 30 and 31 respectively. In these examples, the user 150 has rotated his or her torso forward through a small angle in order to exercise different muscles. The user can therefore alter his or her body position to mimic the positions used in various sports.

Figure 34:
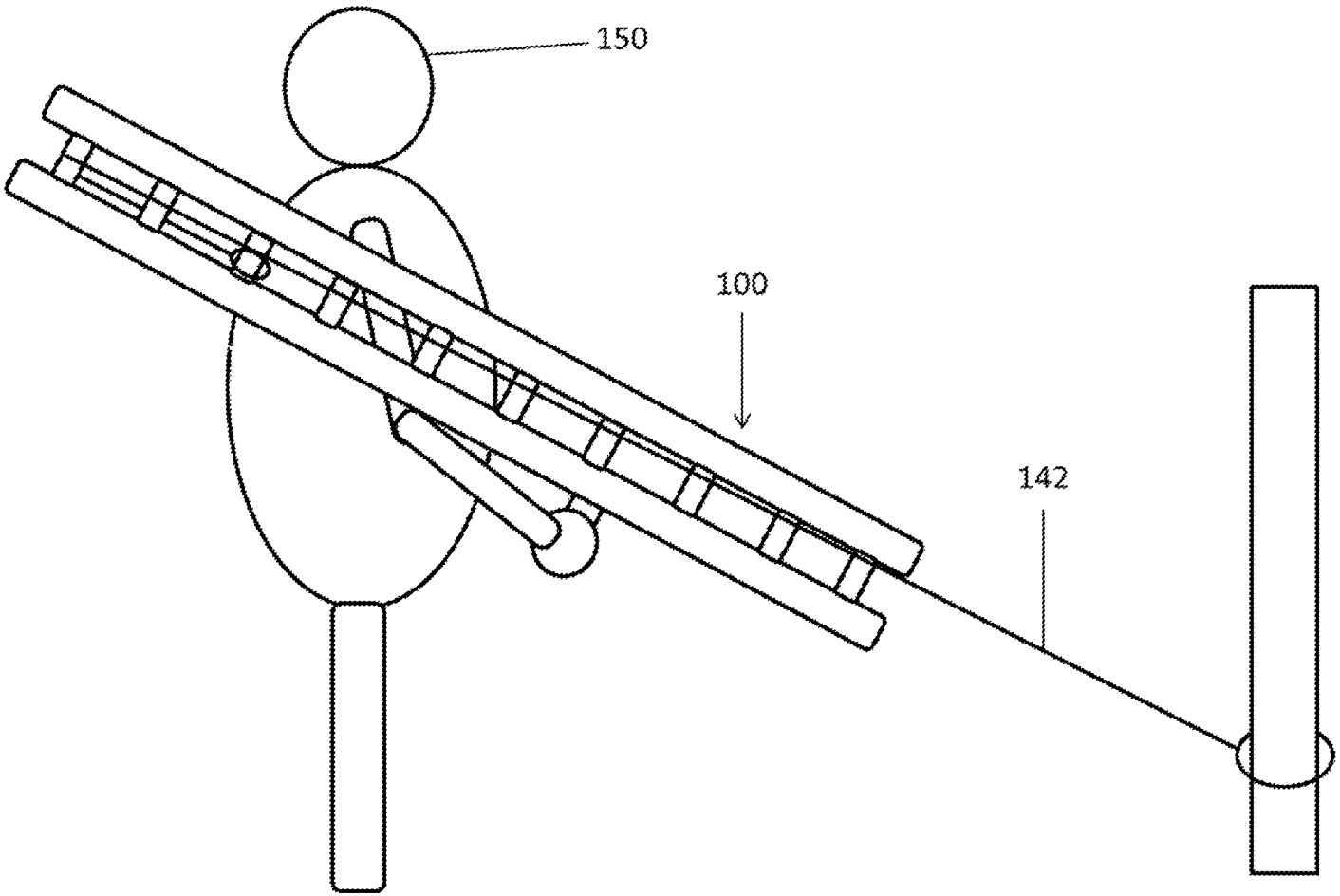
FIG. 34 shows a simplified schematic of an exercise device in use in a seventh arrangement.
Figure 35:
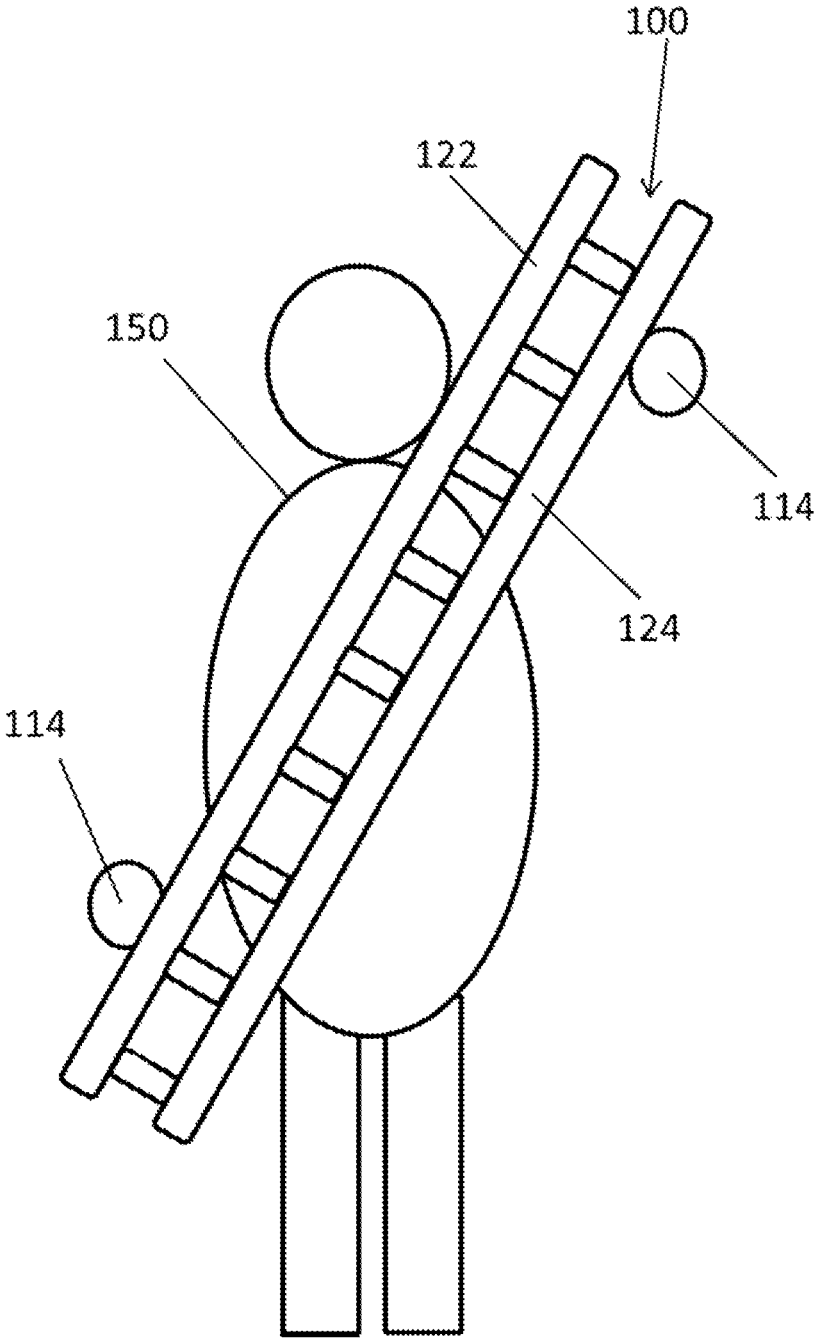
FIG. 35 shows a simplified schematic of an exercise device in use in an eighth arrangement.

FIGS. 34 and 35 show simplified schematics of a user using the exercise device in alternative ways. In these examples, the user 150 has rotated the device 100 so that it is no longer parallel with the length of the user's 150 body and instead sits around the shoulders. This can allow a user to exercise different muscles groups, such as the trapezoidal muscles.

In FIG. 35, there are handles 114 above attached to the top section 122 and below attached to the bottom section 124 of the device 100. This enables a user 150 to exercise different muscles and muscle groups. This may allow a user to replicate other sports which also require core strength but also differing movement profiles. In this case such a sport may be canoeing or kayaking.

Figure 36:
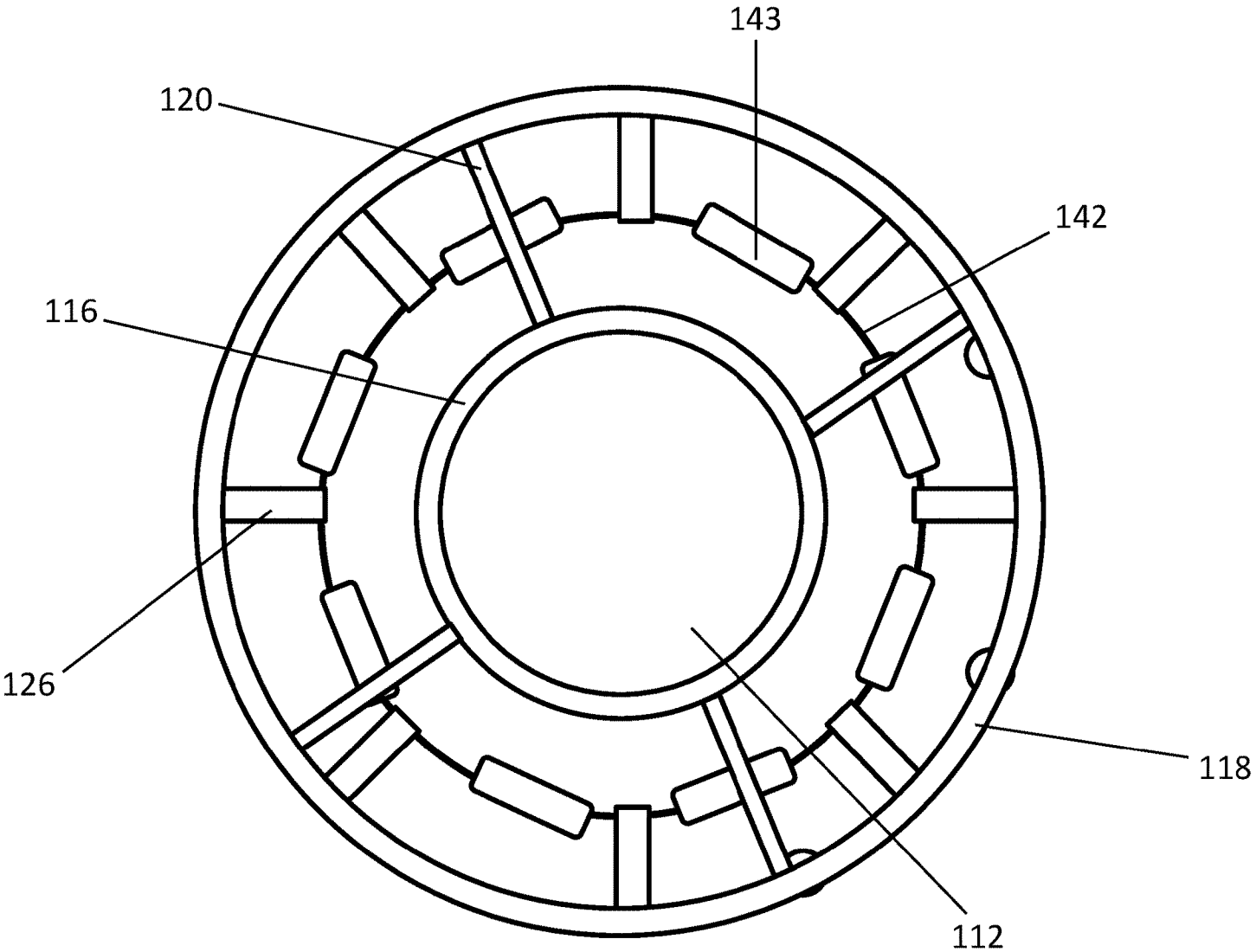
FIG. 36 shows a simplified schematic of another exercise device.

In some examples the device is not used with an external resistance point in order to provide a resistance torque. Instead, a user can simply exercise against a moment of inertia of the device. In order to vary the moment of inertia the resistance member can be provided to increase mass rather than to be fixed to an external resistance point. Such an example is shown in FIG. 36 shows a simplified schematic of an alternative exercise device 100. In this example, the resistance member 142 is a rope comprising weights 143. The weighted rope 142 is wrapped around the outer perimeter of the device 100 to increase the moment of inertia about the centre of the device.

Figure 37:
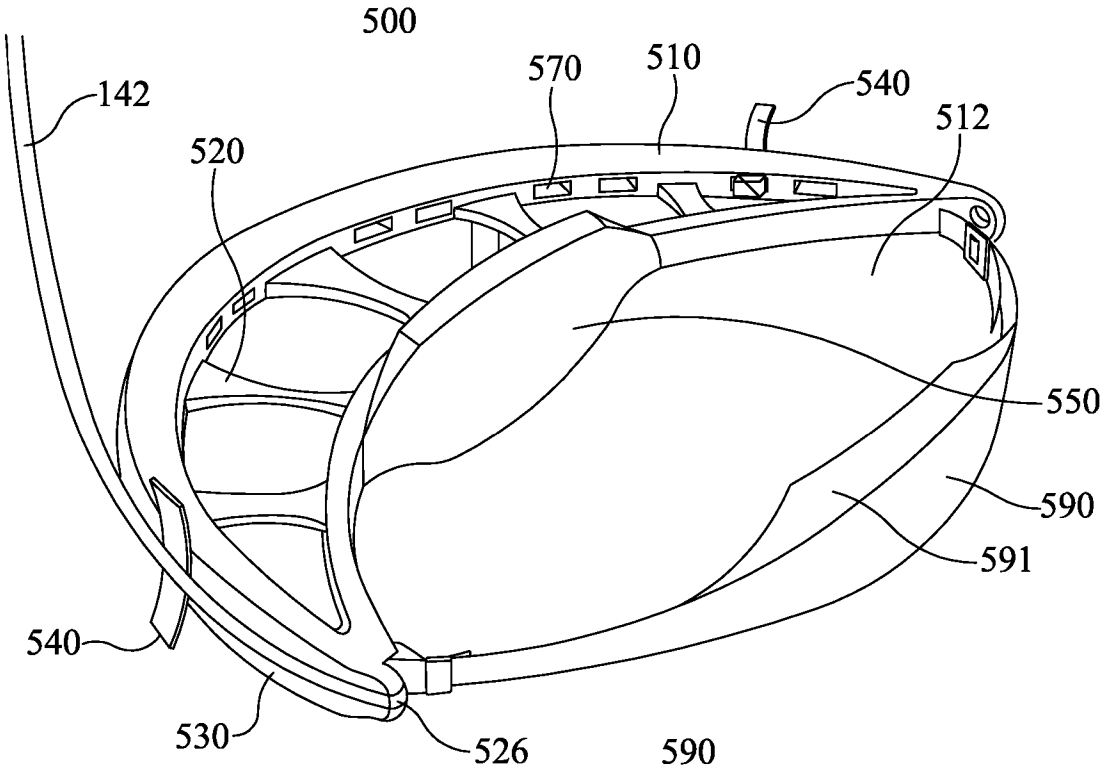
FIG. 37 shows a perspective view of another exercise device.
Figure 38:
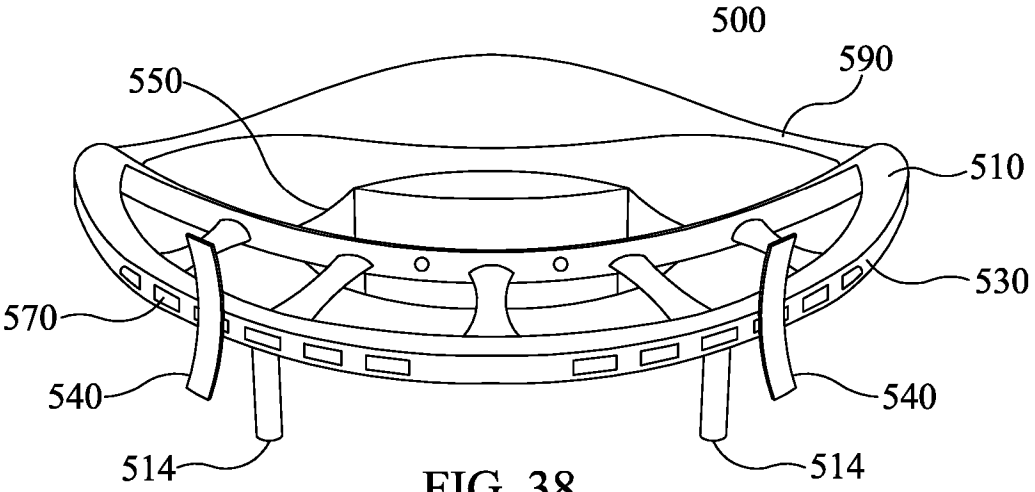
FIG. 38 shows perspective view from the front of the exercise device of FIG. 37.
Figure 39:
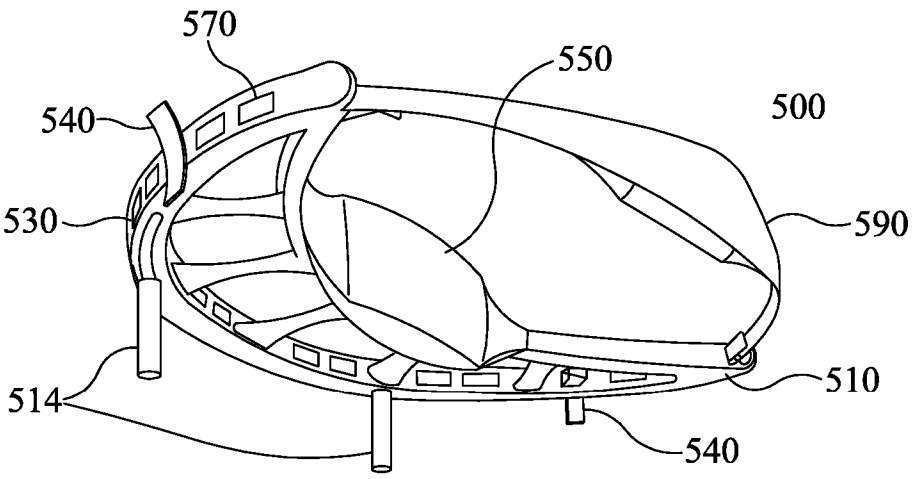
FIG. 39 shows another perspective view from of the exercise device of FIG. 37 from an angle showing the underneath of the device.

Another example of an exercise device 500 is shown in FIGS. 37-39. In this example the exercise device 500 has a 'walk-in' design rather than an 'over-the-head' design as in the previous examples (although a user could still use this device by passing it over his/her head when the device is fully assembled). The frame 510 of the device 500 does not fully encompass the user when used, but rather has a crescent form into which a user can step. Other forms, such as semi-circular or arc may also be used in place of the crescent shape. The frame is of lightweight construction and has a plurality of structural webs 520 that provide structural rigidity to the frame. The frame 510 is constructed from two plastic moulded components split horizontally. Forming from the two components allows for easier moulding and forming of the features of the device than if the frame 510 was formed from a single component. A support strap 590 is attached to the frame to close the aperture 512 in which the user places themselves. The support strap 590 comprises a cushioned section 591. The cushioned section 591 provides lumbar support when in use. The cushioned section 591 is slidable along the support strap 590 to provide easy adjustability to position the support in the appropriate positon. As in the previous examples this device 500 of this example comprises an attachment point 526 and a channel 530 in which a resistance device 142 can be attached and located within respectively.

The channel 530 is extended in at least one area to offer more protection to the user in case of accidental disconnection of the resistance member 142. The extension is provided through the addition of at least one releasably attachable shield 540. The shield is substantially concave to locate the resistance member in the same manner as the channel 530. The shield 540 extends vertically in both directions to provide protection in either direction. There are preferably a plurality of shields, at least one for each of the left and right sides of the device 500. Each shield 540 clips into a hole 570 formed in the frame 510. The holes 510 also provide light weighting to the device and walls of the holes provide stiffness to the device 500. Adjustable handles 514 are provided for the user to grip when the device 500 is in use.

The frame 510 has a pad 550 attached to it. The pad 510 sits opposite to the cushioned section 591 of the support strap 590 when in use. The pad 550 is a thoracic pad in that is it is a pad that engages with the torso of the user when in use. In use, a user may position the device 500 such that pad 550 is adjacent to the front of the user's torso. The user may then close the aperture 512 by means of the support strap 590, such that the cushioned section 591 of the support strap 590 is adjacent to the rear of the user's torso. Alternatively, the device 500 may be operable with the pad 550 adjacent to the rear of a user's torso. The aperture 512 does not necessarily have to be closed by means of the support strap 590 in use—the user may just put the device around the front of their torso, possibly with the pad between their torso and the frame of the device, with nothing behind their back. This may be quicker an d easier to do than to pass straps behind them. In some embodiments, the support strap 590 may not be present.

In addition or alternatively to the frame pad 550 and the cushioned section 591 of the support strap 590, the frame 510 may comprise further padding. For example, padding may be provided on inner surfaces of the frame 510 which could come into contact with a user if the device 500 in use, such as at the edges of the inner section of the frame 510.

Figure 41:
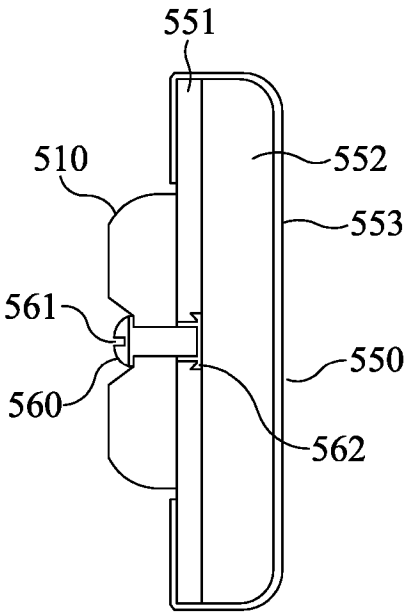
FIG. 41 shows a cross section through the highlighted section of FIG. 40.
Figure 40:
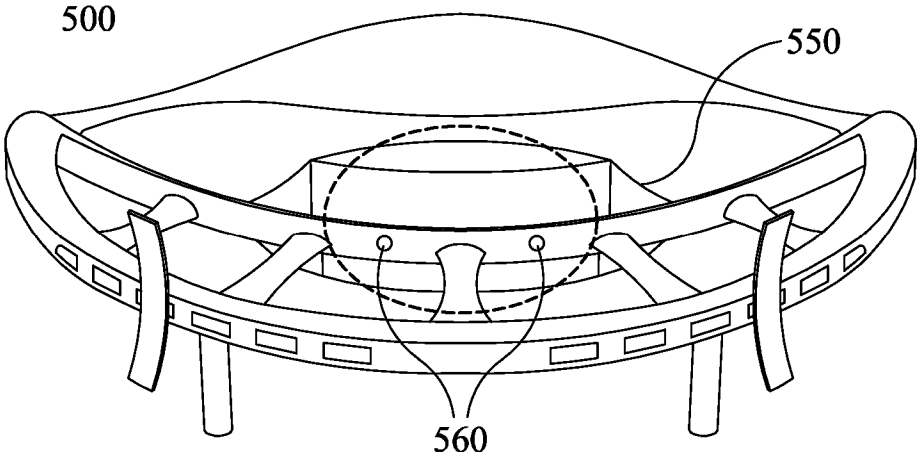
FIG. 40 shows a perspective view of the exercise device of FIG. 37, highlighting a section.

Mode detail regarding the pad 550 is shown in FIGS. 40 and 41. FIG. 40 shows a view from the front of the device. Attachment means 560 are shown within the circled areas of the device 500. The pad 550 is secured to the frame 510 in two locations in order to provide a secure fitting and anti-rotation. The construction of the pad is shown in FIG. 41. The pad comprises a structural base layer 551. The structural base layer 551 provides rigidity and stiffness to the pad. Some flexibility is preferred in construction in order to provide some flexibility in response to user movements and therefore improve comfort. This can also reduce the risk of snapping than if less flexible materials are used. Plywood is an example of a suitable material for the structural base layer 551. A cushion layer 552 is applied to the structural base layer 551. The cushion layer 552 provides padding and comfort to the user when the device 500 is in use. Foam padding is a suitable material for the cushion layer 552. A top layer is provides as a cover 553. The cover 553 encases the cushion layer 552. The cover protects the cushion layer from ingress of sweat or other contaminants which may degrade the life of the cushion layer. The cover also provides a comfortable surface for the user to interface with. A suitable material for the cover 553 is a faux leather such as they type often used in conventional gym equipment seats. The pad 550 is attached to the frame using attachment means 560. The attachment means 560 comprises a nut 562 and a bolt 561. The nut is preferably a T-nut as these provide additional security and anti-rotation when used in materials such as the plywood given as an example for the structural base layer 551.

Figure 44:
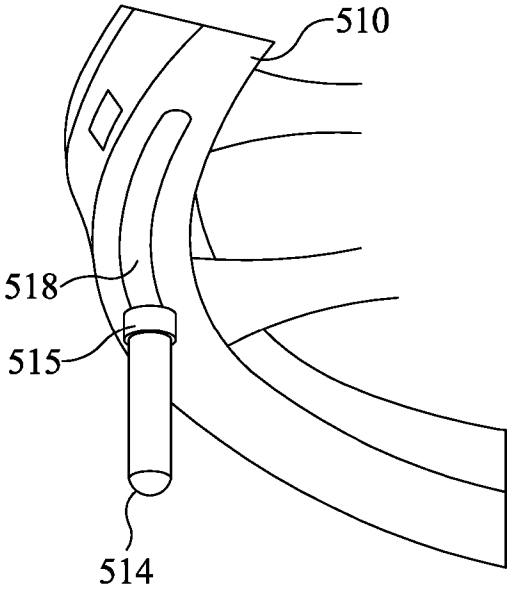
FIG. 44 shows a magnified view of the highlighted section of FIG. 42.
Figure 42:
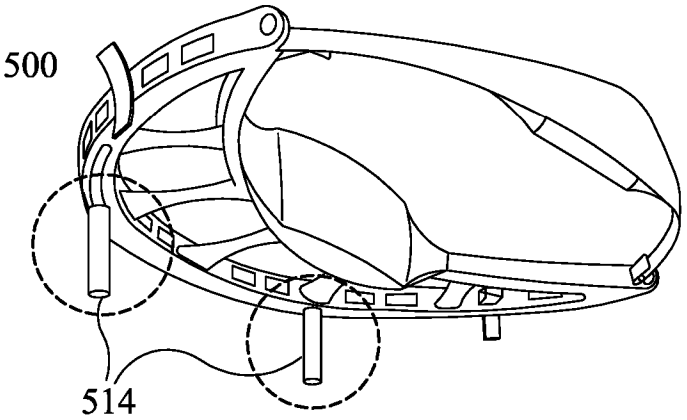
FIG. 42 shows a perspective view of the exercise device of FIG. 37, highlighting another section.
Figure 43:
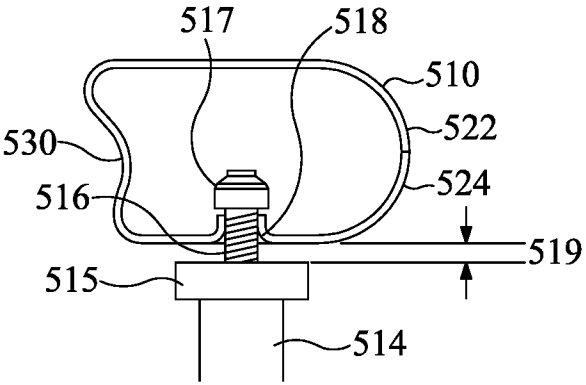
FIG. 43 shows a cross section through the highlighted section of FIG. 42.

The handles 514 and their adjustment means are shown in more detail in FIGS. 42 to 44. The handle 514 is attached to the frame 510 via a nut 517 and a bolt 516. The bolt 516 is a threaded section that is formed or moulded within the handle 514. The bolt 516 passes through a slot 518 in the frame 510. The handle 514 is assembled to the frame 510 during construction. The slot is formed in a lower section 524 of the frame 510. Once the bolt 516 is passed through the slot 518 and the nut 517 tightened on top a top section 522 of the frame 510 is fitted to the lower section 524. This encloses the nut and prevents further adjustment. In order to provide the adjustable position of the handle a collar 515 is therefore provided with the handle 514. The collar 515 has an internal threaded bore that engages with the thread of the bolt. Tightening or loosening the collar to close a gap 519 between the collar 515 and the frame 510 provides a releasable securing means for the handle 514. Loosening the collar 515 allows for the handle 514 to be moved to different positions within the slot 518. Once a suitable position is identified the collar 515 is tightened, locking the handle 514 into the preferred position. In other words to adjust the handle location, the collar is loosened at the top of the handle to release the tension between the nut, the plastic moulding and the collar. It is then possible to slide the handle to a desired position then re-fasten the collar 515 to secure the handle 514. The collar 515 is knurled to provide grip to a user. In some examples the handles are pivotable. A joint or hinge may be provided on the handle such that a user can vary their grip position.

In some embodiments, the handle 514 may comprise a longitudinal threaded bore to receive the bolt 516. In this way the handle 514 may be removed from the frame 510 by tightening the collar 515 to close the gap 519, thereby gripping the collar 515 against the frame 510 and holding the bolt 516 in a stationary position, before rotating the handle 514 about its longitudinal axis so as to loosen the handle 514 from the bolt 516. The handle 514 can be reattached by receiving the bolt 516 in the longitudinal threaded bore of the handle 514 and rotating the handle 514 about its longitudinal axis so as to tighten the handle against the bolt 516.

Removability of the handle 514 allows interchangeable handles to be used with the frame 510. For example, a plurality of different handles may be provided. Each handle may comprise a different grip or different dimensions. The handles can be interchanged by removing a currently attached handle from the frame 510 before attaching a different handle. The interchangeable handles enable the exercise device to be used by different users with different preferences in terms of grip and handle dimensions, and/or for training for different sports with different requirements.

Figure 45:
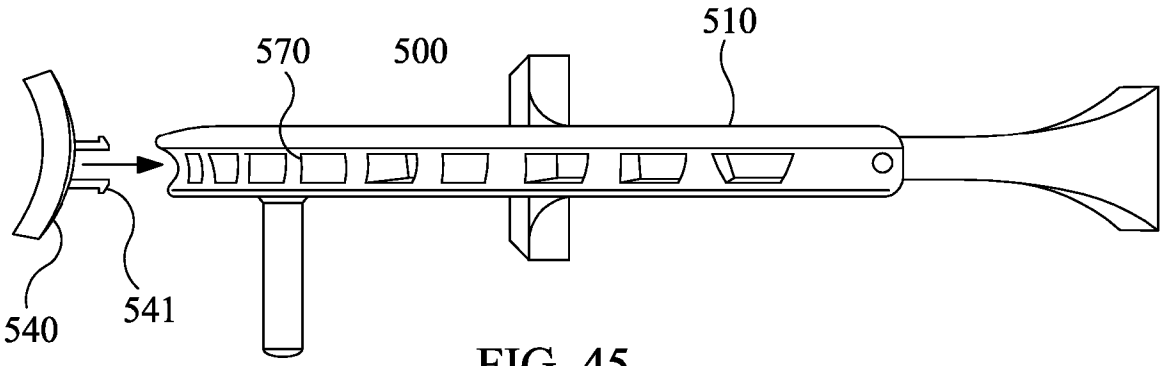
FIG. 45 shows a partially-exploded side view of the exercise device of FIG. 37.
Figure 46:
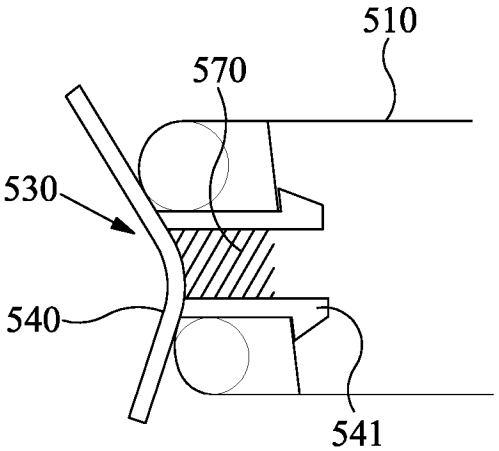
FIG. 46 shows a cross section of a portion of the exercise device of FIG. 37.

FIGS. 45 and 46 provide more detail with regards to the fitting of the shield 540. The shield comprises a snap hook 541. The snap hook 541 is elastically deformable. To fit the shield 540 the snap hook 541 is inserted through one of the holes 570 of the frame 510. The holes are formed to match the snap hook 541. The holes 570 extend substantially radially. The snap hook 541 retains the shield 540 once inserted. To release the shield 540, to change its position within the channel 530 for example, a user pinches the snap hook 541 together and pushes it back through the hole 570.

Figure 47:
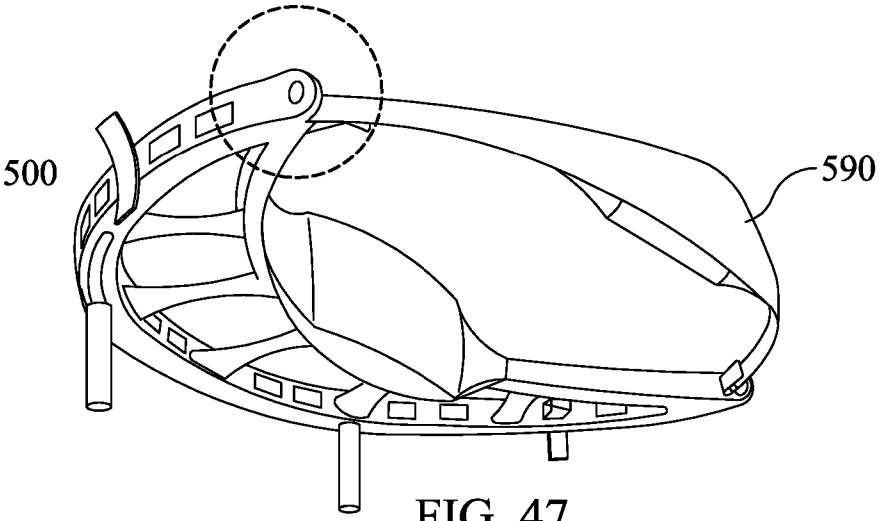
FIG. 47 shows a perspective view of the exercise device of FIG. 37, highlighting another section.
Figure 49:
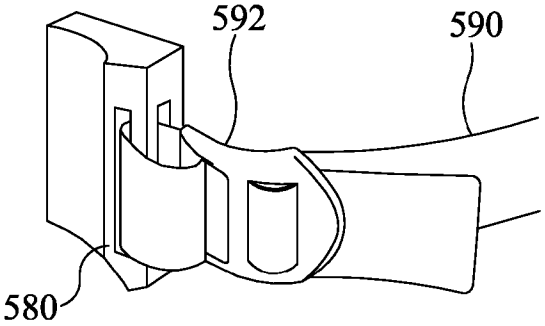
FIG. 49 shows a magnified view of the highlighted section of FIG. 47 with some other parts removed for clarity.
Figure 48:
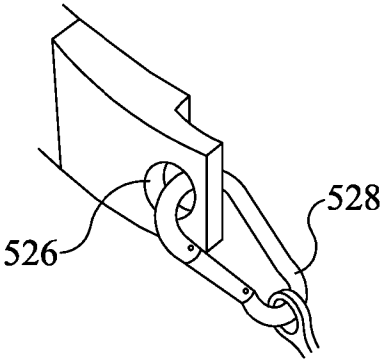
FIG. 48 shows a magnified view of the highlighted section of FIG. 47 with some parts removed for clarity.

The attachment points for the resistance member 142 and the support strap are shown in FIGS. 47 to 49.

The attachment point 526 for the resistance member 142 is shown in FIG. 47. In this example the resistance member 142 comprises a carabiner 528 which clips through the hole 526. A resistance member 142 in the form of a resistance band can be passed through the hole and tied on or similar. In some examples the attachment point 526 may be positioned elsewhere on the frame 510. The attachment point 526 can be positioned on a front facing part of the frame, rather than at the end points of the bow.

The attachment point 580 for the support strap 590 is shown in FIG. 49. The support strap 590 is adjustable to change its length. The adjustable support strap 590 provides adjustability for the device 590 for use with users of a variety of body sizes and age groups. A standard buckle fastener is shown in FIG. 49, adjustability could also be achieved in other examples through other means, such as hook and loop (such as the type produced by Velcro (RTM)) connections for example.

Figure 50:
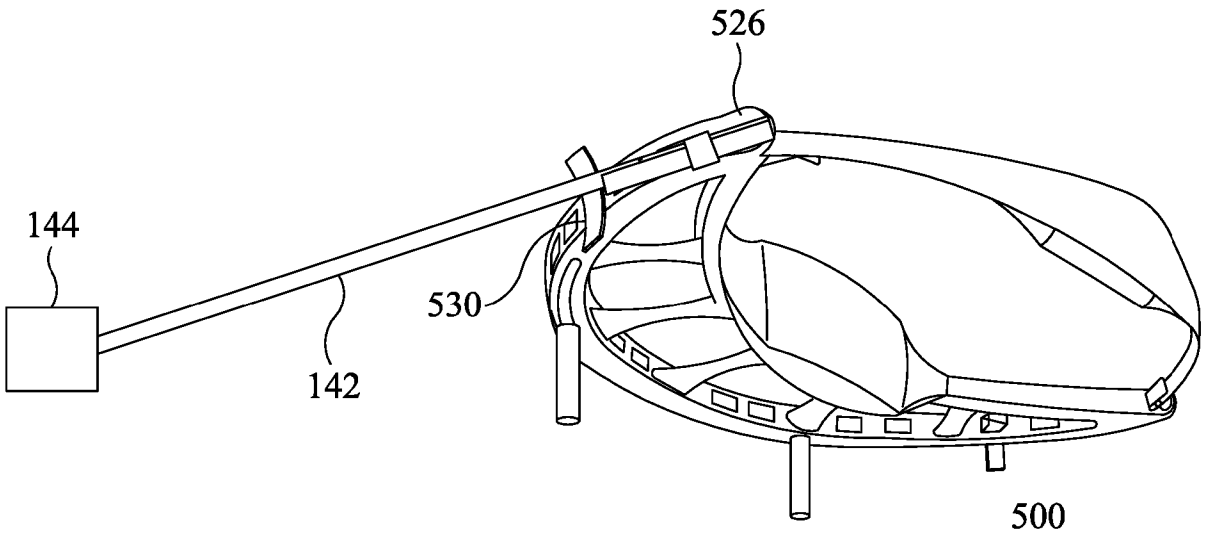
FIG. 50 shows a perspective view of the exercise device in use in a first configuration.
Figure 51:
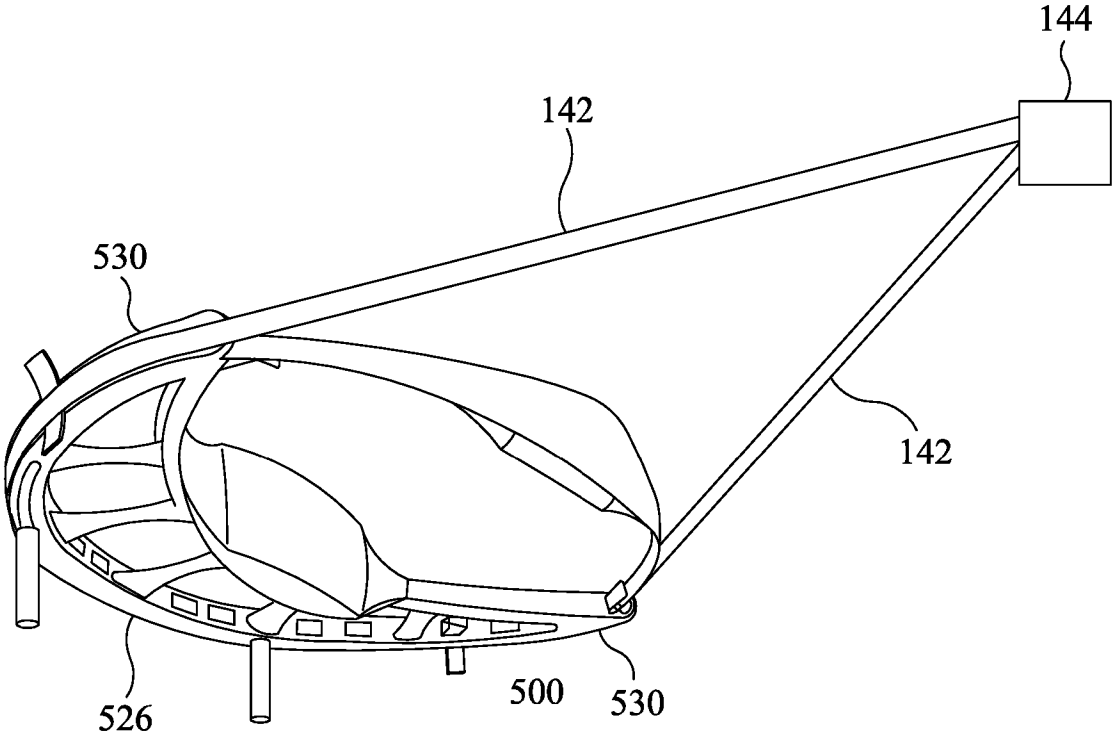
FIG. 51 shows a perspective view of the exercise device in use in a second configuration.
Figure 52:
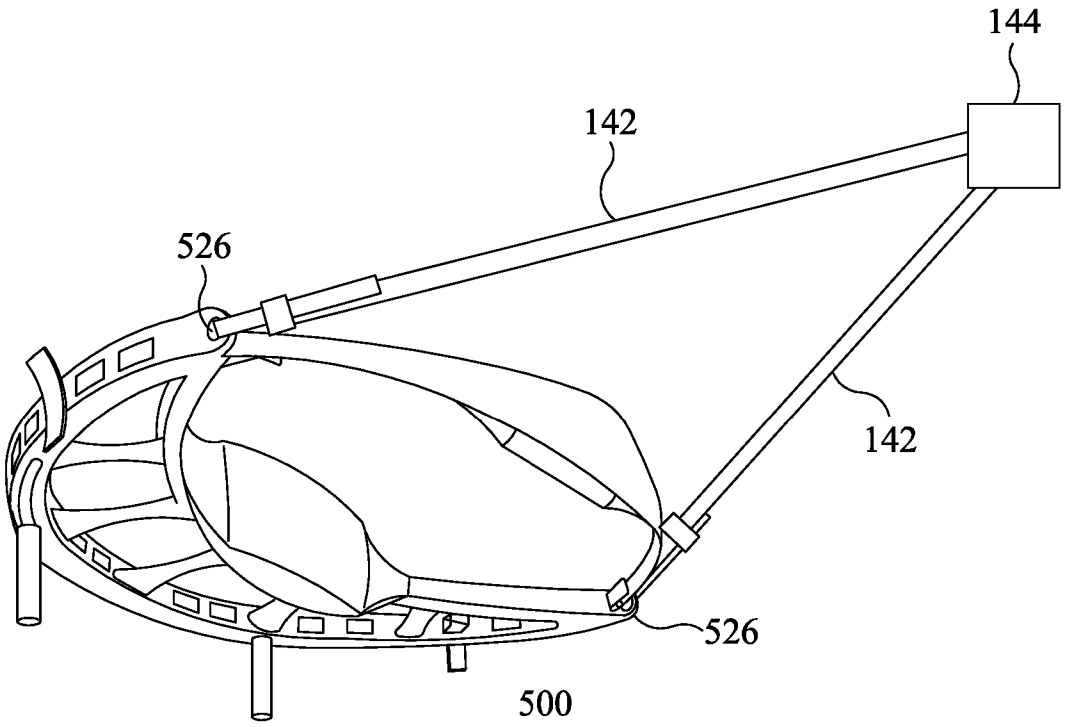
FIG. 52 shows a perspective view of the exercise device in use in a third configuration.

FIGS. 50 to 52 show various configurations of the device 500 when in-use, with the resistance member 142 attached to an external resistance point 144. In FIG. 50 a first end of a resistance member is attached to an attachment point 526 at one end of the frame. A second end of the resistance member 142 is attached to a resistance point 144. As the user twists in an anti-clockwise direction (when viewed from above) the resistance member sits in the channel 130 and the resistance force is provided tangentially to the device 500. If the first end of the resistance member is attached to the other end of the bow at another attachment point then the user can twist in a clockwise direction (when viewed from above) and the resistance member sits in the channel 130 and the resistance force is provided tangentially to the device 500. A pair of resistance members 142 can be used so that the user can rotate in both clockwise and anti-clockwise directions without having to re-position the resistance member.

In FIG. 51 a pair of resistance members 142 are attached to an attachment point 526 positioned at a centre of the bow. The resistance members 142 sit in respective left and right hand channels 530 and the resistance members are attached to a resistance point 144 that is situated behind the user when the device is in use.

In FIG. 52 a pair of resistance members 142 is attached to respective attachment points 526 at opposite ends of the bow. In this arrangement the resistance members do not sit in the channel 530, but extend directly from the attachment points to the resistance point 144, situated behind the user when in use.

Various configurations of the device can have one, two, or all three of the above described attachment points. The device can be supplied with one or two resistance members so that the user can use the device with one or two resistance members as preferred.

Figure 53:
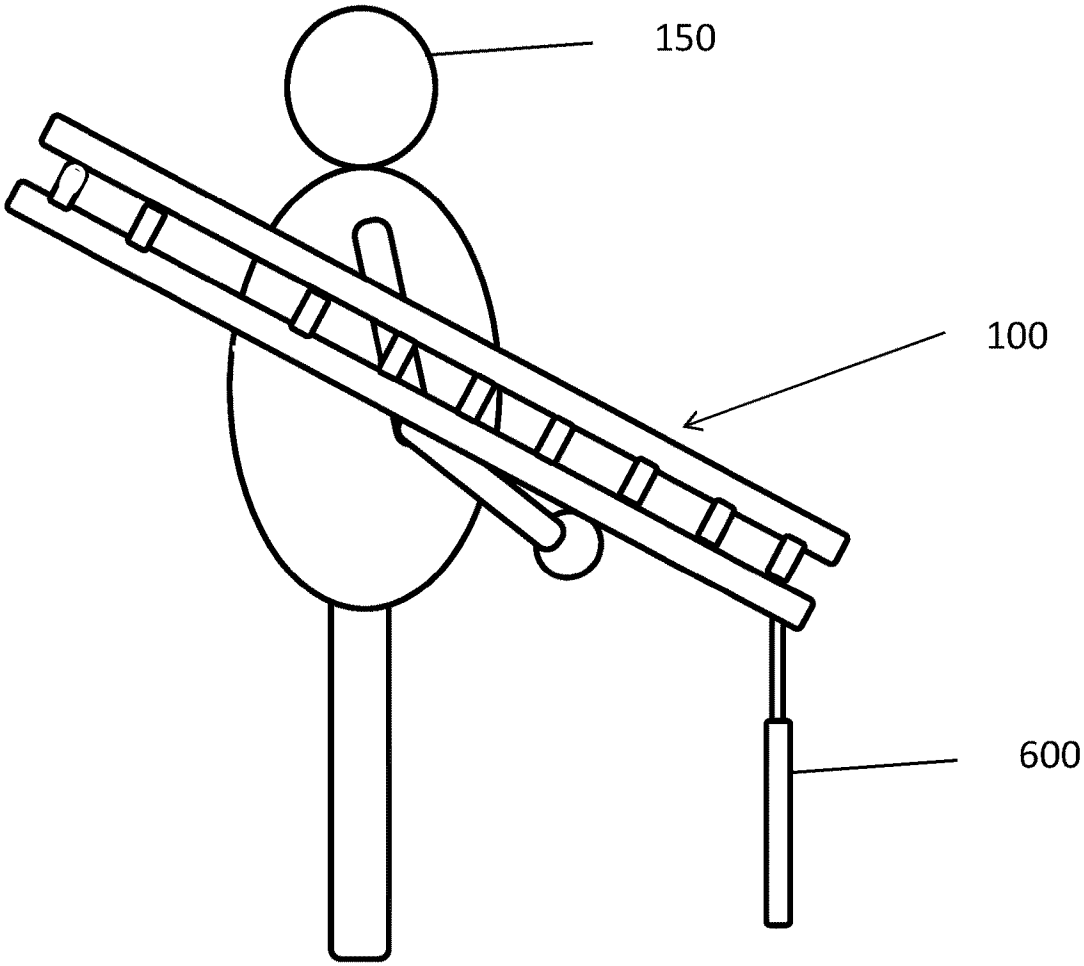
FIG. 53 shows a simplified schematic view of the exercise device in use in another arrangement.
Figure 54:
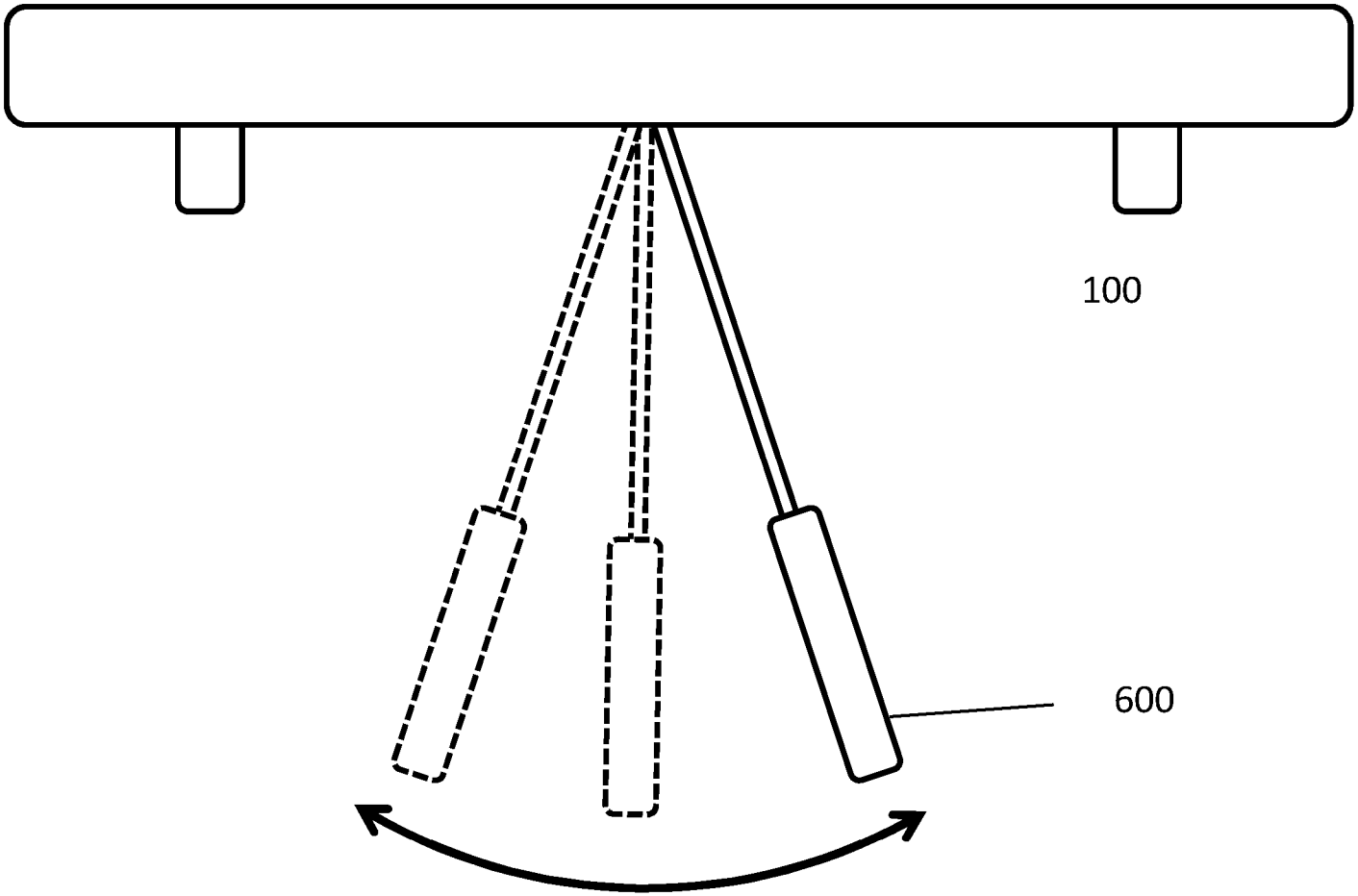
FIG. 54 shows a simplified schematic view of the exercise device in isolation when in use in the arrangement of FIG. 53.

In another example the device may be fitted with a pendulum or swinging member 600 or similar. The pendulum 600 is attached to the frame of the device at one end and is configures to freely swing in at least one plane and preferably is completely free to swing and not restricted to any particular direction. In the example shown in FIG. 53 the pendulum 600 is located at a front, centre point of the device when it is in use, and hangs below the lowest point of the frame. The movement of the device is shown more clearly in FIG. 54, which shows a view from the front of the device. The pendulum is free to swing side to side and will oscillate in response to a user's motion when the device is in use.

Figure 55:
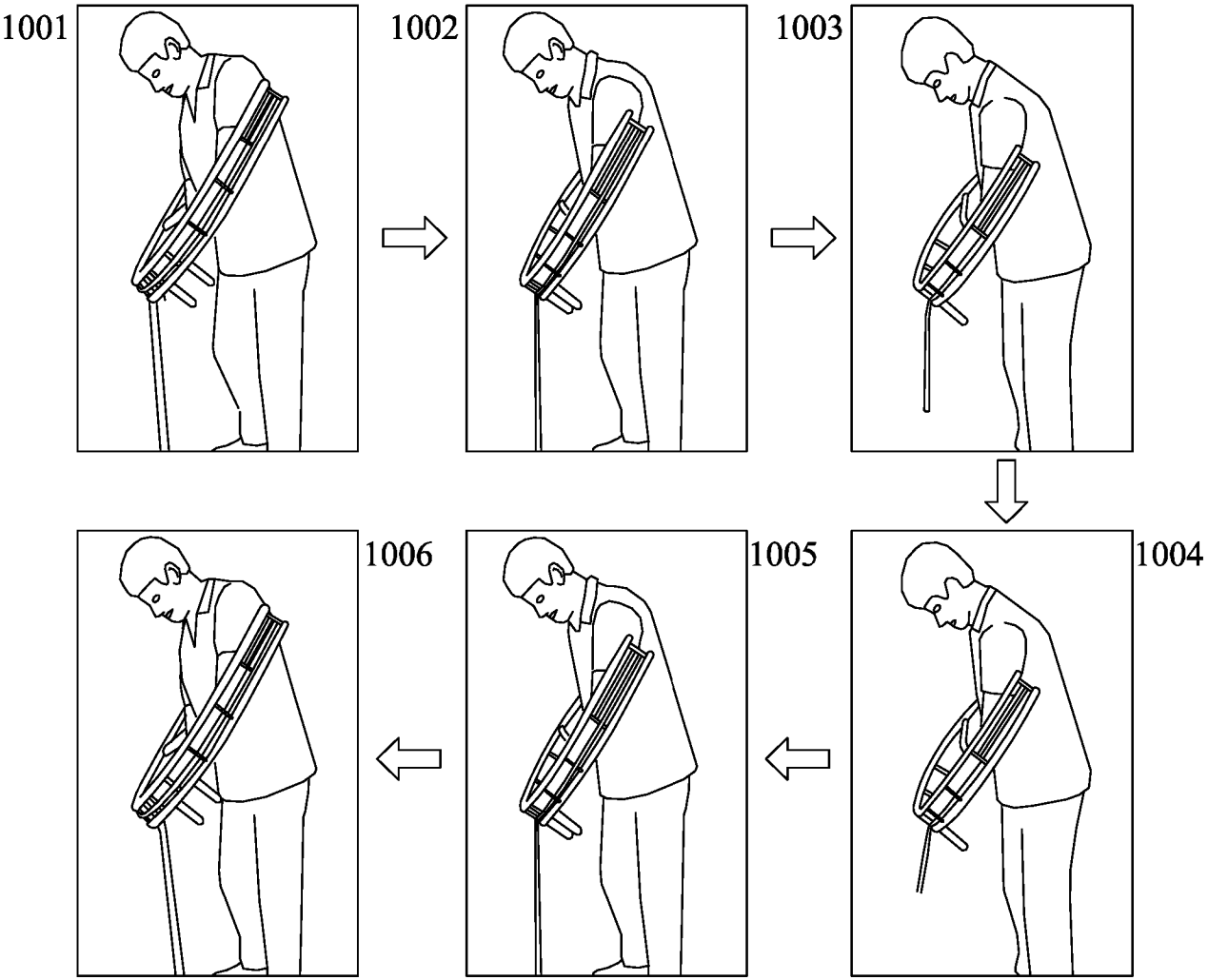
FIG. 55 shows screenshots from a video of the device when used in the arrangement of FIG. 53.

The motion of the pendulum can be controlled by the user of the device when the device is in use. It is envisaged that the user can take a golf-like stance and use the device to improve their golf swing technique. Smooth twist movements from the user will allow for the pendulum to be controlled smoothly and its oscillation to be likewise controlled. Poor, jerky or mistimed technique will result in the oscillation of the pendulum being interrupted. The images provided in FIG. 55 show a device having a pendulum in use. The user can be seen to be in an approximate golf-like stance, with the device held at angle relative to an axis of his body. In image 1001 the user has twisted to the left (that is, his left) and the pendulum likewise swings to the left. The pendulum reaches its maximum displacement to the left and then begins to swing back towards the centre as seen in image 1002, the user twists back towards the centre to control this movement. As the pendulum passes the centre point the user twists to the right and the pendulum reaches its maximum displacement to the right, as shown in image 1003. This motion is then reversed, as the pendulum swings from right to left, as shown in images 1004-1006.

Figure 56:
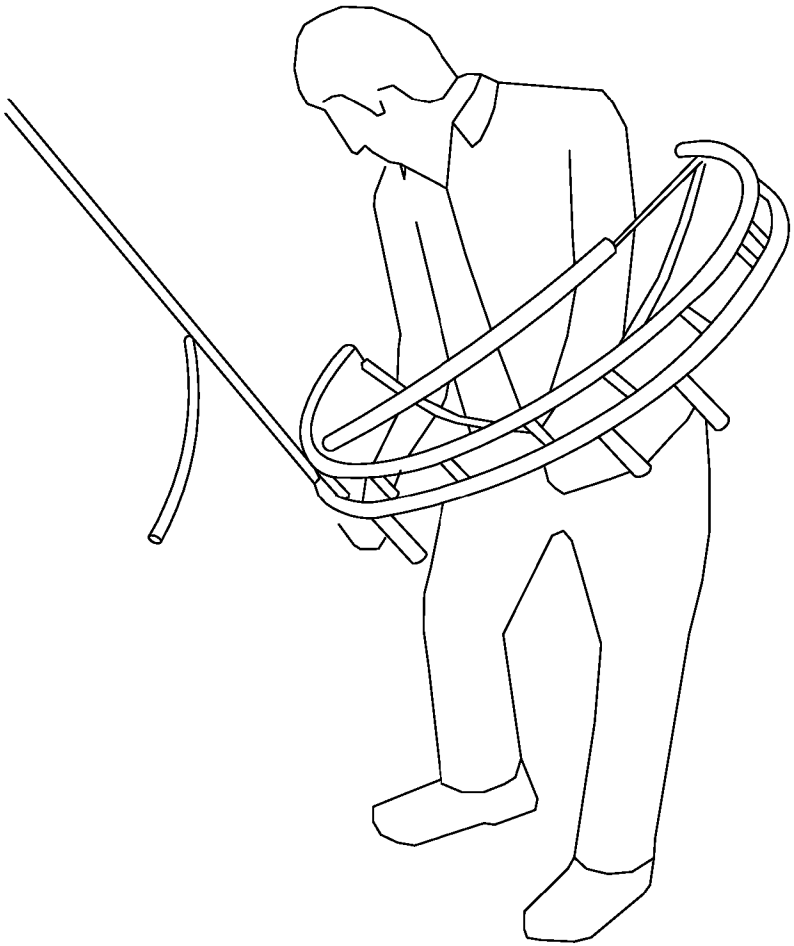
FIG. 56 shows screenshots from a video of the device when used in another arrangement.

The pendulum may be positioned elsewhere and not necessarily on the frame. FIG. 56 provides an example of another arrangement, in which the pendulum is suspended from the resistance member when in use. In this use case the user can use the resistance member to exercise whilst the pendulum provides a cadence for the user to match. In this example, and the previous ones, the pendulum itself may be considered a resistance member. The mass of the resistance member may be configured to provide a weight against which the user can exercise. The pendulum may take a variety of forms, as well as being suspended below the device it is conceivable that a mass on a spring could be used above the plane of the device.

The pendulum may comprise an elongate member. The elongate member may be rigid, or it may be flexible. The elongate member may have a mass at a location, for example its end, remote from where it is affixed to the frame of the device.

Figure 57:
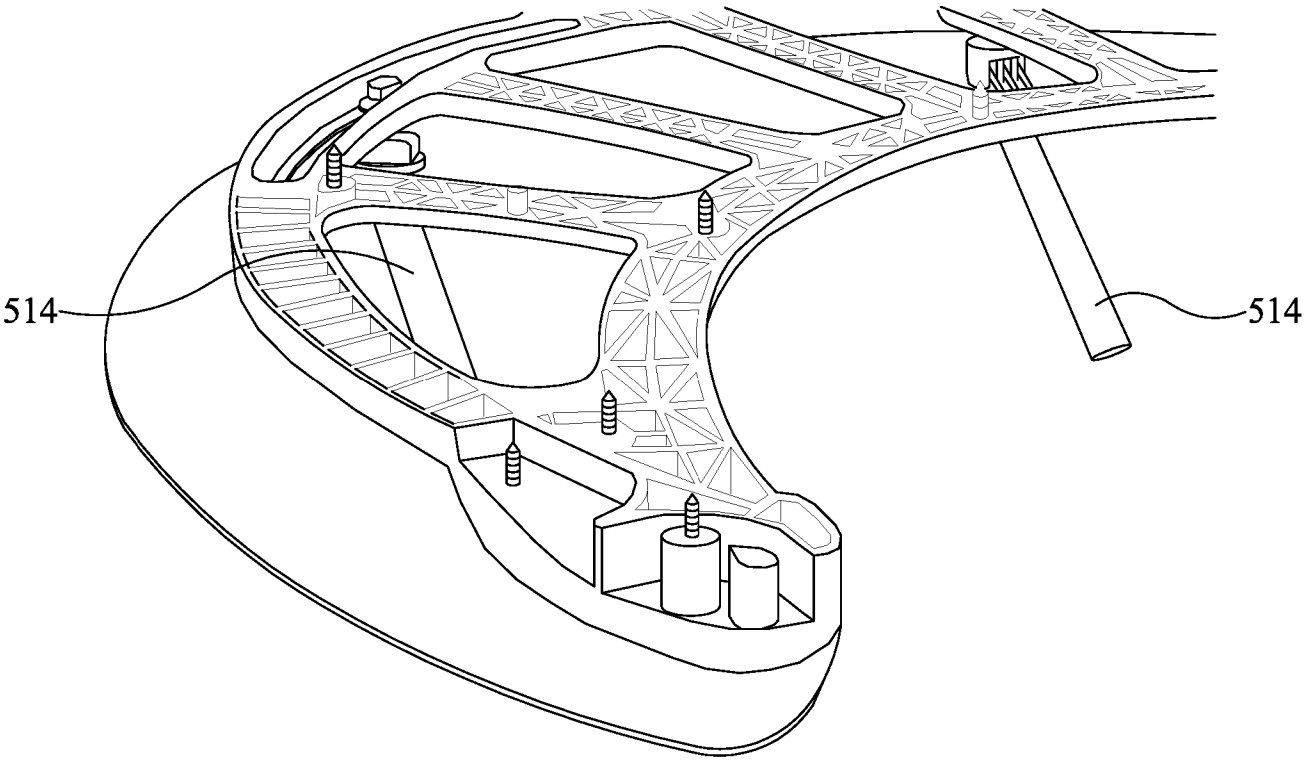
FIG. 57 shows a sectional view through a part of the device.

The construction of the frame of the device is shown in FIG. 57. The top part of the frame has been removed, showing the internal construction. The frame is predominantly hollow, having multiple structural webs and and/or ribs that provide structural rigidity.

FIG. 57 also shows a hinged example of the handles 514. The handles are hinged inwards. This can allow users to vary their grip. In some embodiments, the handles 514 may be angled inwards towards the centre of the device 500 by means of a fixed angled joint between each handle 514 and the frame 510. The hinges also provide a means for collapsing the handles for transport without having to remove them.

Figure 59:
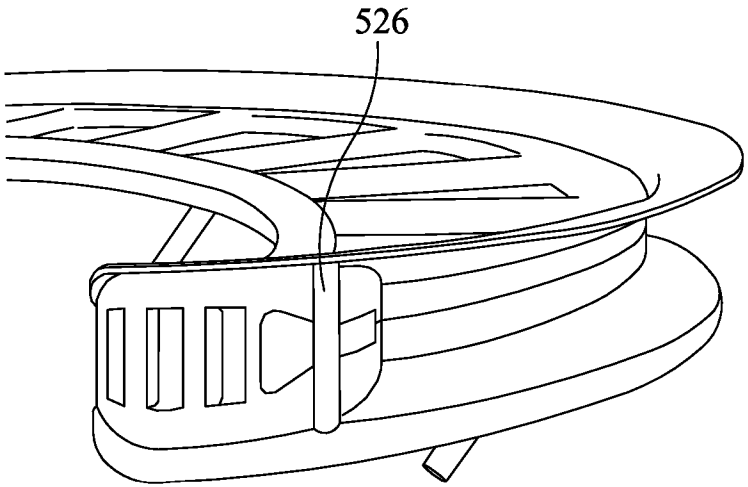
FIG. 59 shows another attachment point of the device.
Figure 58:
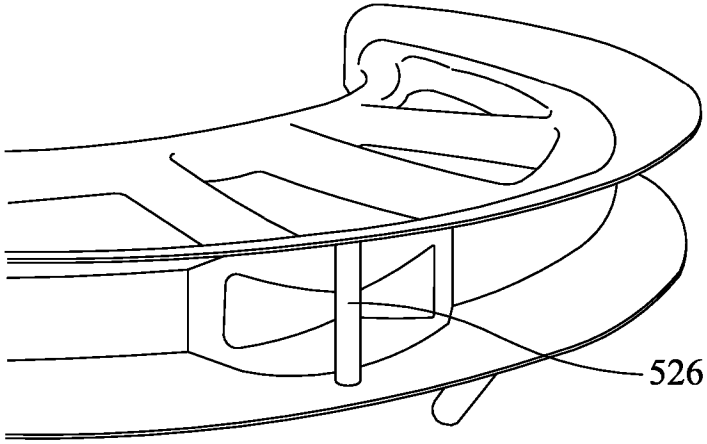
FIG. 58 shows an attachment point of the device.
Figure 60:
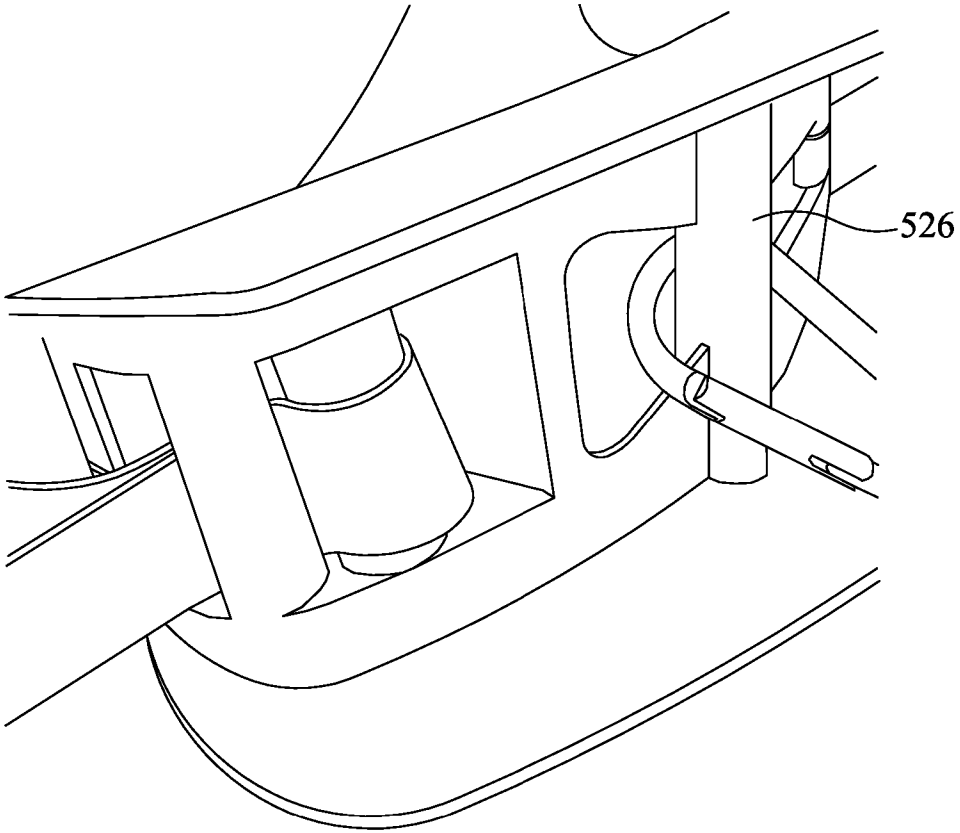
FIG. 60 shows an attachment point of the device with a carabiner attached.

Further detail regarding the resistance member attachment point is shown in FIGS. 58 to 60. FIG. 58 shows an attachment point at a centre point of the frame, situated within the channel. FIG. 59 shows an attachment point proximal to an end point of the frame, also situated within the channel. The attachment point comprises a column in the channel or defining part of the channel around which a clip—such as a carabiner—can be attached, for assembling the device with a resistance member; FIG. 60 shows a carabiner in place on the attachment point. There is a space behind the column into which the carabiner clip can extend so as to surround the column.

Figure 61:
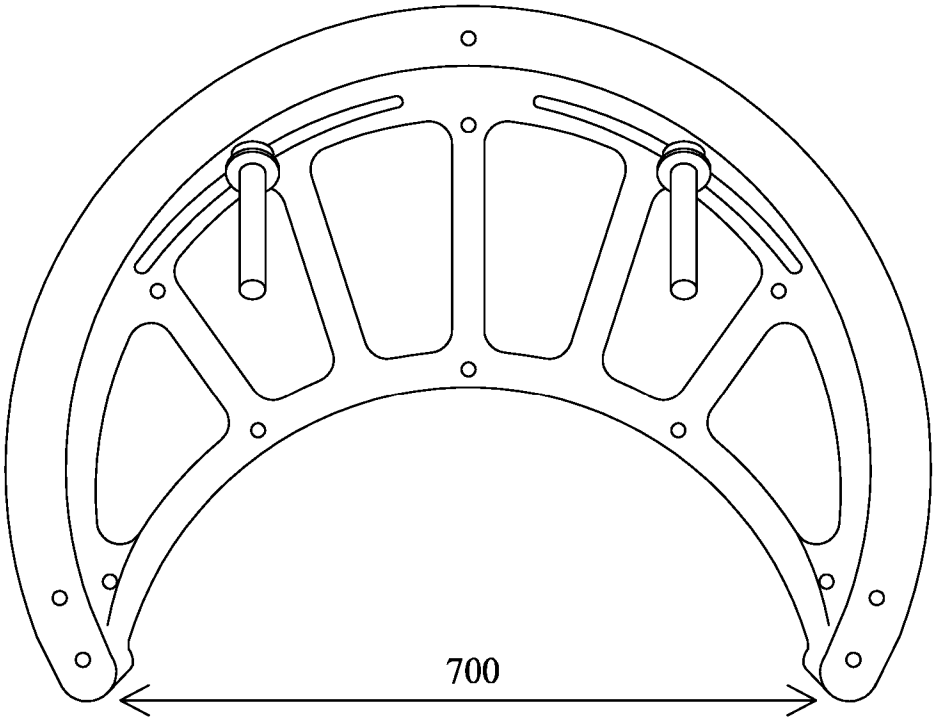
FIG. 61 shows a view from underneath the device.

FIG. 61 shows another variant of the device in which the inner ring or bow and the outer ring or bow have offset centres and in which the opening at the rear, that a user puts their waist/torso into, has a space 700 between the "horns" of the bow of about 61 cm+/−3 cm or +/−5 cm, or +/−7 cm or +/−10 cm.

Figure 62:
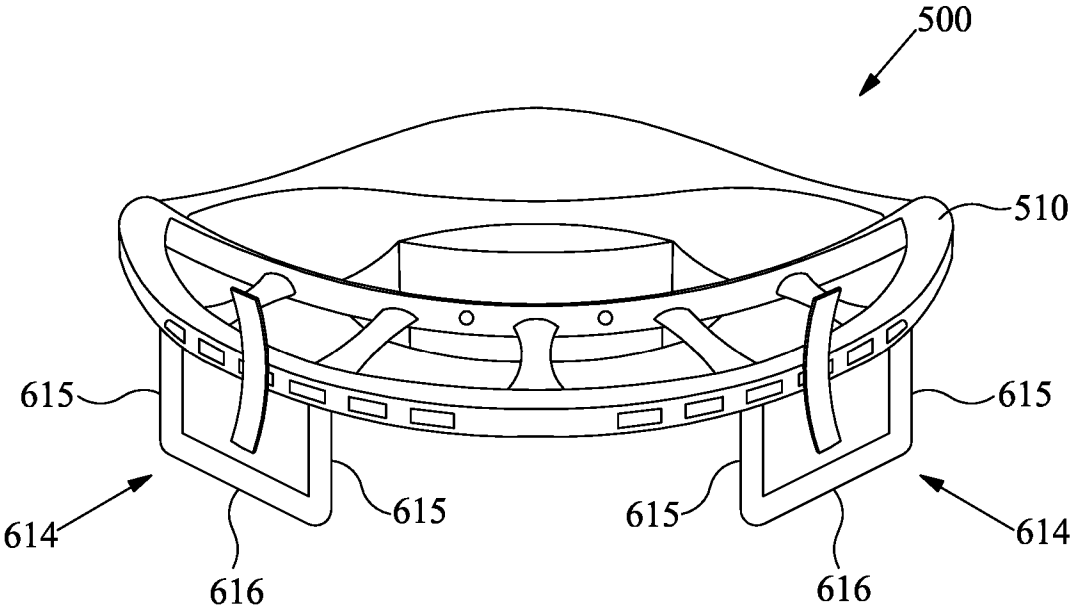
FIG. 62 shows a schematic front view of an exercise device.

FIG. 62 shows another embodiment of the device 500. The handles 614 of the device 500 each comprise two upright sections 615. A first end of each upright section 615 is attached to the frame 510 of the device, for example as described above with reference to other embodiments. Each handle 614 further comprises a transverse section 616 which extends between the upright sections 615. The angle between the transverse section 616 and each of the upright sections 615 is substantially a right angle; however, in other embodiments this angle may be less than or greater than 90 degrees.

In use, a user may grip either upright section 615 of each handle 614, or the transverse section 616 of each handle to vary their grip on the device 500. In the embodiment of FIG. 62, the device 500 comprises two handles 614. In other embodiments, the device 500 may comprise fewer or more than two handles 614. For example, the device 500 may comprise a single handle 614 such that in use, a user grips one of the upright sections 615 with each hand.

In the embodiment of FIG. 62, the each upright section 615 of each handle 614 extends substantially perpendicularly to the plane of the frame 510 of the device. In other embodiments, the each upright section 615 of each handle 614 may extend at an angle of less than or greater than 90 degrees to the plane of the frame 510. For example, each upright section 615 of each handle 614 may be angled inwards towards the centre of the device 500.

The handle 614 of the embodiment of FIG. 62 may be used in place of the or each handle of any other embodiment described herein.

Figure 63:
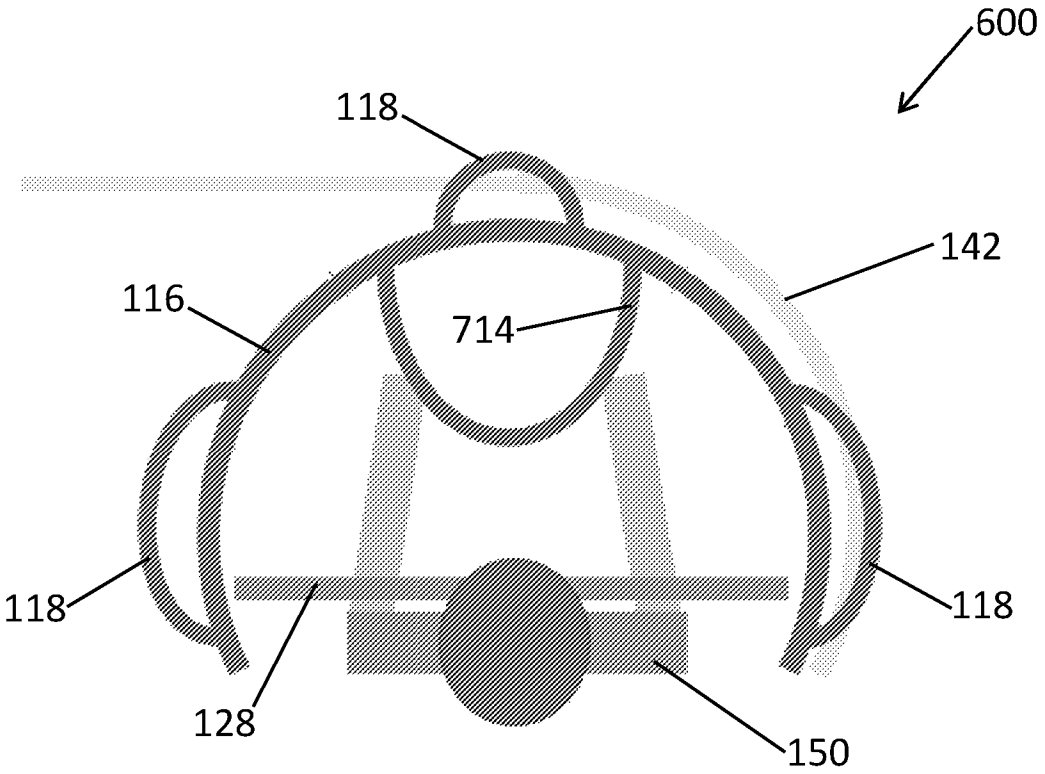
FIG. 63 shows a schematic plan view of an exercise device.

Another example of an exercise device 600 is shown in FIG. 63. The device 600 comprises a first frame section 116 and a plurality of second frame sections 118 mounted to the first frame section 116. In this embodiment, the first and second frame sections 116, 118 are formed from metal. A strap 128 is attached to the first frame section 118 so that the device 600 can be supported by a user 150 in use, as described above with reference to other embodiments. Each of the second frame sections 118 is substantially U-shaped and comprises a semi-. circular body extending from a first end to a second end. The first and second ends are mounted to the first frame member 116 by any suitable means, such as welding.

The device 600 comprises a discontinuous radially outwardly facing channel. Each of the second frame sections 118 comprises part of the channel. Each part of the radially outwardly facing channel is configured to receive a portion of a resistance member 142. In use, a first end of the resistance member 142 is attached to the device 600 and a second end of the resistance member 142 is attached to an external resistance point, as described above with reference to other embodiments. When the resistance member 142 is received in the channel in use, the resistance member 142 forms an arc which is tangential to one or more of the second frame sections 118; FIG. 63 illustrates a use case where the arc of the resistance member 142 is tangential to two of the second frame sections 118.

In the embodiment of FIG. 63, the device 600 comprises three second frame sections 118 spaced equidistantly about the circumference of the first frame section 116. In other embodiments, the device 600 may comprise fewer or more than three second frame sections 118.

The device 600 further comprises a substantially U-shaped handle 714. The handle 714 comprises a semi-circular body extending from a first end to a second end. The first and second ends are mounted to the first frame section 116. The handle 714 provides various grip positions and different points along the length of the body of the handle 714.

Figure 64:
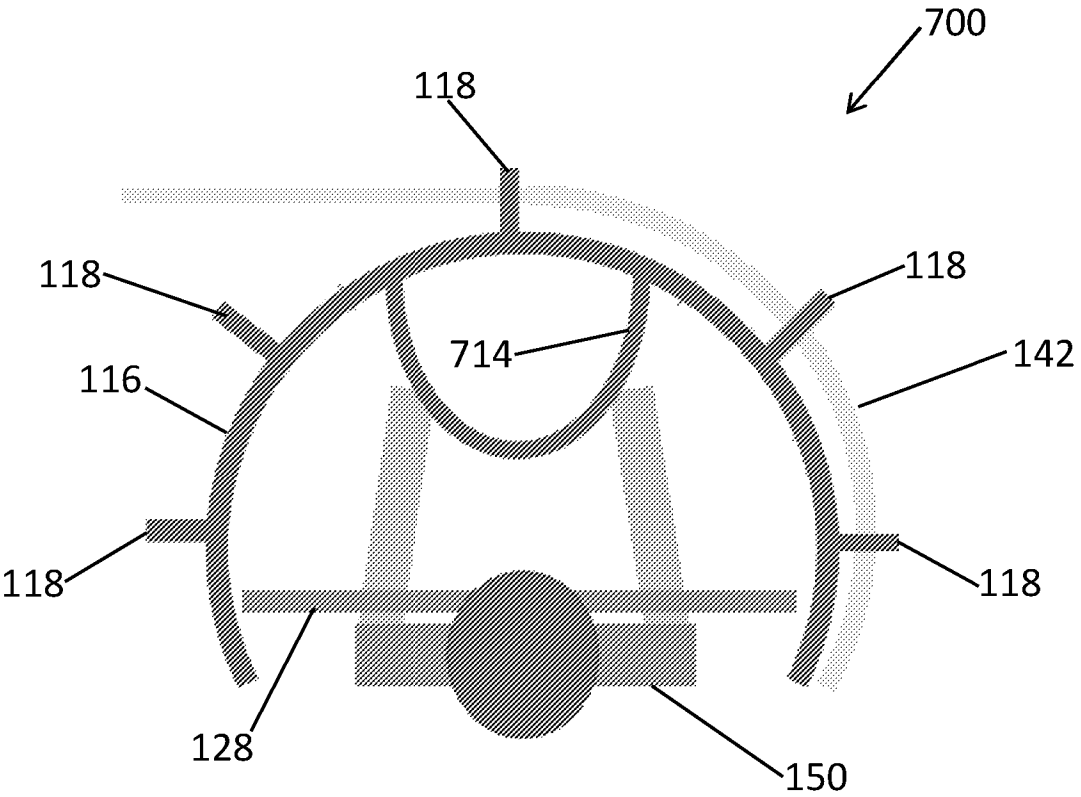
FIG. 64 shows a schematic plan view of an exercise device.

Another example of an exercise device 700 is shown in FIG. 64. The exercise device 700 of FIG. 64 shares features in common with the exercise device 600 of FIG. 63. Like reference numerals are used to refer to like features.

The device 700 of FIG. 64 differs from the exercise device 600 of FIG. 63 in that the second frame members 118 are substantially linear shape. Each of the second frame members 118 comprises a first end and a second end distal from the first end. The first end of each of the second frame members 118 is mounted to the first frame member 116 by any suitable means, such as welding. The second end of each of the second frame members 118 comprises part of the discontinuous radially outwardly facing channel.

Figure 65:
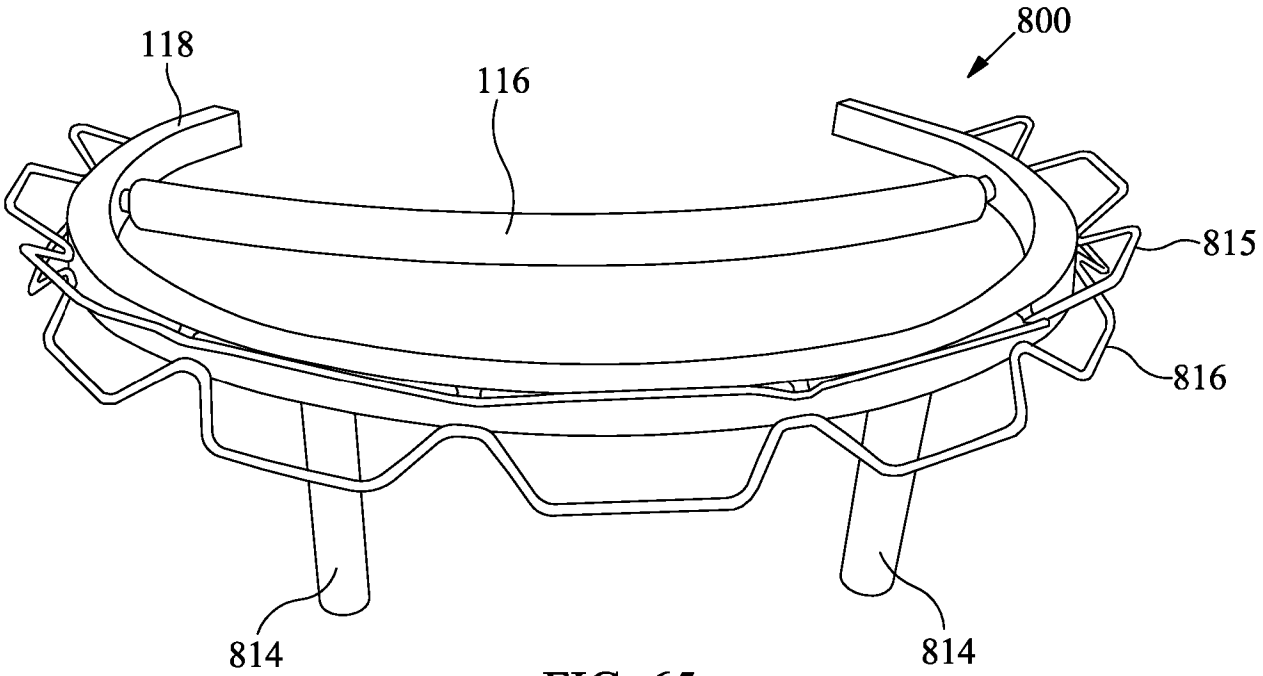
FIG. 65 shows a front view of an exercise device.

Another example of an exercise device 800 is shown in FIGS. 65-70. FIG. 65 shows a front view of the device 800. The device 800 comprises a first frame member 116, a second frame member 118 and two handles 814. The second frame member 118 forms an arc of a nominal circle when viewed in plan. The central angle of the arc is greater than 180 degrees. The first frame member 116 extends across the second frame member 118 between two points spaced from the ends of the second frame member 118. The first frame member may be arcuate or straight. When arcuate, it may have a radius of curvature that is greater than that of the first frame member. In use, a user rests the first frame member 116 against their torso and grips one of the handles 814 in each hand in a similar manner as described above with reference to other embodiments. In the embodiment of FIG. 65, the device 800 comprises padding on the first frame member 116 to provide comfort to a user. In other embodiments the padding may not be present. The padding could be a foam tube, possibly with a longitudinal slit to allow it to be slipped on to the first frame member. The padding/foam tube could be replaceable/removable and replaceable, possibly for when it becomes worn.

The device 800 further comprises an upper rail 815 and a lower rail 816. The rails may form upper and lower lips of a discontinuous (or reduced depth) channel in which in use a cable, resilient rope or band or other or other resistance member is retained or held as the user twists their torso. The rails may provide a castellated series of projections and lands between the projections. The castellations of the upper and lower rail form radially outwardly flaring grooves or valleys in which the resistance member is received.

The resistance member may be a bungee cable or the like, for example an elastic resistance band that exerts progressively more resistance as it is stretched, or an inelastic cable such as a metal cable or the like.

Figure 66:
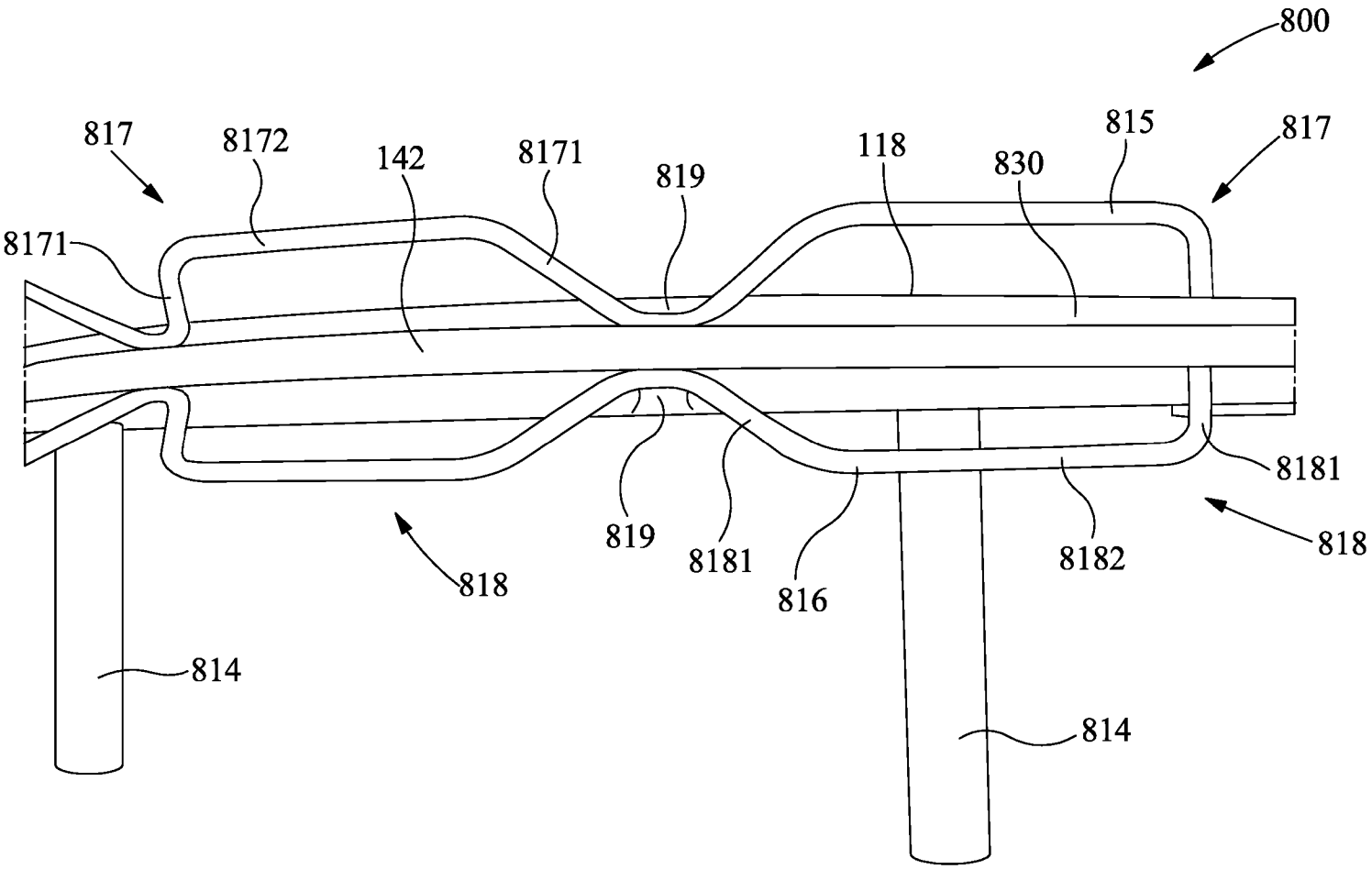
FIG. 66 shows a close-up view of a portion of the device of FIG. 65.

FIG. 66 shows a close-up view of a portion of the device 800. The upper rail 815 comprises a plurality of sections 817 arranged over the circumference of the second frame member 118. Each section 817 comprises two first portions 8171 spaced apart from one another about the circumference of the second frame member 118. Each first portion 8171 extends away from the second frame member 118 and extends at an acute angle to the plane of the circumference of the second frame member 118. The first portions 8171 are also angled towards each other. Each section 817 further comprises a second portion 8172 extending between the ends of the first portions 8171 distal from the second frame member 118. The lower rail 816 also comprises a plurality of sections 818 each comprising two first portions 8181 and a second portion 8182. The sections 818 of the lower rail 816 are arranged in the same manner as the sections 817 of the upper rail 815, but such that the first portions 8181 of the sections 818 of the lower rail 816 extend away from the first portions 8171 of the sections 817 of the upper rail 815. The upper and lower rails 815, 816 are arranged such that, in use, the first portions 8171 of each the section 817 of the upper rail 815 are angled away from the ground, and the first portions 8181 of each the section 818 of the lower rail 816 are angled towards the ground.

The upper rail 815 is coupled to the second frame member 118 at the apex of the adjacent first portions 8171 of adjacent sections 817 of the upper rail 815 by a joint 819, such that the upper rail 815 protrudes from the second frame member 118 in a direction parallel to the plane of the second frame member 118. The lower rail 826 is coupled to the second frame member 118 in the same manner. The joints 819 may be any suitable joint, such as a weld joint. The joints 819 of the upper and lower rails 815, 816 are aligned with the same point along the circumference of the second frame member 118. The joints 819 of the upper and lower rails 815, 816 are spaced apart from each other in a direction perpendicular to the plane of the second frame member 118 to form a discontinuous (or periodically reduced depth) channel 830 extending about the circumference of the second frame member 118. The channel 830 is configured to receive a resistance member. FIG. 66 shows a resistance member 142 received within the channel 830. In use, the first and second portions 8171, 8172 of the upper rail 815 and the first and second portions 8181, 8182 of the lower rail 816 urge the resistance member 142 into the channel, thereby inhibiting the resistance member 142 from being dislodged from the channel 830. The rails may be inclined at an angle to the central plane of the frame so as to subtend an angle of 35-70 degrees between them, or 45-60 degrees.

Figure 67:
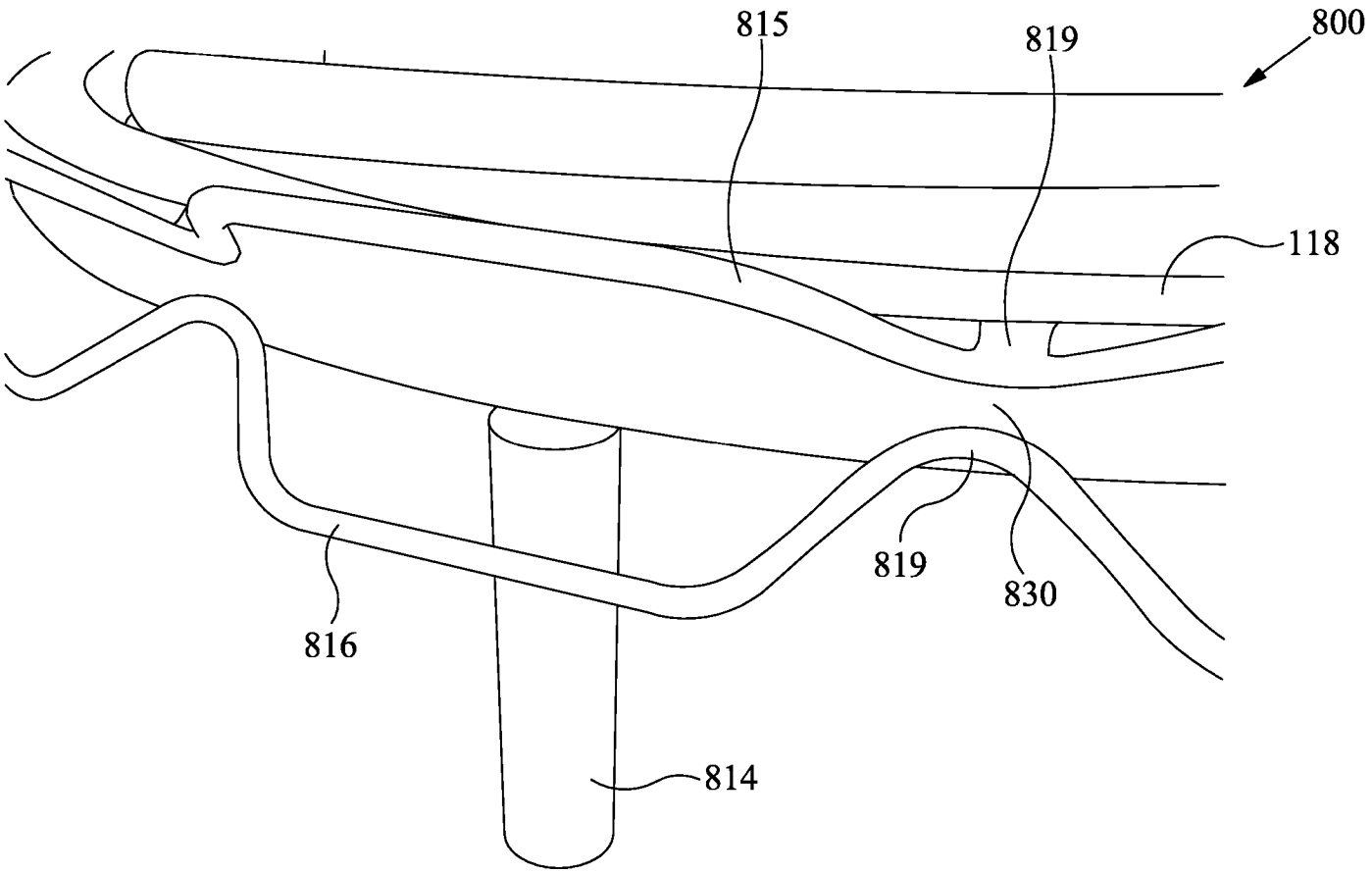
FIG. 67 shows a further close-up view of a portion of the device of FIG. 65.
Figure 68:
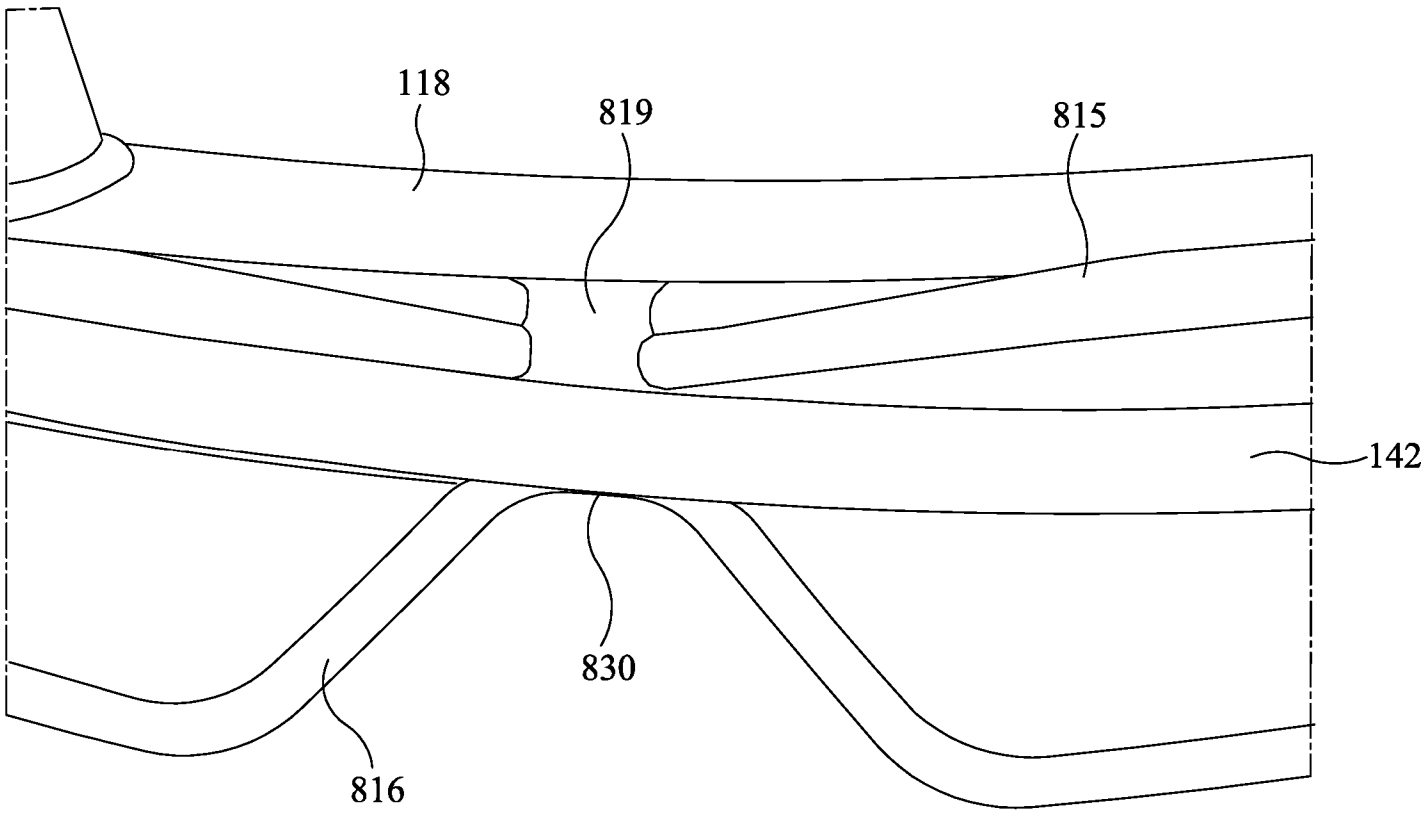
FIG. 68 shows a further close-up view of a portion of the device of FIG. 65.

FIGS. 67 and 68 each show a further close-up view of the device 800, showing how the joints 819 form the channel 830. FIG. 67 shows the device 800 without a resistance member received within the channel 830 and FIG. 68 shows the device 800 with a resistance member 142 received within the channel 830.

Figure 69:
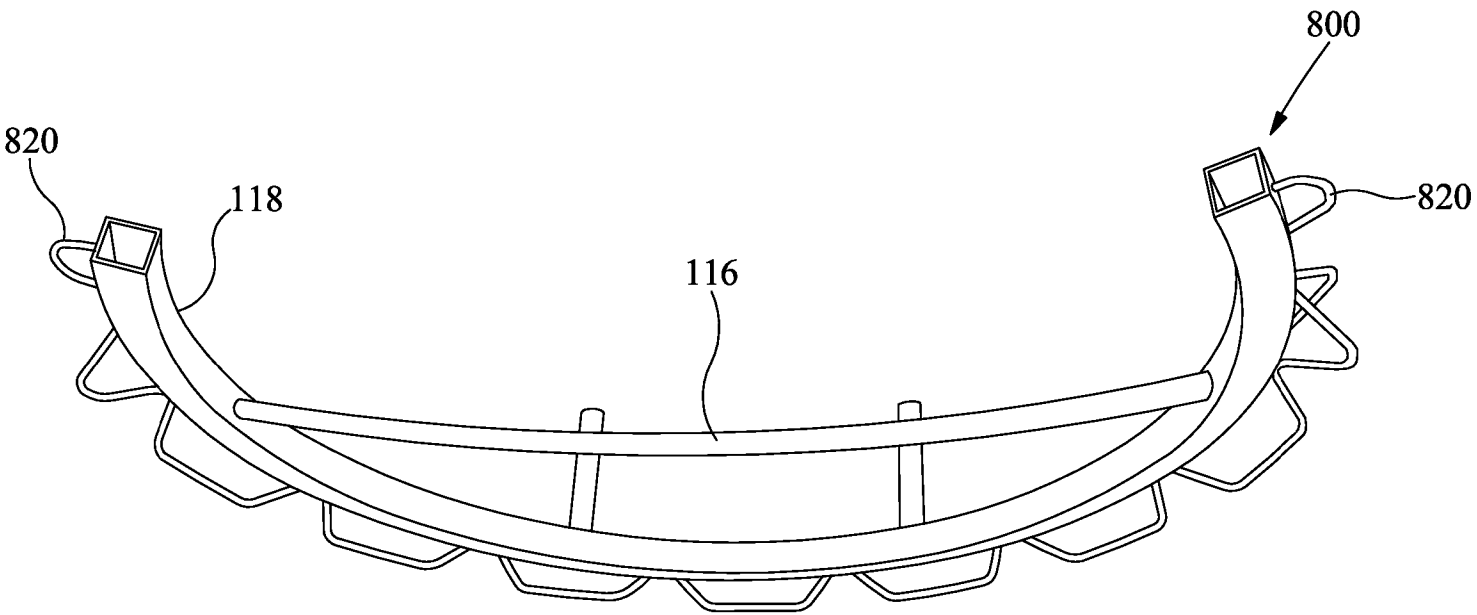
FIG. 69 shows a rear view of the device of FIG. 65.

FIG. 69 shows a rear view of the device 800. In this embodiment, the device 800 is formed as a hollow box section of a suitable metal, such as steel, stainless steel or aluminium. The second frame member 118 may be formed by bending a straight box section of metal into the desired shape. The device 800 comprises an attachment point 820 for attaching an end of a resistance member to the device 800 in a similar manner as described above with reference to other embodiments. The rails may be welded to the frame member.

Figure 70:
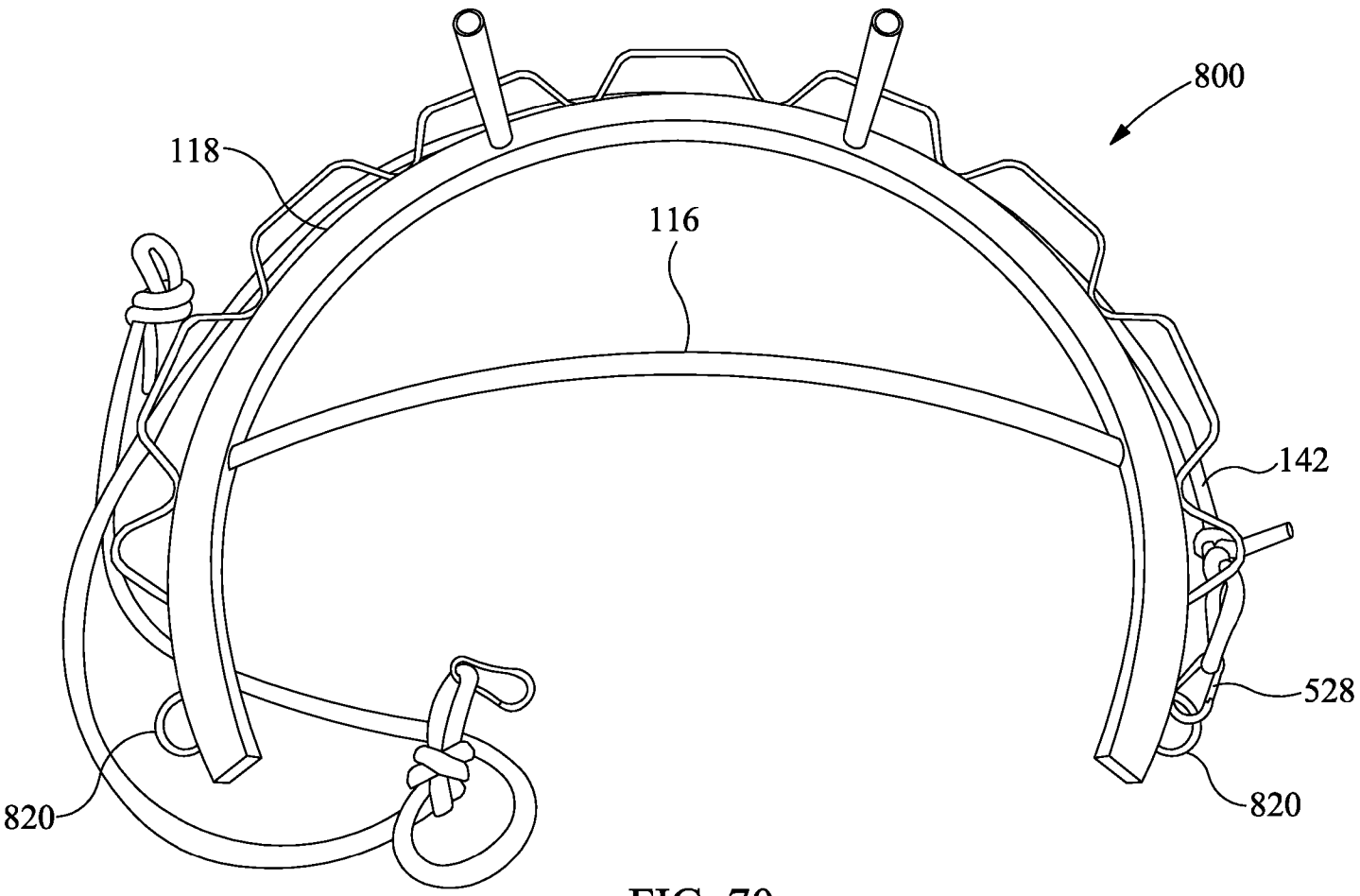
FIG. 70 shows a plan view of the device of FIG. 65.

FIG. 70 shows a plan view of the device 800 as viewed in a direction from the lower rail 816 towards the upper rail 815. FIG. 70 shows a resistance member 142 attached to one of the attachment points 820, by means of a carabiner 528, and received within the channel 830.

The rails of the embodiments shown may be continuous pieces of material (eg metal rod) attached to the frame of the device at spaced apart regions.

The rails may be welded to the outside surface of the frame, as shown in FIG. 67. Also as shown in FIG. 67 the welding "blob" of metal used to weld the rail to the frame may be disposes on the side of the rail away from the channel that is to receive the cable/resistance member. This can leave the interior surfaces of the rails that face the channel and form the channel free of weld material, leaving a smoother channel.

The radially outwardly facing wall of the frame that part-defines the channel and that in use contacts and receives the resistance member may have a concave curvature so as to assist in positioning/holding the resistance member. That concave curve may be formed naturally by the act of bending rectangular hollow section tube to form the curved frame. The flat metal wall on the outside of a bent hollow rectangular cross section metal (e.g. steel) tube may naturally have an outwardly facing concave curve or camber on the outer "flat" face.

Figure 71:
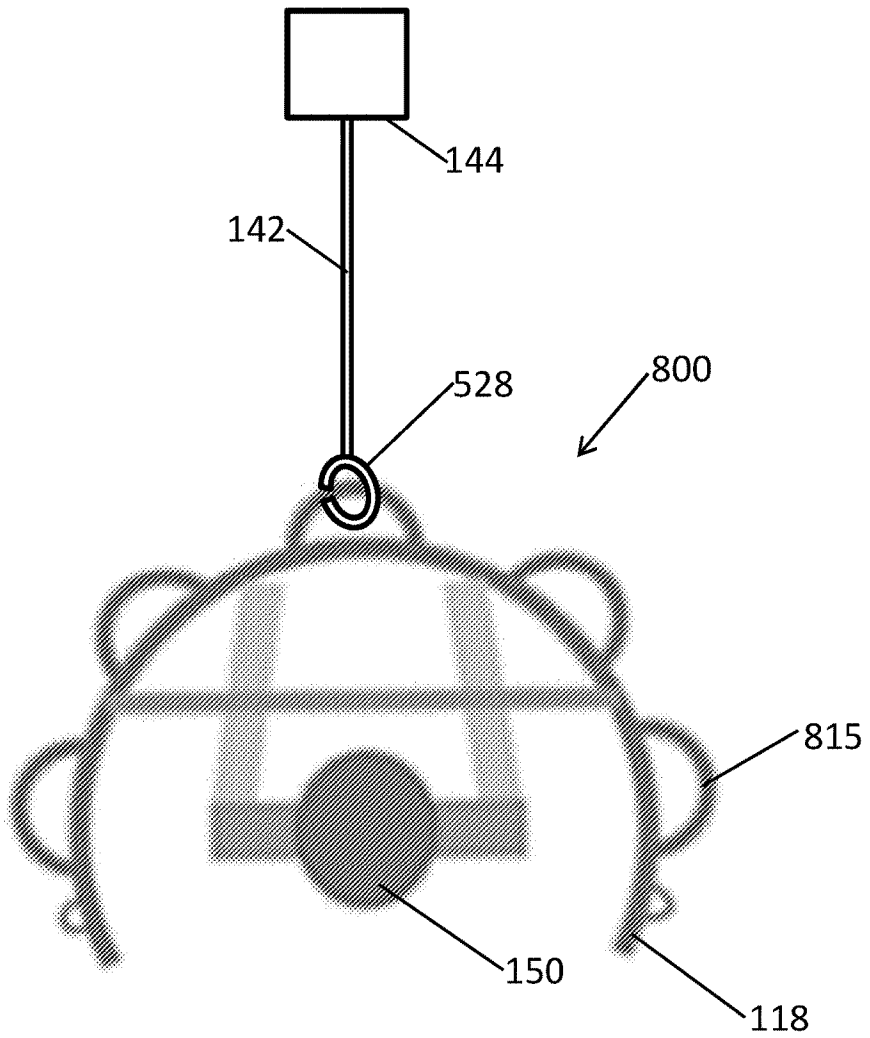
FIG. 71 shows a schematic plan view of the exercise device of FIG. 65.
Figure 72:
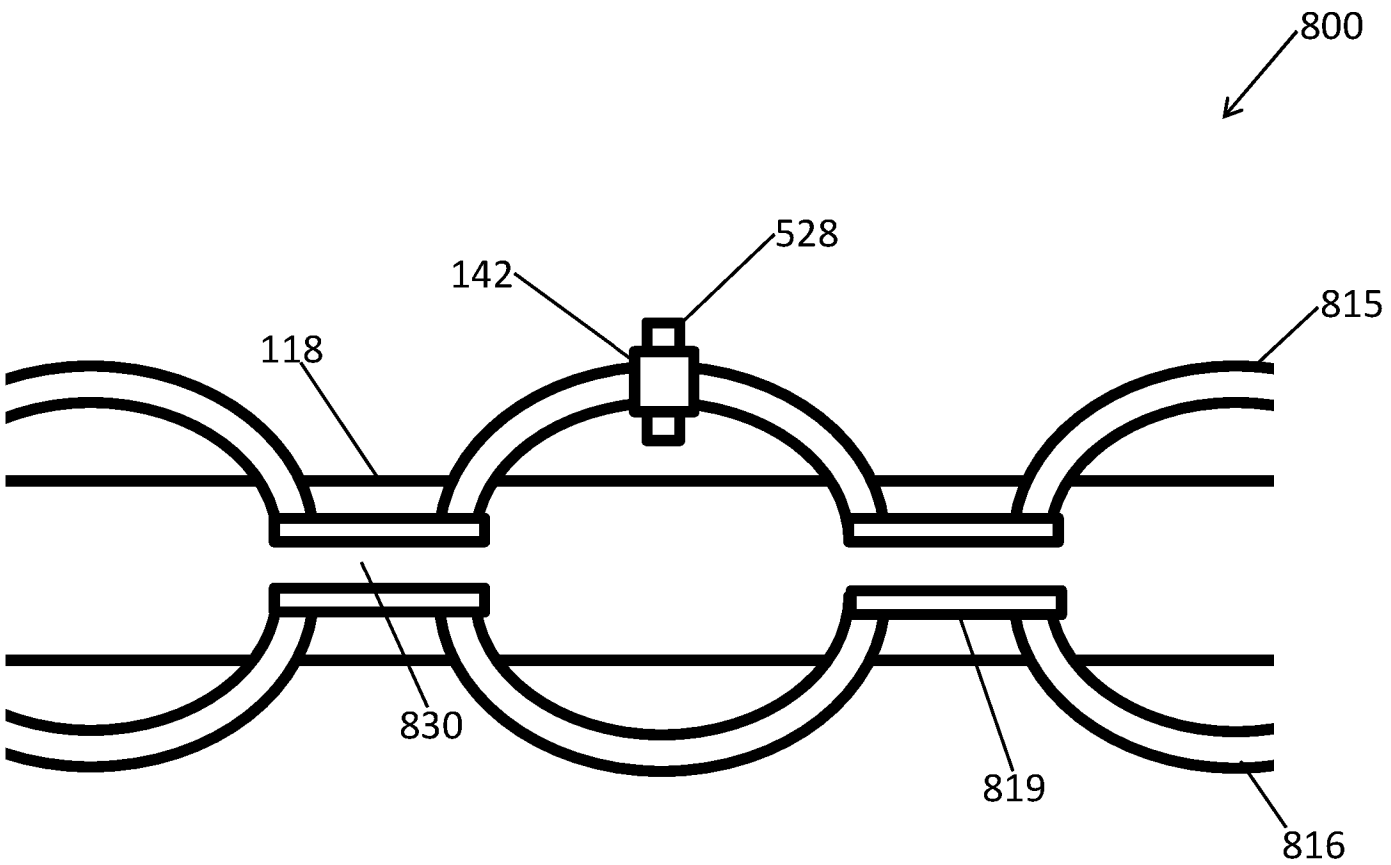
FIG. 72 shows a schematic front view of a portion of the exercise device of FIG. 65.

FIG. 71 shows a schematic plan view of the device 800 of FIGS. 65 to 70 being used by a user 150. The user 150 holds the device 800 in a similar manner as described with reference to other embodiments of the invention. FIG. 71 shows a first end of a resistance member 142 attached to a section of the upper rail 815 by means of a carabiner 528. In the configuration shown in FIG. 71, the first end of the resistance member 142 is attached to a section of the upper rail 815 which is substantially directly in front of the user 150. A second end of the resistance member 142, opposite the first end, is attached to an external resistance point 144. FIG. 71 shows the user 150 adopting a first position with respect to the external resistance point 144. In the first position, the external resistance point 144 is substantially directly in front of the user 150. As such, the carabiner 528 is located in the centre of the section of the upper rail 815 and the resistance member 142 extends straight out in front of the user. FIG. 72 shows a schematic front view of a portion of the device 800 in the configuration shown in FIG. 71.

Figure 73:
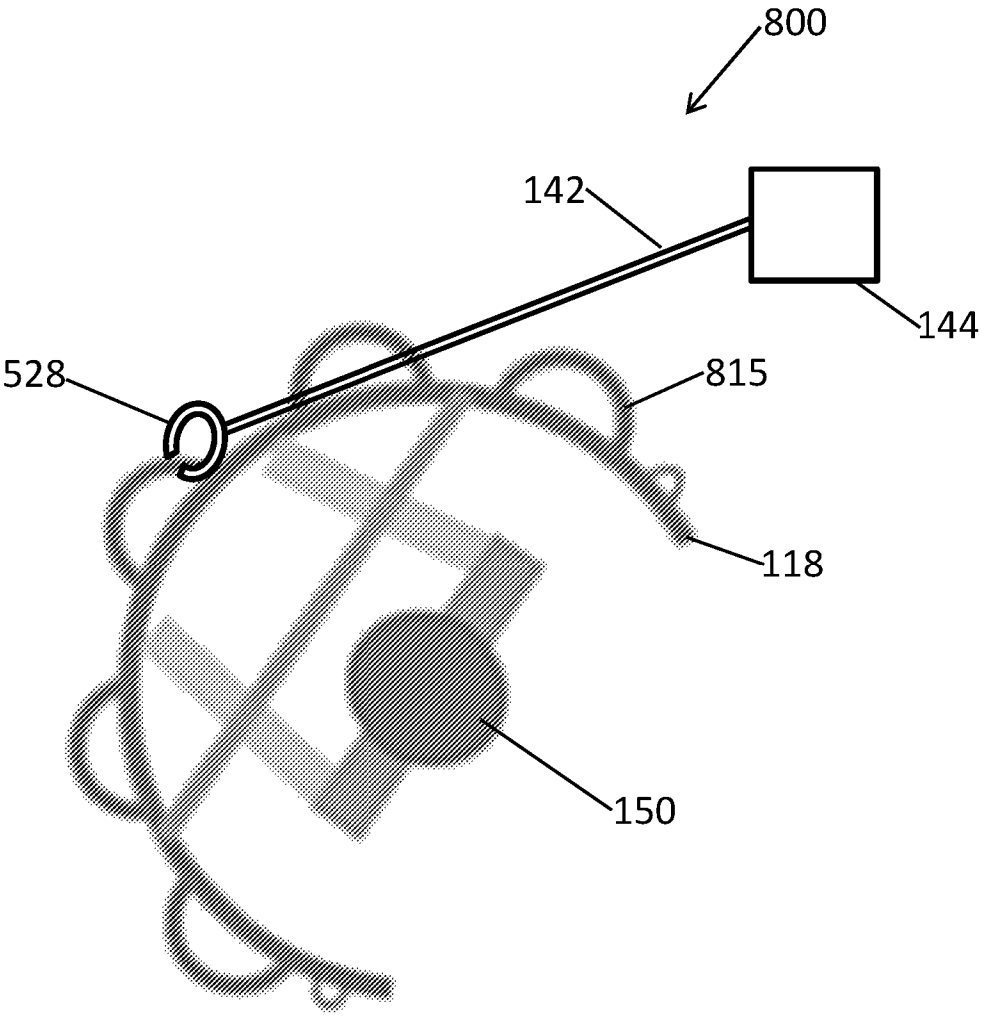
FIG. 73 shows the same view as FIG. 71 with the exercise device in a different position.
Figure 74:
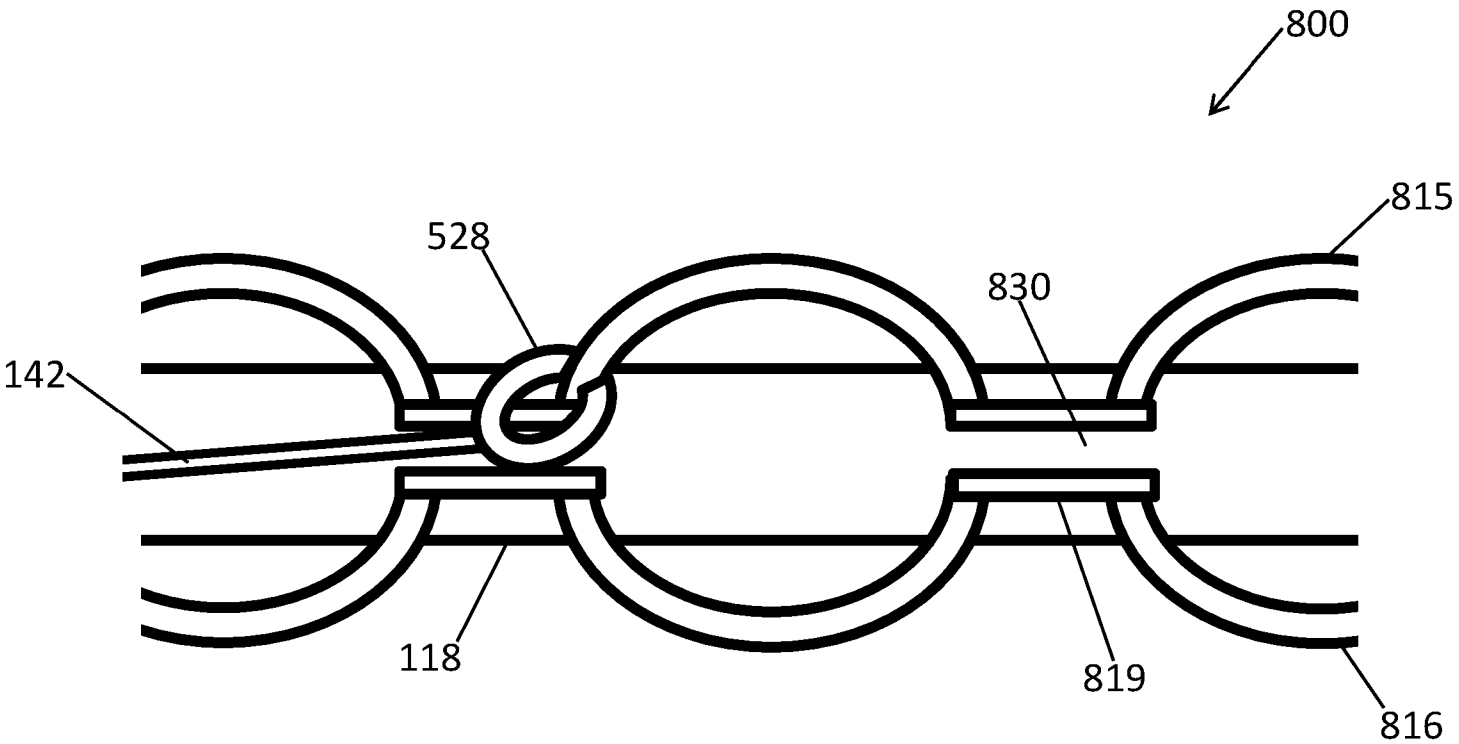
FIG. 74 shows a schematic front view of a portion of the exercise device of FIG. 65 in the configuration shown in FIG. 73.

FIG. 73 shows the same view as FIG. 71, but with the user 150 adopting a second position relative to the external resistance point 144. In this position, the resistance member 142 exerts a clockwise torque on the device 800 and the user 150 resists this torque as a means of exercise, as described with reference to other embodiments of the invention. As the user 150 moves from the first position to the second position, the carabiner 528 slides along the section of the upper rail 815 until it reaches the end of the section of the upper rail 815 closest to the external resistance point 144. Due to the angle of the upper rail 815 relative to the plane of the circumference of the second frame member 118, this sliding of the carabiner 528 causes the resistance member 142 to extend through a gap between the section of the upper rail 815 and an adjacent section of the upper rail 815, and become received within the channel 830. FIG. 74 shows a schematic front view of a portion of the device 800 in the configuration shown in FIG. 73.

Figure 75:
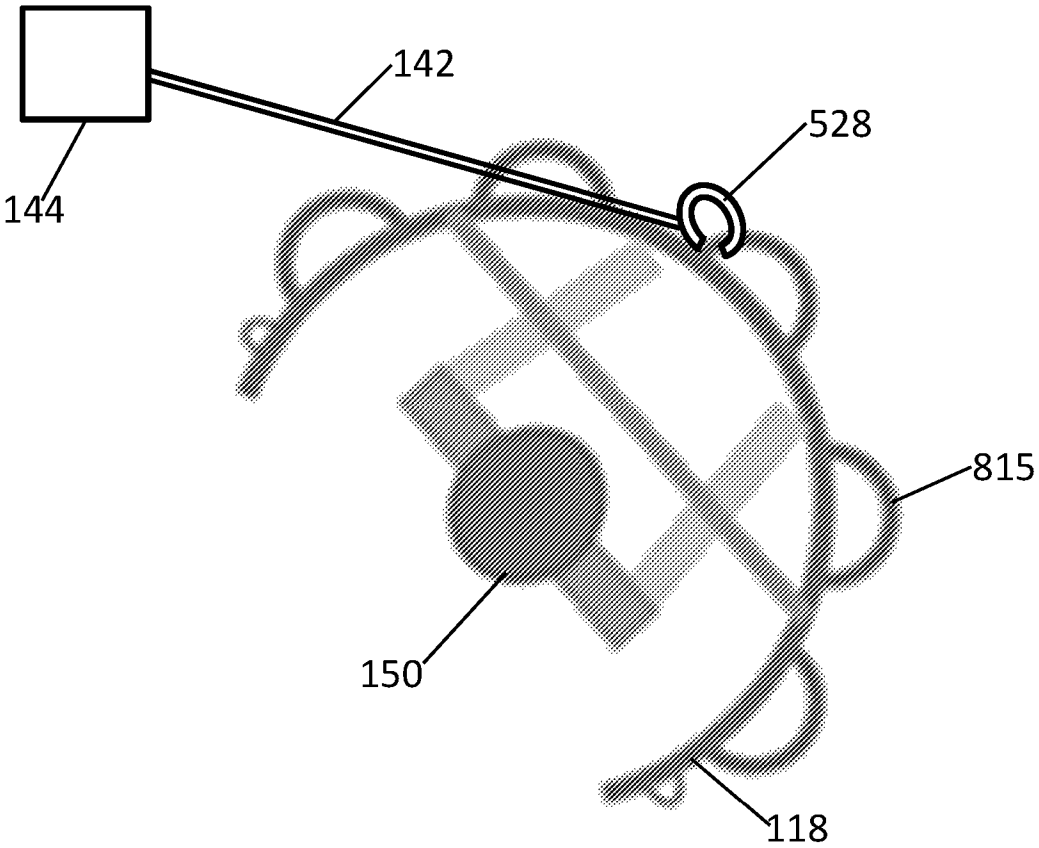
FIG. 75 shows the same view as FIG. 71 with the exercise device in a different position.
Figure 76:
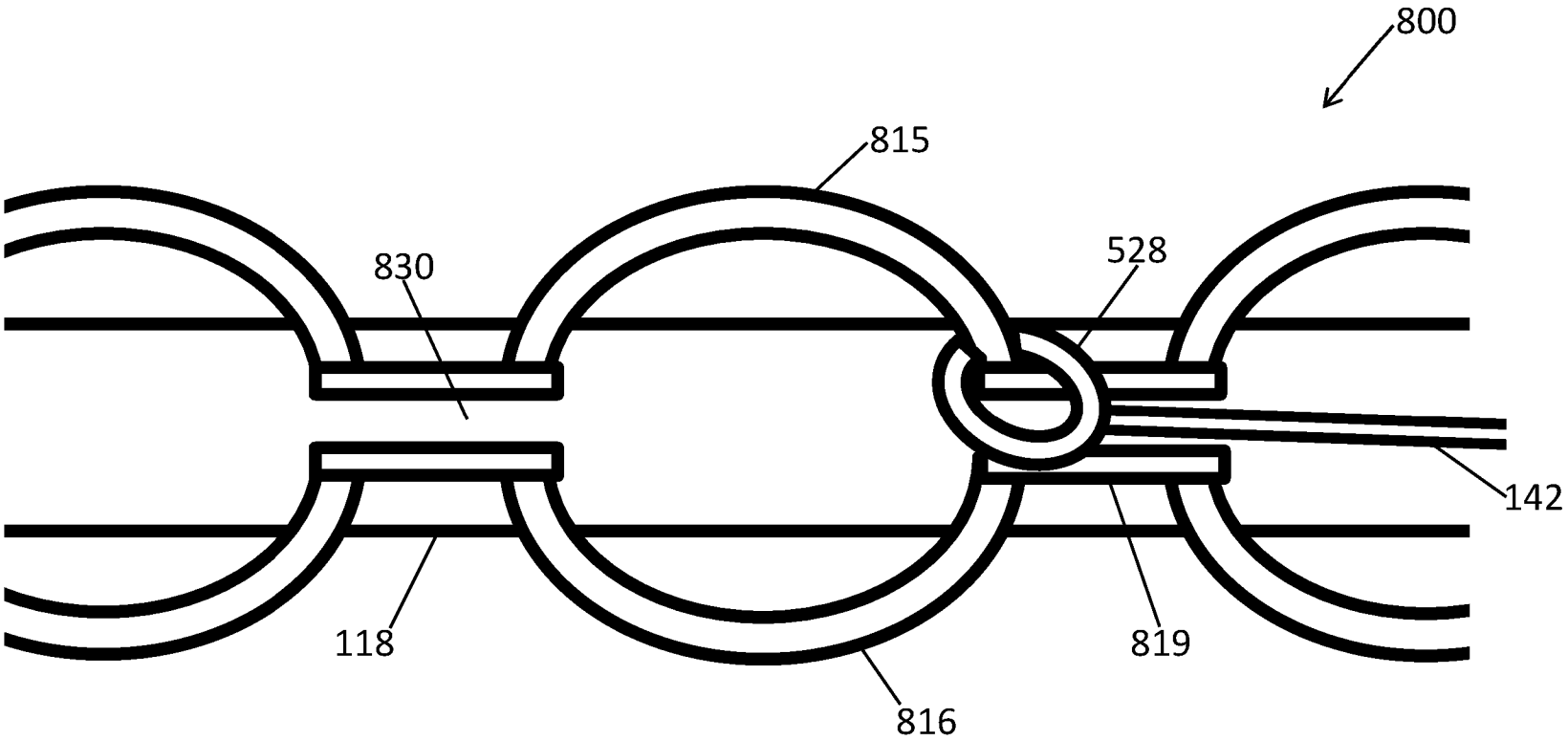
FIG. 76 shows a schematic front view of a portion of the exercise device of FIG. 65 in the configuration shown in FIG. 75.

FIG. 75 shows the same view as FIG. 71, but with the user 150 adopting a third position relative to the external resistance point 144. In this position, the resistance member 142 exerts an anti-clockwise torque on the device 800 and the user 150 resists this torque as a means of exercise, as described with reference to other embodiments of the invention. The user 150 may move from the second position to the third position. As the user 150 does so, the carabiner 528 will slide from one end of the section of the upper rail 815 to the centre of the section of the upper rail 815, and from the centre of the section of the upper rail 815 to the other end of the section of the upper rail 815. Due to the angle of the upper rail 815 relative to the plane of the circumference of the second frame member 118, this will cause the resistance member 142 to lift out of the channel 830 as the carabiner 528 slides to the centre of the section of the upper rail 815, and back in to the channel 830 as the carabiner 528 slides to the other end of the section of the upper rail 815. FIG. 76 shows a schematic front view of a portion of the device 800 in the configuration shown in FIG. 75.

The arrangement of FIGS. 71 to 76 allows the user to transition between performing exercises with a clockwise torque exerted on the device 800 to performing exercises with an anti-clockwise torque exerted on the device 800 without having to detach and reattach the carabiner 528. The user 150 is simply required to change their position relative to the external resistance point 144. In addition, the sliding movement of the carabiner 528 along the section of the upper rail 815 as the user 150 changes position encourages the resistance member 142 in and out of the channel 830, reducing or removing the effort required of the user 150 to ensure the resistance member 142 is properly received in the channel 830 before exercising.

The castellated/intermittent/interrupted projections nature of the upper and lower rails, with projecting sections that are spaced from the frame member, and "gap" sections that are close to the frame member allows for gaps (viewed from above) between projection portions of the rails, and the resistance member can naturally use the gaps to feed into the groove defined by the upper and lower rails. By sliding to one end or the other, in use, of a castellated pair of upper and lower rail sections the resistance member is automatically placed adjacent the gaps in use at the point where it is connected to the selected rails. This makes threading the resistance member into the channel defined by the upper and lower rails easy for a user.

It will be appreciated that in other embodiments, the resistance member 142 may be attached to a different section of the upper rail 815, or to a section of the lower rail 816. A user may attach the resistance member 142 to any section of the upper or lower rails 815, 816 as appropriate.

Figure 77:
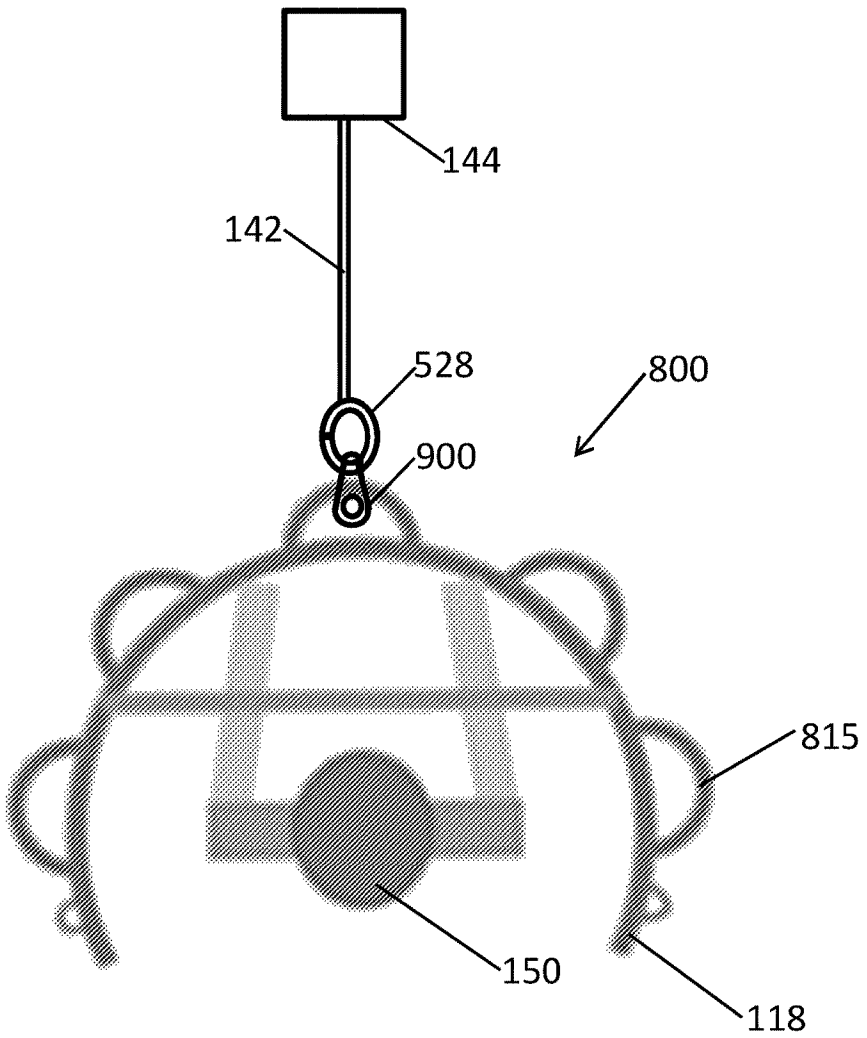
FIG. 77 shows a schematic plan view of another embodiment of the device of FIG. 65.

FIG. 77 shows a schematic plan view of another embodiment of the device 800. In this embodiment, the device comprises a pulley 900. A carabiner 528 (or other coupling for a resistance member) is attached to the pulley 900 and a resistance member 142, and the pulley 900 is attached to a section of the upper rail 815. In other embodiments, the pulley 900 may be attached to a different section of the upper rail 815 or to a section of the lower rail 816. The pulley 900 is releasably attachable to any section of the upper or lower rails 815, 816 to enable a user of the device 800 to alter the position of the pulley 900.

In another variant the resistance member may be attached directly to one of the rails.

Figure 78:
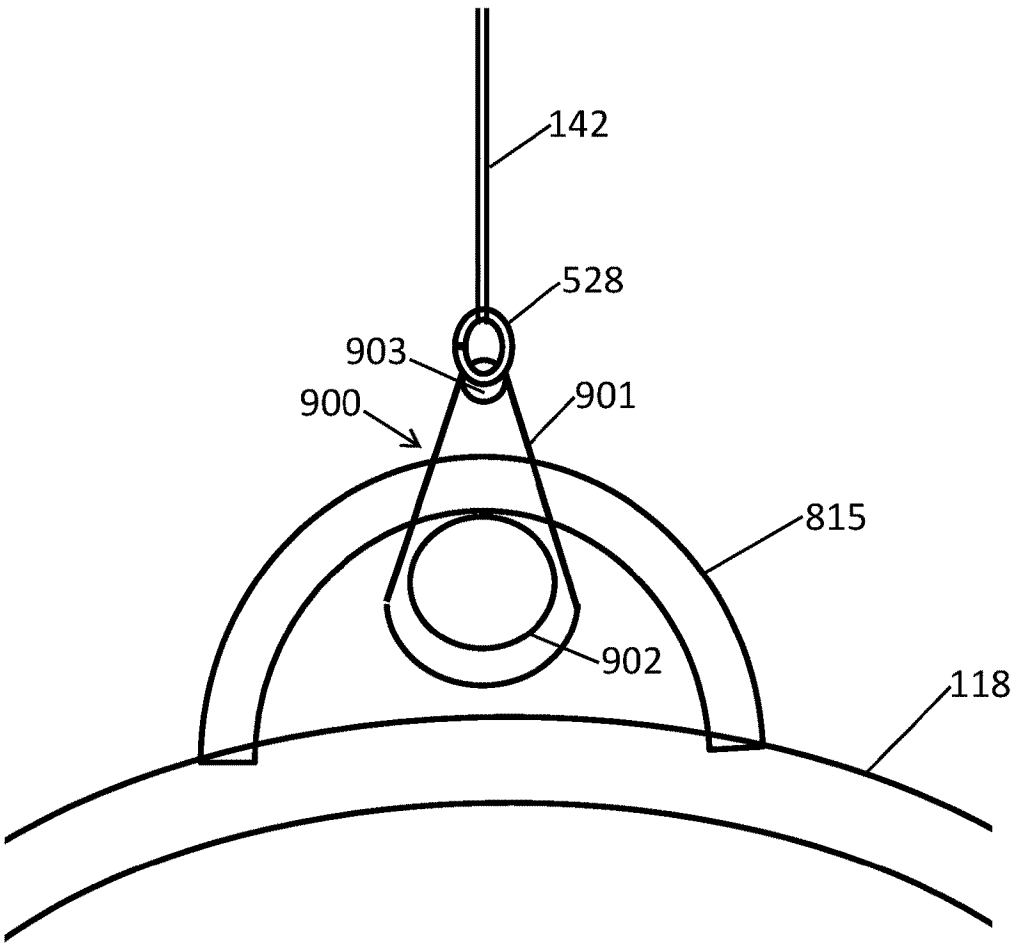
FIG. 78 shows a schematic plan view of a portion of the device of FIG. 77.

FIG. 78 shows a schematic plan view of a portion of the device 800 comprising the pulley 900. The pulley 900 comprises a housing 901 and a pulley wheel 902 rotatably mounted within the housing 901. The pulley 900 further comprises an aperture 903 for attaching the carabiner 528 to the pulley 900. When the pulley 900 is attached to the section of the upper rail 815, or any other section of the upper or lower rail 815, 816, the section of rail sits between the pulley wheel 902 and the aperture 903. When tension is provided in the resistance member 142, the pulley wheel 902 engages the section of rail to aid sliding of the carabiner 528 from one end of the section of rail to the other end, as described with reference to FIGS. 71 to 76.

Figure 79:
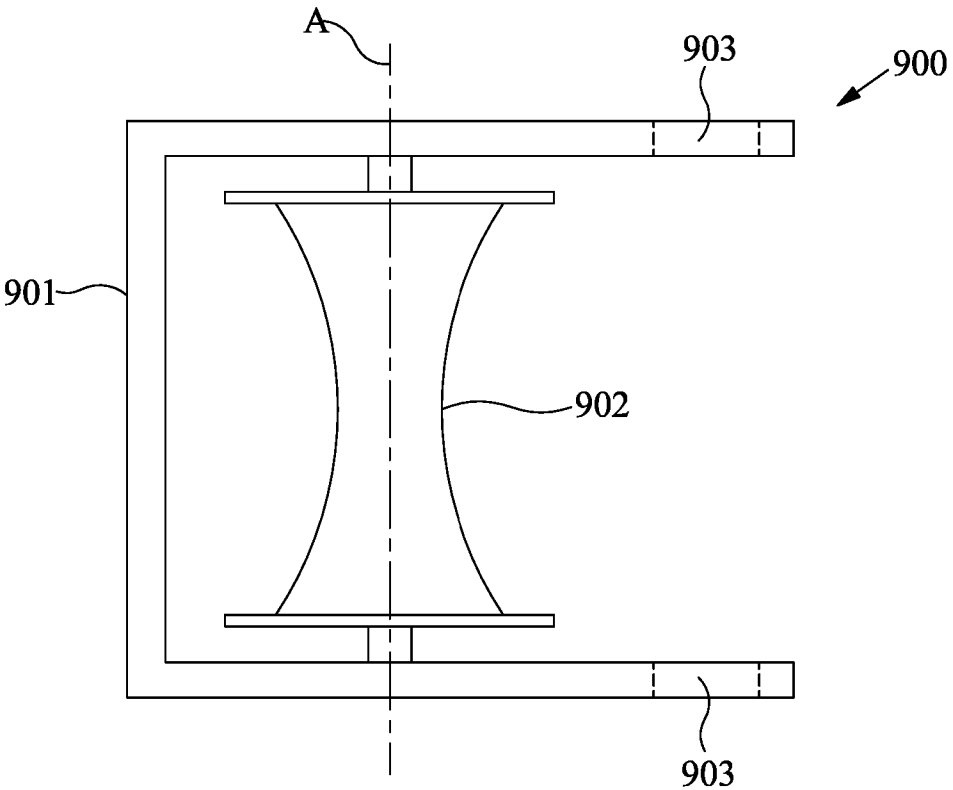
FIG. 79 shows a schematic side view of the pulley of the device of FIG. 77.

FIG. 79 shows a schematic side view of the pulley 900. The housing 901 is open at one end and at the sides. The aperture 903 is located towards the open end of the housing 901 and is formed of an upper part and a lower part. The pulley wheel 902 is rotatably mounted between upper and lower parts of the housing 901. The circumferential surface of the pulley wheel 902 is concave towards the axis of rotation 'A' of the pulley wheel 902.

Figure 80:
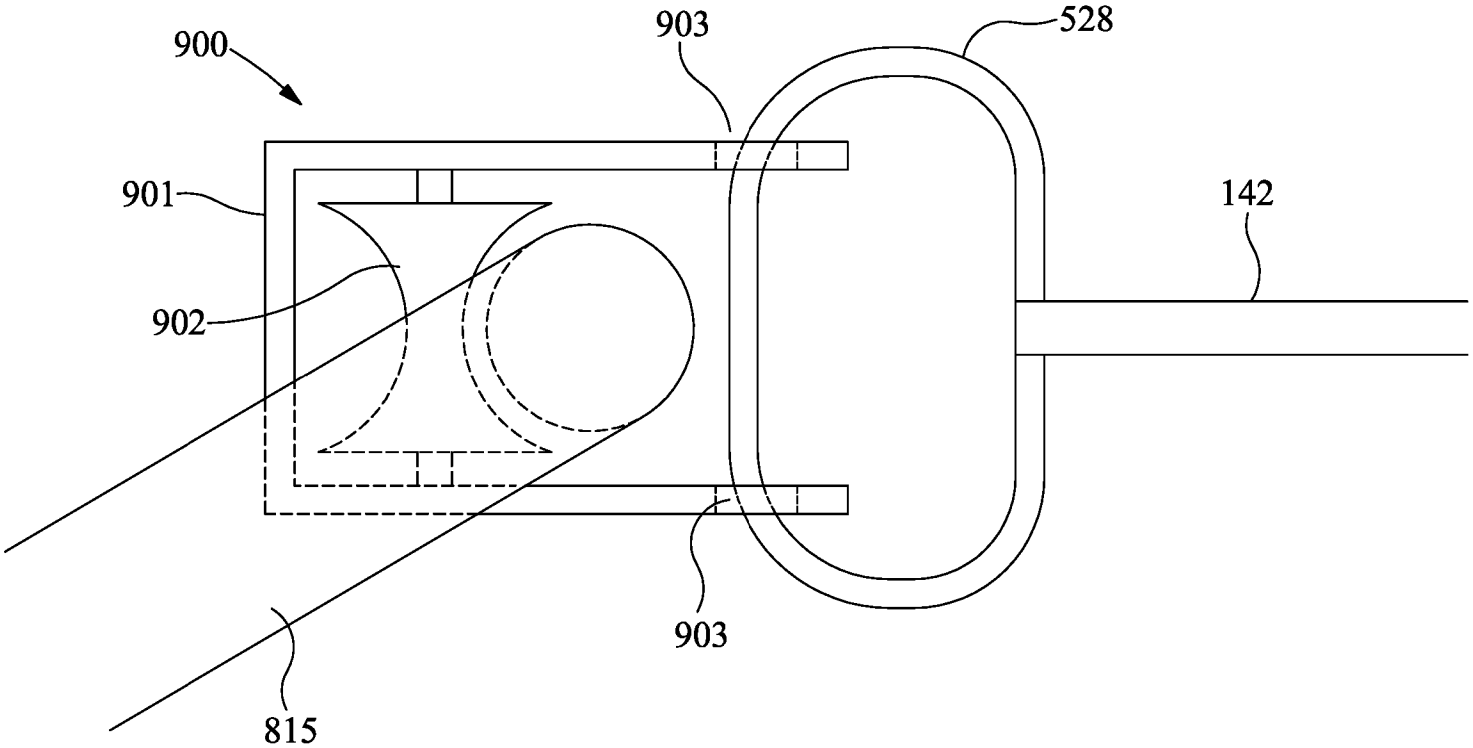
FIG. 80 shows a schematic side view of a portion of the device of FIG. 77 comprising the pulley.

FIG. 80 shows a schematic side view of a portion of the device 800 comprising the pulley 900 with the resistance member 142 in tension. The concave circumferential surface of the pulley wheel 902 is complementary to the engaged portion of the section of the upper rail 815. This aids sliding of the carabiner 528 from one end of the section of rail to the other end, as described with reference to FIGS. 71 to 76. To attach the resistance member 142 to the section of the upper rail 815, a user first receives the section of rail through the open end of the pulley housing 901. The user then threads the carabiner 528 through the aperture 903, either with the resistance member 142 attached to the carabiner 528 or before attaching the resistance member 142 to the carabiner 528. The carabiner 528 then prevents the pulley 900 from falling off the section of the upper rail 815 through the open end of the pulley housing 901.

Figure 81:
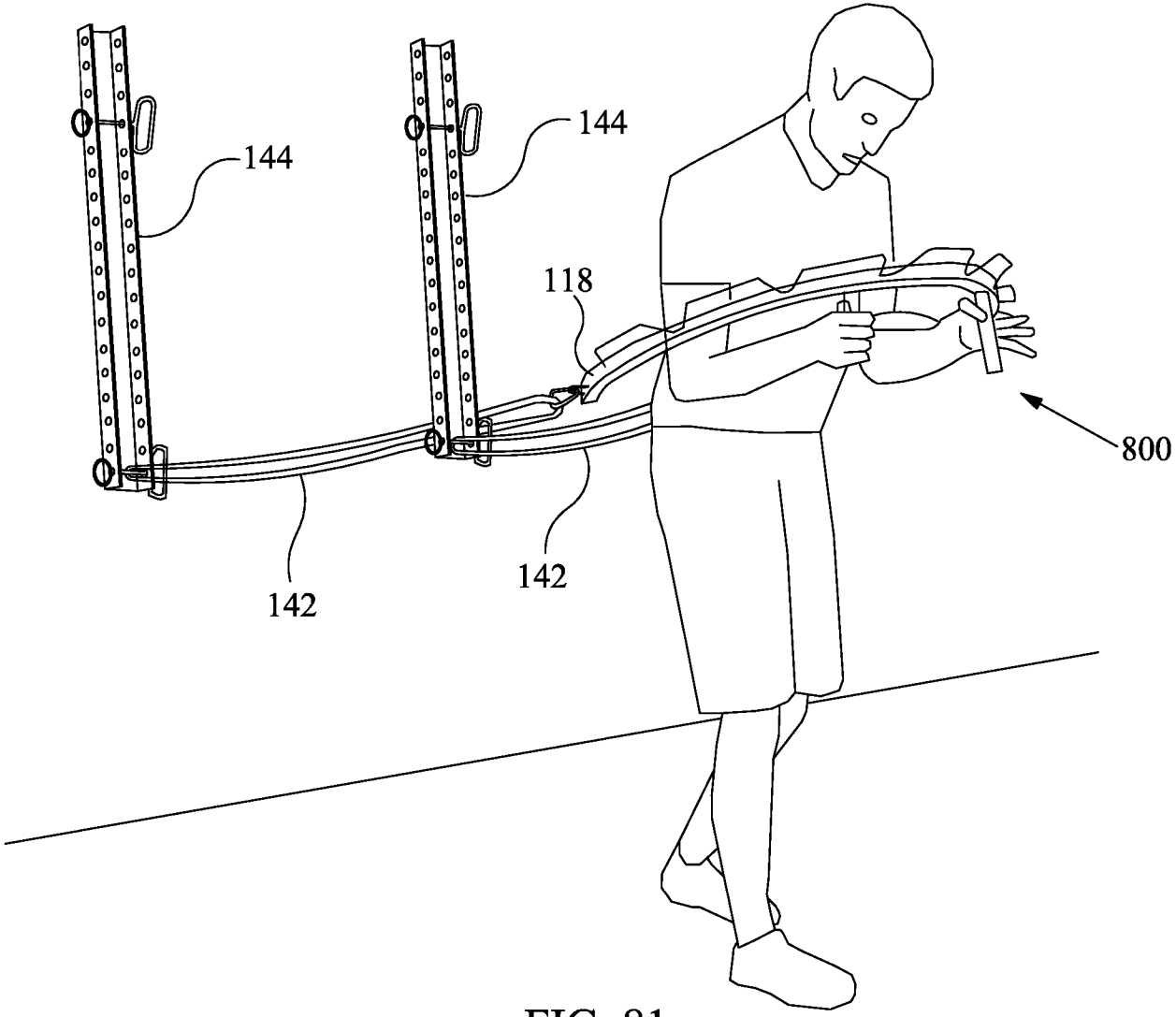
FIG. 81 shows the device of FIG. 65 in use.

FIG. 81 shows the device 800 in use. For clarity, not all of the features of the device 800 are labelled in FIG. 81. In this example, each end of the second frame member 118 of the device 800 is attached to a resistance member 142 at a first end of the respective resistance member 142. Each end of the second frame member 118 may be attached to the respective resistance member 142 by means of one of the attachment points 820 shown in FIG. 70 and a carabiner, for example. In other examples, each resistance member 142 may be attached to the second frame member 118 at any suitable location along the second frame member 118.

A second end of each resistance member 142, opposite the respective first end, is attached to an external resistance point 144. In this example, each external resistance point 144 comprises a bracket mounted to a wall by suitable means, such as one or more bolts. The user is facing away from the wall, with the device 800 in front them, and is gripping the handles of the device. The user can then rotate in either a clockwise or anticlockwise direction from the position shown to train the core muscles. In the example of FIG. 81, there is no resistance member received in the radially outwardly facing channel of the device 800. This demonstrates that the device 800 can optionally be utilised without a resistance member received in the radially outwardly facing channel. A similar use may involve a single resistance member attached at a first end of the resistance member to the second frame member 118 at any suitable location along the second frame member 118, and a second end of the resistance member, opposite the first end, attached to a suitable external resistance point.

The various features and characteristics of the examples and embodiments described within this specification are interchangeable between the various examples and embodiments. Any attachment means, adjustment means, methods of using the device, to name just a few examples, are not limited to the example with which they are associated in the description but may be added or substituted in to any of the other examples and embodiments of the exercise device.

I claim:

1. An exercise device for exercising core muscles of a user's torso, the exercise device comprising:

a frame, configured to be supported by the user; and a radially outwardly facing channel, wherein the channel is configured to receive an elongate resistance member, the channel comprising at least one of a concave outwardly facing channel and an outwardly facing flat sided and V-shaped channel;

wherein the channel is configured in use to cause the elongate resistance member that is in use in the channel to be urged towards the centre of the channel by the shape of the channel; and wherein the frame defines an aperture configured to receive a torso of the user, and wherein the device is configured to provide a resistance force against which the user can exercise when in use.

2. The exercise device according to claim 1, wherein at least one of i) the frame is configured to be supported by the user such that in use the frame is supported by the forearms of the user with the user's forearms substantially parallel to the ground, and ii) the aperture is an open aperture, in that the frame does not completely surround a user when the device is in use, and wherein the frame extends in front of the user, at least partially to the sides of the user, and not behind the user when the device is in use.

3. The exercise device according to claim 1, wherein the frame comprises a maximum thickness measured substantially perpendicularly to a width of the frame, wherein a maximum width of the frame is at least two times the maximum thickness of the frame.

4. The exercise device according to claim 1, wherein the frame is formed from an outer curved member and an inner member that meet at junctions between the outer curved member and the inner member; and at least one of i) wherein the inner member is curved and comprises an arc with a radius of curvature greater than a radius of curvature of an arc of the outer curved member, and ii) wherein the inner member is flexible.

5. The exercise device according to claim 1, wherein the frame has at least one of a curved bow and crescent shape.

6. The exercise device according to claim 1, comprising at least one of i) a plurality of attachment points for attaching the resistance member to the frame, and ii) an attachment point for attaching the resistance member at a centre point of the frame.

7. The exercise device according to claim 1, wherein the channel is discontinuous.

8. The exercise device according to claim 7, wherein the frame comprises a first frame section and a plurality of second frame sections extending radially outwardly from the first frame section, wherein each of the second frame sections comprises part of the channel.

9. The exercise device according to claim 7 comprising an upper rail and a lower rail, wherein each of the upper rail and lower rail are coupled to the frame by a joint at a plurality of points along a length of the frame, wherein the rails and the joints form the discontinuous channel.

10. The exercise device according to claim 9, wherein at least one of i) one or more of the plurality of joints coupling the upper rail to the frame is aligned along a length of the frame with one or the plurality of joints coupling the lower rail to the frame, and ii) each of the upper rail and the lower rail comprises a plurality of sections, wherein each section extends form the frame and each joint is located at an apex between adjacent sections.

11. The exercise device according to claim 9, wherein the resistance member is attachable to at least one of the upper rail and the lower rail, and, wherein the exercise device comprises a pulley for attaching the resistance member to at least one of the upper rail and the lower rail, wherein the pulley comprises a pulley wheel rotatably mounted within a housing and an aperture for attaching the resistance member to the pulley, wherein the rail sits between the pulley wheel and the aperture of the pulley when the resistance member is attached to the rail via the pulley.

12. The exercise device according to claim 1, wherein the frame comprises a box section, wherein the box section is formed from metal.

13. The exercise device according to claim 1, comprising at least one of (i) an indicator to provide a user of the device with information relating to their use of the device; (ii) a mount for mounting an electronic device to the exercise device; and (iii) an attachment for attaching an electronic device to the exercise device.

14. The exercise device according to claim 1, wherein the frame lies on a plane and the channel is extended at one or more points in a direction having a component transverse to the plane, and wherein the extension or extensions to the channel comprise one or more shields to protect a user of the device in the event of accidental disconnection of the resistance member, wherein the one or more shields are releasably attachable to the frame.

15. The exercise device according to claim 1, further comprising handles for providing a device supporting means to the user, and wherein the handles are at least one of (i) multiple sets of handles to provide differing hand/arm positions for the user when the device is in use, (ii) adjustable relative to the frame to provide differing hand/arm positions for the user when the device is in use, and (iii) adjustable relative to the frame, wherein the frame defines one or more slots configured to receive the handles and the handles are angularly moveable within the slots, wherein the handles are securable at a plurality of positions within the slots.

16. The exercise device according to claim 15, wherein at least one of:

(i) the handles are pivotable relative to the frame, (ii) each handle comprises two upright sections and a transverse section extending between the upright sections, and (iii) the frame is formed from an outer curved member and an inner member that met at junctions between the outer curved member and the inner member, wherein the handles are attachable to the outer curved member.

17. The exercise device according to claim 1, wherein the aperture is partly defined by the frame and partly defined by another component, wherein the other component comprises at least one of a strap and a support, and wherein the exercise device comprises a lumbar support attached to the at least one of a strap and support or formed within the at least one of a strap and support, and wherein the frame has a curved bow or crescent shape and the at least one of a strap and support extends in use from the ends of the bow or crescent shaped frame.

18. The exercise device according to claim 1, further comprising a plurality of resistance members attached to the frame.

19. A kit of parts comprising:

the exercise device of claim 1 and a resistance member; and a set of instructions for providing a user with methods of using the device; and a stability training device.

20. An exercise device for exercising core muscles or a user's torse, the exercise device comprising:

a frame, configured to be supported by the user;

an elongate resistance member; and a radially outwardly facing channel, the channel having a depth of at least four times the diameter of the elongate resistance member;

wherein the channel is configured to receive the elongate resistance member, the channel comprising at least one or a concave outwardly facing channel and an outwardly facing flat sided and V-shaped channel;

wherein the channel is configured in use to cause the elongate resistance member that is in use in the channel to be urged towards the centre of the channel by the shape of the channel;

wherein the frame defines an aperture configured to receive a torso of the user, wherein the frame further comprises a first frame section and a plurality of second frame sections extending radially outwardly from the first frame section, wherein each of the second frame sections comprises part of the channel, and wherein the device is configured to provide a resistance force against which the user can exercise when in use; and wherein the channel extends between the handles such that, in use, at least a portion of the channel is positioned in front of the user.

* * * * *